US012716179B2

(12) United States Patent
Picard

(10) Patent No.: US 12,716,179 B2
(45) Date of Patent: Aug. 25, 2026

(54) METHOD FOR THE CONSTRUCTION AND SUSTAINABLE MANAGEMENT OF A HYBRID TURF SPORTS GROUND WITH WATER TABLE AND HYBRID TURF SPORTS GROUND

(71) Applicant: NATURAL GRASS, Paris (FR)

(72) Inventor: Edmond-Pierre Picard, Saint Sulpice de Favères (FR)

(73) Assignee: NATURAL GRASS, Paris (FR)

( * ) Notice: Subject to any disclaimer, the term of this patent is extended or adjusted under 35 U.S.C. 154(b) by 788 days.

(21) Appl. No.: 18/004,212

(22) PCT Filed: Jul. 6, 2021

(86) PCT No.: PCT/FR2021/051252
§ 371 (c)(1),
(2) Date: Jan. 4, 2023

(87) PCT Pub. No.: WO2022/008842
PCT Pub. Date: Jan. 13, 2022

(65) Prior Publication Data

US 2023/0287633 A1 Sep. 14, 2023

(30) Foreign Application Priority Data

Jul. 6, 2020 (FR) ..... 2007122

(51) Int. Cl.
*E01C 13/08* (2006.01)

(52) U.S. Cl.
CPC ..... *E01C 13/083* (2013.01); *E01C 2013/086* (2013.01)

(58) Field of Classification Search
CPC ... E01C 13/08; E01C 13/083; E01C 2013/086
See application file for complete search history.

(56) References Cited

U.S. PATENT DOCUMENTS

| | | | | |
|---|---|---|---|---|
| 10,208,434 | B2 * | 2/2019 | van Raam | E01C 13/02 |
| 2017/0094919 | A1 | 4/2017 | Sternberg | |
| 2020/0205334 | A1 * | 7/2020 | Sternberg | A01B 45/02 |
| 2021/0156095 | A1 * | 5/2021 | Sternberg | A01G 25/06 |

FOREIGN PATENT DOCUMENTS

| | | | |
|---|---|---|---|
| BR | PI0604071 | A * | 4/2008 |
| FR | 2556381 | A1 | 6/1985 |
| WO | 198500631 | A | 2/1995 |

* cited by examiner

*Primary Examiner* — Frederick L Lagman
(74) *Attorney, Agent, or Firm* — LEASON ELLIS LLP

(57) ABSTRACT

The invention relates to a method for the construction and sustainable management of a hybrid turf sports ground, with management of a shallow water table in the structure of the sports ground, which comprises: a first step of constructing a structure (S) placed on a base (F), the structure comprising N stacked porous layers (Ci); a second step of installing turf on the surface of the top layer (Ci), the installation of the turf possibly being carried out by sowing; and, of the N layers, one hybrid layer (H) is constituted either (i) by a cultivation substrate that comprises synthetic reinforcing elements, or (ii) by a cultivation substrate that shares the space of the hybrid layer (H) with synthetic reinforcing elements.

18 Claims, 5 Drawing Sheets

Fig. 1
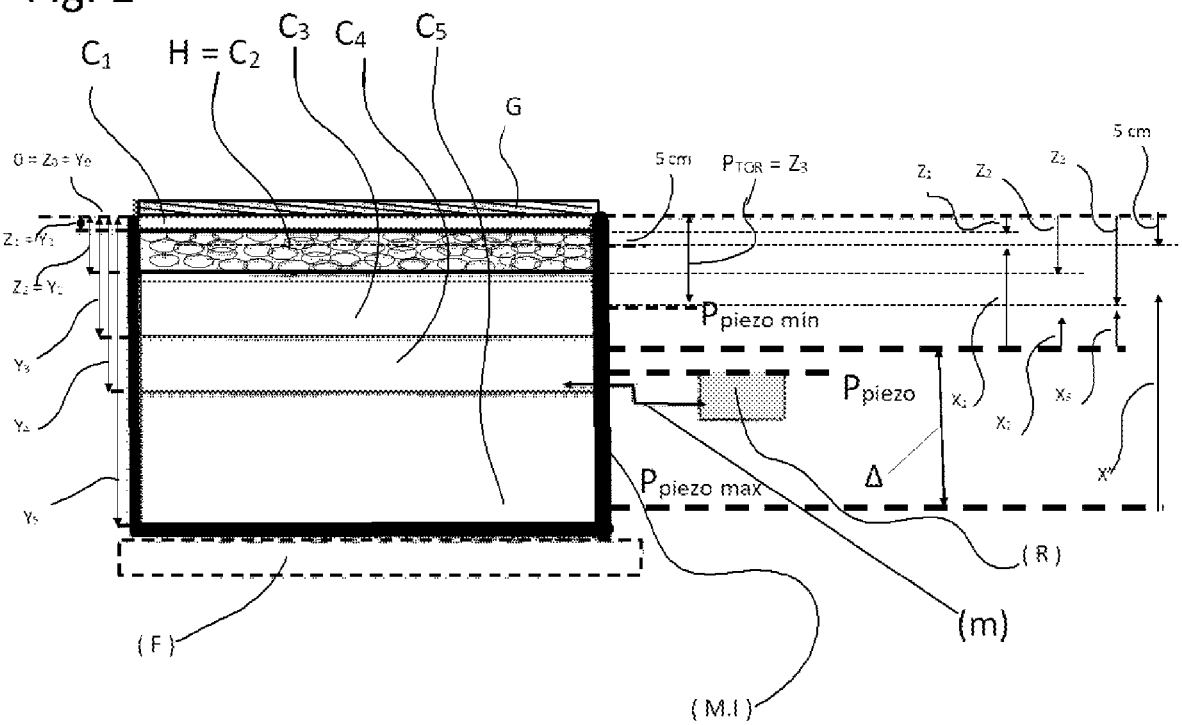
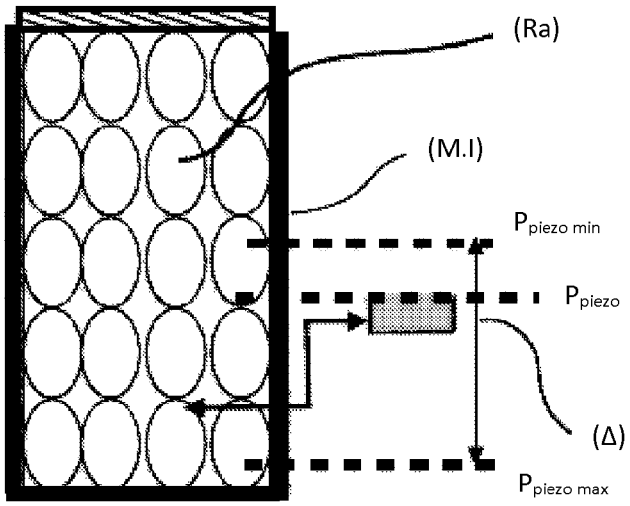
Fig. 2A

[Fig. 2B]
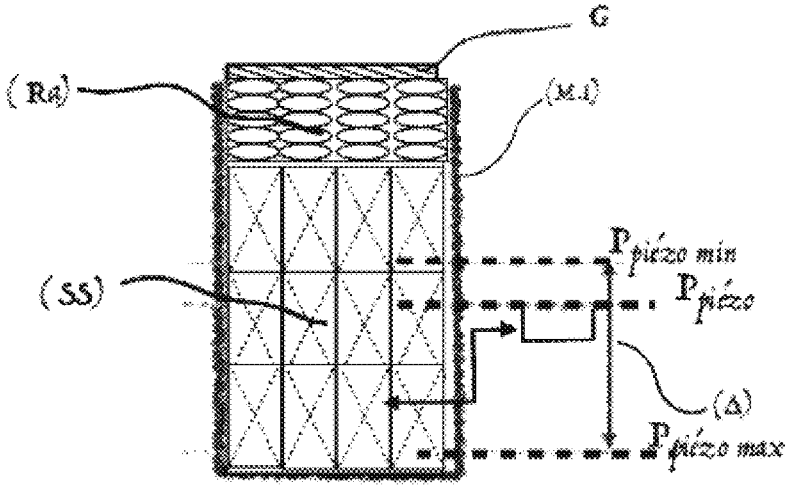
[Fig. 2C]
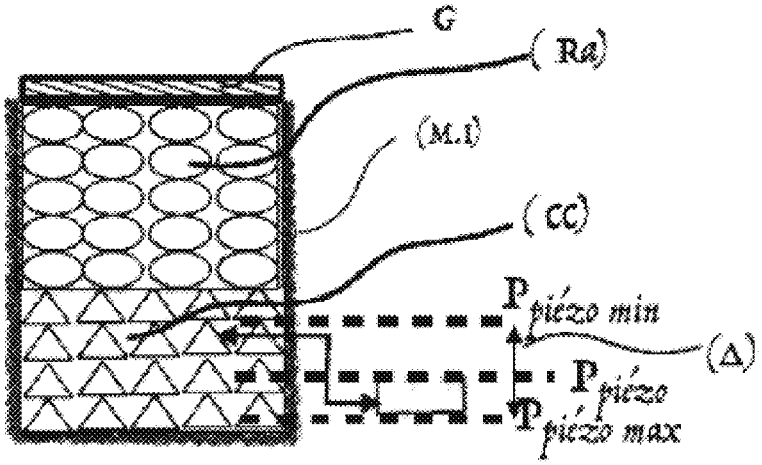

[Fig. 2D]
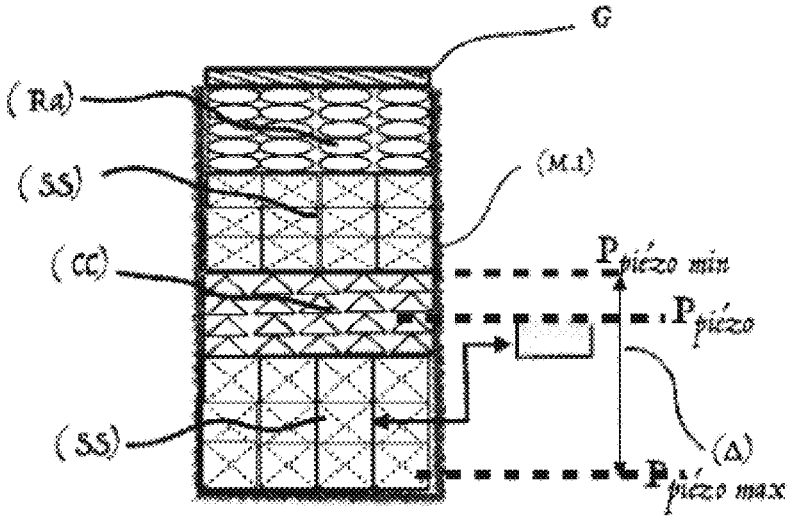
[Fig. 3]
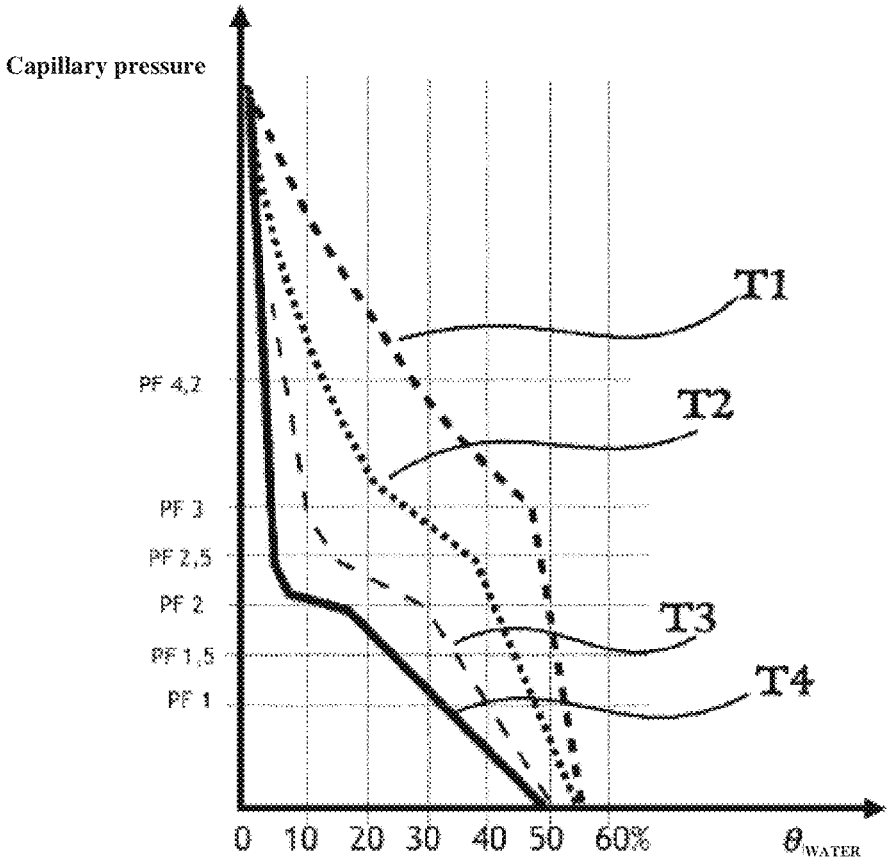

[Fig. 4A]
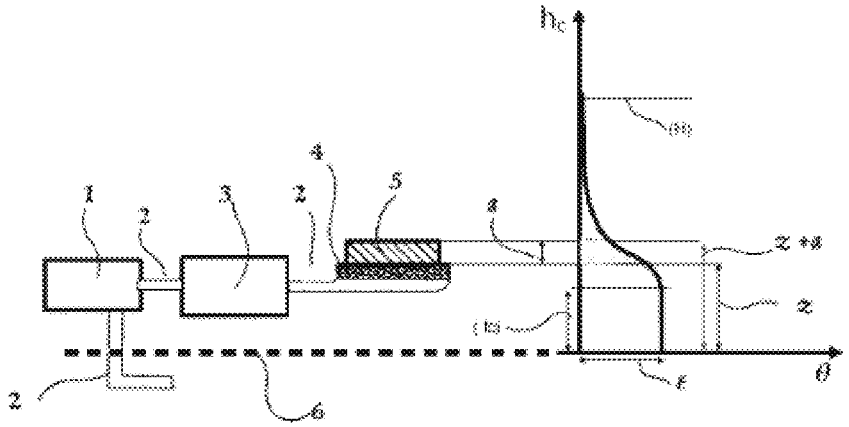
[Fig. 4B]
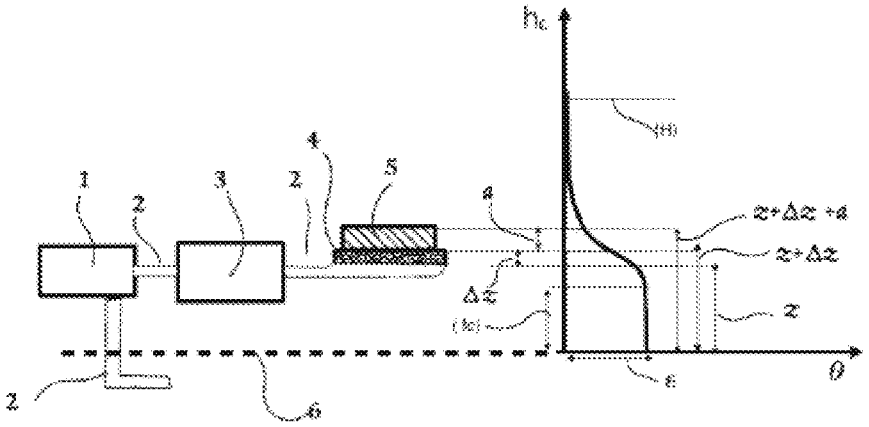

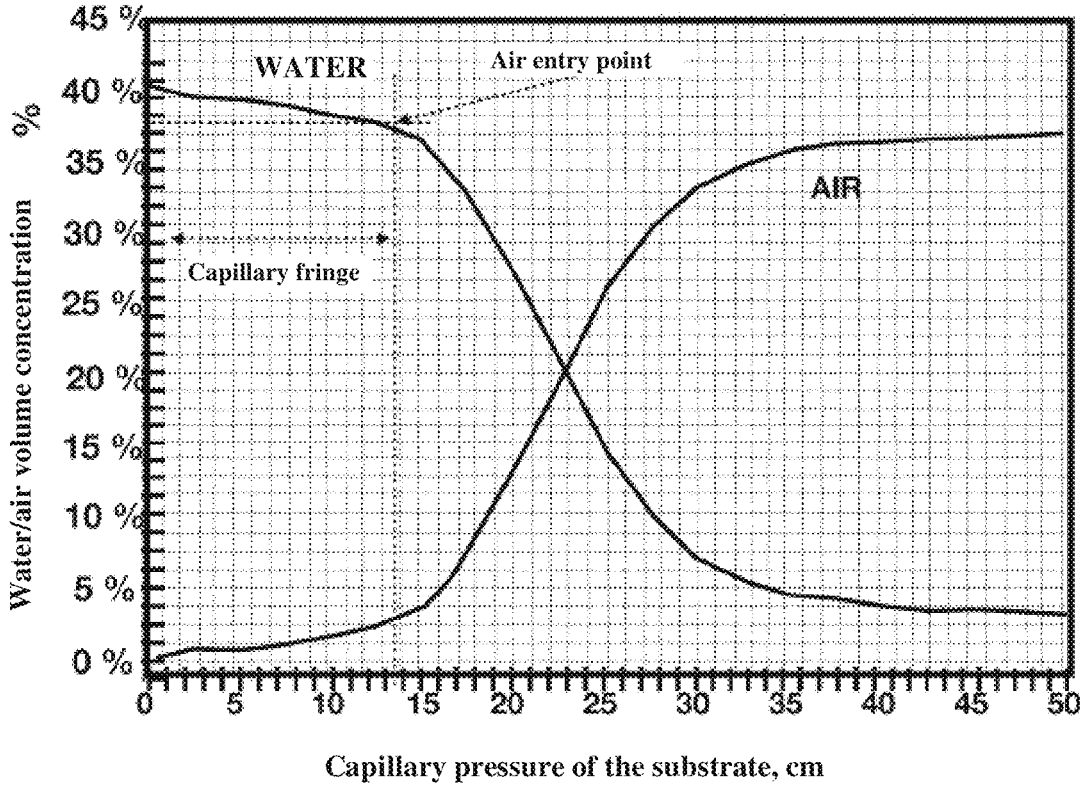
[Fig.5]
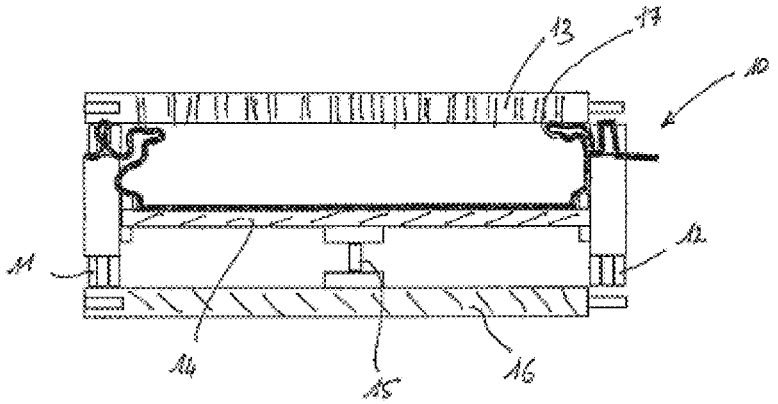
[FIG.6]

METHOD FOR THE CONSTRUCTION AND SUSTAINABLE MANAGEMENT OF A HYBRID TURF SPORTS GROUND WITH WATER TABLE AND HYBRID TURF SPORTS GROUND

CROSS-REFERENCE TO RELATED PATENT APPLICATIONS

This application is a U.S. National Stage Application under 35 U.S.C. § 371 of International Patent Application No. PCT/FR2021/051252 filed Jul. 6, 2021, which claims the benefit of priority of French Patent Application No. 2007122 filed Jul. 6, 2020, both of which are incorporated by reference in their entireties. The International Application was published on Jan. 13, 2022, as International Publication No. WO/2022/008842 A1.

This invention relates to a method of construction and sustainable management, in particular water-saving, of a hybrid turf sports ground, with a water table at an adjustable level in the structure, with sufficient sub-irrigation of the roots via spontaneous capillary action from the water table, while respecting the oxygenation and aeration needs of the substrate and the roots and with a water concentration conducive to the good mechanical performance of the sports soil.

In a preferred embodiment, the method even provides water autonomy for the ground, i.e. a ground that can do without water from the network for its irrigation.

In another preferred embodiment, compatible with the foregoing, the method also proposes an eco-responsible process of active oxygenation of the roots and convective climate control of the substrate and the turfed surface.

The sustainable hybrid turf sports ground according to the invention comprises a structure (S) laid on a base (F), this structure comprising (i) one or more stacked homogeneous porous layers, including at least one hybrid playing layer (H), (ii) a turf whose roots are anchored in this hybrid playing layer (H) and (iii) means allowing for the bringing of the water into the structure or to evacuate it from it, to constitute therein a water table (N) and to manage the piezometric level inside the structure (S) at a shallow depth ($P_{piezo}$), which can vary between a minimum depth ($P_{piezo\ min}$) and a maximum depth ($P_{piezo\ max}$).

This invention can be used in all climates, in particular temperate climates, dry climates in summer and climates with heavy winter precipitation of the Mediterranean type, or tropical climates. This invention also addresses the situation of salty irrigation water that is relatively frequent in tropical or sub-Mediterranean areas.

The invention relates to 3 systems, corresponding to 3 steps of the invention:

The first part of the invention is a first system that relates to the general scope of the invention. A set of rules concerning the choice of the composition of the substrate and the management of the development over time of the depth of the water table in the structure as a function of the main capillary curve of the said substrate makes it possible to guarantee spontaneous capillary irrigation ensuring the needs of the turf in terms of irrigation, oxygenation of the roots and aeration of the substrate.

The second part of the invention is within the framework of the system developed in the first part, in the particular case where the structure comprises a specific storage layer that performs well but has a fixed storage volume. The invention then makes it possible to minimize the consumption of water from the outside by a system for managing the depth of the water table as a function of time on the basis of the constraints defined in the first part of the invention, in order to optimize the storage of precipitation water in the water table for irrigation of the lawn over time. The system also preferably determines the desired thickness of the substrate layer above said storage layer. Furthermore, in the event that said water storage layer has a mechanically rigid top surface, an additional constraint in terms of maximum water table depth is provided to ensure sports soil flexibility despite the presence of said mechanically rigid top surface.

The third part of the invention is also within the framework of the system developed in the first part and relates to an alternative solution to overcome the shortcomings of the storage layers known in the state-of-the-art. The proposed use of vertically movable base containers and new associated resources allows for the best possible management of the depth of the water table, at a depth independent of the quantity of water stored, in order to be able to conserve water from winter precipitation and use it in summer for irrigation, to choose the level of the water table independently of the amount of water stored in order to optimize the spontaneous efficiency of capillary action, to oxygenate and cool the substrate by upward and downward conveyance of water from the water table through the substrate, in an optimal way and at a lower energy cost.

The general purpose of the invention is to provide criteria for achieving 4 objectives that serve as a framework for the invention, and 2 additional objectives within this framework:

- In the part of the substrate below the surface in which root development is desired, referred to here as the "root oxygenation zone," it is important to avoid a sufficiently high and long-lasting drop in the amount of oxygen in the substrate porosity at the roots. The objective is to avoid having a negative effect on root development, a phenomenon that is particularly frequent in winter in temperate climates if the substrate is too close to the level of a water table in nature or if the thickness of the substrate above a drainage layer is insufficient in the case of sports grounds classically made with substrate on a drainage layer.
- In hot weather, too high a water concentration near the surface should be avoided, since insufficient air concentration near the surface in hot weather favors the development of disease, whereas a profile of increasing water concentration with depth with sufficient air concentration at the surface is the best possible means for preventing disease, at least as long as the plants are not otherwise stressed by lack of irrigation water.
- In all seasons, and especially in summer and during heat waves, the spontaneous capillary flow of water from the water table must provide the roots with enough water to allow the turf to provide an actual evapotranspiration as close as possible to the potential evapotranspiration.
- During athletic use of the ground and in particular in the case of projects where the constructional structure includes a hard layer for water storage, the sports ground must be flexible, i.e. provide a dampened response in reaction to the mechanical stresses of the physical activity. It has been found that this flexibility above a hard layer is increased by 40% if there is a "perched layer" of at least 4 cm, i.e. a quasi-saturation by capillarity of the substrate placed just above said hard storage layer.

The first two objectives to be achieved give rise, according to the invention, to criteria of minimum depth of the water table, while the next two give rise to criteria of maximum depth of the water table. Moreover, these 4 water table depth criteria (2 minimum and 2 maximum) all depend on the characteristics of the substrate.

Once these first 4 objectives have been achieved, which serve as a general framework for the invention, the purpose of the invention is to achieve 2 additional specific objectives:

To minimize the thickness of the layers in order to minimize the costs and the consumption of water from the outside by optimizing the management of the depth of the water table in order to store the precipitation water intended for irrigation of the turf deferred over time for the layers known in the state-of-the-art, with a constant storage volume, while respecting the needs of the turf.

To optimize water storage, oxygenation and climate control of the substrate, the turfed surface and its environment by convection of water from the water table or air by proposing and implementing new storage means with a variable storage volume allowing better use of the water table and consisting of containers with a mobile base.

The particular feature of the invention is that it sufficiently specifies the type of substrate and the rules to be respected as a function of the substrate to enable all of these conditions to be respected, even though they are generally incompatible with each other.

In its very concept, the approach of the invention differs from the state-of-the-art on 4 points:

The 1st point: the innovative principle of the invention in determining the conditions to be met is to consider that the depth of zero capillary pressure equal to the depth of the water table is variable over time and can be written as:

$$P=P_1+P_2(t)$$

$P_1$ being the depth of a point where we want to observe the effect of the depth of the water table, such as 5 cm from the surface to see the effect of the water table on root oxygenation at 5 cm from the surface. This is a point that is looked at as a key point in time but the depth does not vary with time.

On the contrary, $P_2$ (t) is the overdepth of the water table at a time t and can therefore vary according to a strategy developed according to the invention. Taking into account the zero capillary pressure depth with respect to the point of depth $P_1$, corresponding to the additional depth $P_2$ of the water table between the point considered and the water table, is a first new and fundamental degree of freedom introduced by the situation of the existence, according to the invention, of a water table which fixes the depth of the zero capillary pressure.

Secondly, taking into account the variation with respect to time of this additional depth of the water table $P_2$ (t) by following a given scenario according to the invention is a second additional fundamental degree of freedom, constituting in its simple concept a completely new approach, opening up very broad possibilities.

However, an analysis of the objectives targeted by the invention shows that they are all objectives concerning only a given period of time and essentially depend, at least in some cases, on an accumulation of effects in the period of time preceding said given period of time.

The determination of the evolution in time of the depths of the water table is therefore a new and essential element of the invention.

The 2nd point: the principle chosen to ensure root oxygenation.

It is conventional in the state-of-the-art to mistake the need for oxygenation of roots for a permanent need for "sufficient" air concentration. However, the oxygen problem of the roots, if it indeed depends on the air concentration, does not depend on the instantaneous air concentration or on the permanent air concentration but on a cumulative effect over a long period linked to the air concentration.

As a result, the approach according to the invention is to seek a way to increase the air concentration, but only a little and only from time to time, rather than seeking to have a "good" air concentration all the time, on the basis that oxygen convection by drainage from time to time is a thousand times more effective than a permanent diffusion of oxygen requiring a permanently "good" air concentration.

The invention is therefore based on the choice of a scenario $P_2$(t) with a minimum depth of the water table to be respected "from time to time," the minimum depth of the water table being determined according to the invention from the capillary drainage curve of the turf cultivation substrate.

In a perspective of sustainable development, the invention's approach is to impose a depth of water table scenario that allows for oxygenation of the roots using the play of spontaneous equilibrium under the effect of gravity and capillarity without the need for additional direct action. This does not prevent such additional means from being proposed according to the invention in preferred embodiments.

The 3rd point: the principle chosen to ensure irrigation.

Contrary to the principles usually used in the state-of-the-art, the principle used in the invention is not to be concerned with the water concentration at the level of the roots, but only with the conditions of sufficient capillary flow to meet the evaporative climate demand.

Based on fairly recent scientific results concerning capillary flow through a substrate with a shallow water table in the presence of evaporative demand, the principle adopted is simply to determine a maximum depth of the water table and a type of substrate that will guarantee satisfactory capillary irrigation, regardless of the water concentration (at capillary equilibrium or during flow) at the depth of the roots.

The 4th point: the principle chosen to optimize water storage.

The water storage system must already have a water storage volume of sufficient size in relation to the needs, but it must also be possible to fill and empty it in accordance with the temporal distribution of the needs and according to a filling and emptying chronology that also respects the previously determined rules of water table depth.

A first step of analysis of these constraints highlights the limits of the storage layers already known from the state-of-the-art and proposes a strategy of the evolution curve over time of the water table depth in order to optimize the use of these layers already known from the state-of-the-art.

A second step towards the proposal of a new type of storage layer with a movable base offers the possibility of a water table depth that is independent of the quantity of water in storage and allows for submersion and emptying in order to actively condition the temperature and oxygenation by convection of water from the water table or convection of air passing through the water table.

The purpose of the invention is generally to allow for sustainable management of a turf field by a coherent choice of materials and thicknesses of the field's constituent layers and by adjusting the depth of a water table in the structure at various key moments, in order to make the ground's resistance and flexibility, spontaneous hydration by capillarity and good oxygenation of the roots compatible, as well as summer aeration conducive to the natural prevention of diseases during heat waves.

A contribution in a particular embodiment with more efficient and more expensive storage layers is the determination of a strategy for managing the water table depth according to the seasons and precipitation, respecting the constraints determined previously, in order to minimize the consumption of water from the network by optimizing the capacity to use the precipitation water for the deferred irrigation of the turf.

Another contribution in a particular embodiment is the proposal of new means of storage of precipitation water in the water table of the structure with vertically mobile tanks, allowing water autonomy, especially in a Mediterranean climate, by storing a large quantity of water in the rainy season in the water table located in the said tanks, this quantity of water being then usable in a deferred way during the dry season for capillary irrigation of the turf.

Another contribution of the invention in a particular embodiment of a tank with a vertically mobile base is to allow for active management allowing for the optimal oxygenation of the roots and the ideal thermal conditioning of the substrate and the turf and its environment by using only the calorific resources naturally present in the environment with a marginal mechanical energy consumption.

The favorable conditions of the first targeted input make possible the second targeted input which itself creates the favorable conditions for the third targeted input.

The various possible embodiments of the invention thus combine in multiple ways the various means implemented by the method of managing the hybrid turf field and which all contribute to the realization of all or part of these targeted inputs; These means include in particular:

- the determination of a type of substrate and a maximum water table depth for the satisfactory capillary hydration of the turf,
- the determination of a minimum water table depth to be respected according to a determined evolution over time for the aeration and oxygenation of the roots,
- the determination, in the presence of a water storage layer requiring the addition of artificial capillary means to ensure the capillary function of the system, of a strategy for the water table depth and the determination of the maximum thickness of the substrate placed on the said layer to optimize the water storage capacity,
- the use of a new type of water storage layer, with a vertically mobile base for the storage of precipitation water in the rainy season to be used in a deferred manner in the dry season, for climate control by convection and optimal oxygenation of the roots through cycles of submergence-draining of the substrate.

In summary, the ground management process is particularly characterized by the determination, depending on the substrate, of minimum depths that the water table must respect at certain key moments.

The approach of the invention is to consider the objectives to be reached and to translate them into intermediate objectives relating to the water concentration curve and to capillary flows. Another aspect of the invention is to consider the chronology of the desired effects, to note that they do not all have the same chronological cycles and to deduce from this a management of the evolution over time of the water table depth in order to achieve all the objectives, not necessarily all at the same time but all at the necessary moment.

Another particular aspect of the invention is to deviate, with regard to capillarity, from the principles that are very commonly accepted in the state of the art but are often simplistic and erroneous, and to consider in a more refined manner the contributions of scientific works relating to capillarity in porous media. Some of them are quite recent, in order to deduce through an innovative analysis the conditions relative to the nature of the substrates and to the management of a water table that would allow the achievement of the intermediate objectives fixed during the first phase of analysis in terms of water concentration curve and capillary flow.

Finally, another important aspect of the invention is that, in spite of all the constraining relationships imposed by the invention, the latter finally makes it possible to meet the entire range of requirements encountered on sports fields, so that the invention, with its great variety of embodiment possibilities, ultimately concerns a complete range of hybrid turf sports grounds, ranging from the construction of the ideal ground to, for example, the inexpensive restoration, with partial reuse of the materials in place, of existing grounds initially operating on a drainage layer.

In general, the invention relates to an installed sports ground, with a root development zone on the upper part, of a thickness $P_{TOR}$ (depth of the root oxygenation layer) placed on a lower zone in which it is possible to manage the water table level.

The root development zone can itself be made up of a single-layer substrate or a multilayer substrate. In all cases, it includes a hybrid substrate layer. The lower zone can also be made up of a single layer or of several stacked layers. In addition, the upper layer of the lower zone may have the same composition as the lower layer of the root development zone, without discontinuity. The distinction is simply that the requirements in terms of oxygenation concern a root oxygenation zone, the thickness of which is between 5 cm and 15 cm, depending on the choice of requirements for the different designs.

In order to describe to a person skilled-in-the-art the spontaneous operating method of a turfed area according to the invention and comprising a water table in its structure, and the proposed management methods according to the invention of the said water table, with a general description that adapts to the great diversity of areas and management methods made possible by this invention, it is practical to consider grounds according to the invention as composed of a substrate laid on a storage layer intended for the storage of water in the water table, this water being intended for the subsequent irrigation of the turf by capillary action and the depth of the water table being decisive for the behavior of the water within the substrate itself.

It is important to note that this description of a substrate on a storage layer may lead to the consideration of a boundary between the substrate and the water storage medium, which may be completely artificial. This boundary does not necessarily correspond to a discontinuity in the structure of the soil, as the soil may or may not be multilayered. The boundary between the substrate and the storage medium most frequently corresponds to a material boundary between a layer of culture substrate and a separate storage layer on which the substrate rests, said separate layer being of a porous and capillary medium chosen for its water storage performance which is much better than that of a culture substrate. In some embodiments, however, the boundary may be virtual, corresponding to a boundary arbitrarily considered for the purposes of describing grounds consisting of a single layer of a material having characteristics of both a growing substrate and a porous, capillary medium and considered above the arbitrary boundary as a substrate and considered below as a water storage layer.

In the same way, it does not matter whether the strategy for managing the water table is one involving a change in the water table level decided according to precise criteria, or whether the water table is left free to evolve under the sole influence of spontaneous precipitation and evaporation, or whether the water table is constrained to remain at a level fixed in advance.

Similarly, in order to explain to the person skilled-in-the-art the functioning of the soil, it is convenient to consider a particular example with a familiar configuration of a substrate laid on a gravel drainage layer, since the person skilled-in-the-art is obviously familiar with this case.

Of course, it will be necessary to transform the drainage layer into a groundwater layer, assuming that the entire ground is provided with additional means to transform the gravel drainage layer into a water storage layer according to the invention. It is therefore assumed that a network of flexible capillary wicks or rigid capillary columns is added and installed in the gravel to create a capillary continuity between the water table inside the gravel and the substrate above the gravel despite the capillary barrier. It is also assumed that the whole site has been placed in an impermeable enclosure on its sides and bottom with only adequate means to add or remove a volume of water in the water table in order to change the level according to the desire of the site manager.

This example is interesting in that it allows a comparison of the same substrate laid on the same gravel layer but with the addition of capillary gravel media to study the resulting fundamental differences in the top of the substrate.

Moreover, such a gravel water storage layer artificially provided with additional means would not constitute a particularly efficient storage layer and is probably not the best choice for the construction of new and efficient grounds, but the gravel already present in the drainage layers of existing fields is however a material to be seriously considered for the renovation and transformation of existing grounds into grounds according to the invention, the gravel of old drainage layers being already delivered on site and potentially available free of charge or even at a reduced price.

The study of the management of the water table depth in the particular case where the structure comprises an artificial storage layer of a type already known to the state-of-the-art, i.e. one whose volume is fixed over time, represents a significant part of the invention.

The other particularly important specific case described below is the case of a movable-base artificial storage layer according to the invention, the storage volume of which is made variable so that the level of the water table is no longer constrained by the quantity of water stored in the structure.

However, the first step in describing the invention is the general analysis of the conditions for managing the water table depth in order to obtain sufficient capillary flow and sufficient oxygenation of the roots, good flexibility of the sport soil and good surface aeration.

Indeed, the principle of describing particular cases of structures comprising efficient storage structures relies precisely on said previously determined conditions of water table depth management for obtaining satisfactory oxygenation, flexibility, aeration and flow.

The individual steps of the invention concern the 2 general principles of the invention, then 4 general objectives (oxygenation of the roots, surface aeration during heat waves, spontaneous irrigation via capillary action and softening of the sports grounds in the case of a rigid storage layer), and finally the use of all these steps to describe the complete system in the case of a fixed-volume storage layer, then in the case of a variable-volume storage layer.

The general principle of the invention aims to specify sufficiently the type of substrate and the rules to be respected by a management of the variations over time of the water table depths, the said rules and the said management being established according to an adequate determination of the substrate as well as the choice and the management of the water storage layers in order to finally achieve the objectives.

The principles of the invention therefore relate to:

the 2 parts of the invention:

A: characterization of the substrate by its main drainage curve.

B: the principle of evolution over time of the depth of zero capillary pressure equal to that of the water table:

C: oxygenation of the roots.

D: surface aeration during heat waves.

E: the satisfactory spontaneous capillary irrigation of the turf.

F: the softening of the sport soil by the water table if the substrate is laid on a rigid storage layer.

the 2 applications of these principles which result:

G: the proposal of optimal management of water table storage for deferred irrigation according to different types of storage layers with a fixed storage volume.

H: to the proposal of storage containers with mobile bases and variable storage volume with a management proposal to use these containers for water autonomy, oxygenation and climate conditioning of the substrate The first 2 general objectives (C and D) to be achieved give rise, according to the invention, to minimum water table depth criteria, while the next two (E and F) give rise to maximum water table depth criteria. Moreover, these 4 water table depth criteria (2 minimum and 2 maximum) all depend on the characteristics of the substrate (determined in A).

Once the rules for achieving the first 4 objectives (C, D, E, F) have been determined, which serve as a general framework for the invention, based on the characterization of the substrate (A), the purpose of the invention is to provide the keys, using the principle of the water table depth scenario (B), for achieving 2 additional specific objectives (G and H):

Minimizing water consumption externally by optimally managing the depth of the water table to store precipitation water intended for time-delayed turf irrigation in the case of fixed volume storage layers.

Use of a new means of water storage using movable base containers and a method for fully utilizing the precipitation water and optimizing the oxygenation and climate control of the substrate.

A—Use of the Main Drainage Curve

In order to find the right conditions to ensure that the water objectives will be met, the principle of the invention is to jointly find a desirable type of substrate and to use the main drainage curve to characterize said substrate, the principle of the invention is the joint search for a desirable type of substrate and the use of the main drainage curve (SMRC-Soil Moisture Retention Curve) to characterize said substrate, in order to increase and approximate the water concentration (and thus the air concentration) at different depths in the substrate, depending on the water table depths.

It is known that at any point in the substrate, total porosity ε=water concentration $\theta_{WATER}$+air concentration $\theta_{AIR}$. The air concentration $\theta_{AIR}$ and the water concentration $\theta_{WATER}$ are naturally air concentration by volume and water concentration by volume, and unless otherwise stated, this is the case throughout this application. The two curves of air concentration and water concentration as a function of the suction or capillary pressure expressed in water height can therefore be deduced from each other from the total porosity.

The air concentration and water concentration curves determine two functions hCairt and hc water concentration.

When we want to have an air concentration higher than a given value $\theta_{AIR}$ when the water table is at depth P, the equation is written as follows:

$$P \geq +h_{cdrainage}(\varepsilon - \theta_{AIR})$$

where $h_{cdrainage}$ is the function which, for any water concentration by volume θ, assigns the corresponding capillary height $h_{cdrainage}$ (θ) to the said main drainage curve.

This "soil moisture retention curve" or "main drainage curve" (SMRC) is an intrinsic characteristic of a porous material and therefore of the substrate (at a given compaction), accessible experimentally and defined as the curve of water concentration at capillary equilibrium as a function of capillary tension (expressed in water height in cm and on a natural non-logarithmic scale), the said curve being obtained by quasi-static drainage from the initially saturated state.

It is known that the water concentration at capillary equilibrium at any moment in the substrate cannot be determined in an ultra-precise manner for a given capillary pressure because of a hysteresis phenomenon linked to the history of the previous rise and fall of the water in the substrate, but it is also known that at capillary equilibrium, the weight of a column of water is in equilibrium with the capillary force at the top of the said column of water because of the capillary forces which retain the said column from above, said capillary forces resulting from the surface tension at the air/water interface on the one hand (intrinsically depending on the liquid) and on the other hand from the wetting angle with the edges of the corresponding meniscus (depending on the liquid/solid combination) and which determine said capillary force as a function of the precise (and unknowable) geometry of the edge of the corresponding porosity. However, for a sufficiently homogeneous substrate, it is known that these conditions can be reproduced experimentally by quasi-static drainage from the initial saturated state to provide the curve taken as a reference according to the invention because it is known that said curve always and most often increases slightly (apart from the lower end of the curve) the water concentration actually attained in the substrate at a given capillary height and at a given time.

The determination of the water concentration curves of a substrate as a function of the capillary tension in general and their presentation in the form of PF curves in particular is a classic laboratory measurement.

The principle of the PF curve is the same. Also, even if the scales make this exercise difficult on a practical level, in theory there should be an approach to natural scale drainage curves in the range of heights of interest for the invention of a known substrate whose PF curve is known by using the following equations:

*PF* 0=1 cm; *PF* 0.3=2 cm; *PF* 0.5=3.2 cm; *PF* 0.8=6.4 cm; *PF* 0.9=

*PF*1=10 cm; *PF*1.1=12.8 cm; *PF*1.2=16 cm; *PF*1.3=20 cm; *PF*1.4=25.6 cm;

*PF* 1.5=32 cm; *PF* 1.7=51 cm; *PF* 1.8=64 cm; *PF* 1.9=80 cm *PF*2=100 cm=1 m

*PF*2.1=1.28 m; *PF*3=10 m=1 atm; *PF*4.2=160 m

However, the PF curves are not intended to provide accuracy over the entire range and in particular are not accurate enough for the smaller values of capillary pressure which are those used in the invention.

Implicitly, the extent of a PF curve (PF5 corresponding to 1000 meters) implies low accuracy for the very low capillary pressures (from 0 to 50 cm) which are relevant to the invention.

It is therefore preferred according to the invention to determine the main capillary characteristics:

- not on a logarithmic pressure scale but on a natural scale,
- not with capillary pressures expressed formally as pressures but as equivalent capillary heights expressed in centimeters,
- not the full range of water concentration usually presented on the PF curves but with a precise curve over the first 50 cm of capillary pressure This is why it seems necessary to provide a simple example of a protocol to underline the importance of a curve that is truly adjusted to the low values of capillary pressure, which requires special care not to neglect the thickness of the sample in the measurements, regardless of the measurement technique used. It is not the whole curve that is relevant in the context of the invention, but only the detail of what happens between zero capillary pressure and a capillary pressure of 50 cm, with an accuracy to the centimeter for capillary pressure and the percentage of water or air concentration. It is therefore not possible to characterize the main drainage curve in logarithmic form or with the imprecision of the classical PF curves, but with a specific curve providing the water and air concentration by volume in percentages in relation to the capillary heights provided in cm from 0 to 50 cm.

Such curves exist and are, for example, available for some USGA standard substrates selected for the construction of golf courses by the American Golf Federation. However, most of the substrates offered on the market are not characterized by such precision, even when their PF curve is available, which is quite rare. Therefore, in order to establish this precise equation determining the minimum depth of the water table as a function of the characterization of a specific substrate by the quasi-static main capillary drainage characteristic curve from the initial saturated state, it is not useless to have a protocol adapted to the experimental determination of this intrinsic characteristic of the substrate, which will be measured on a sample of compacted substrate. In fact, in the particular case of the invention, we are looking for capillary profiles over a few tens of cm, with a capillary margin of a magnitude of ten cm and sample sizes of a comparable order of magnitude. Also, in the particular case corresponding to the conditions of the invention, and contrary to the classical PF curves, it is important not to neglect during the measurements for determining the curve the differences in hydrostatic pressure and therefore in capillary pressure in the sample itself, because the order of magnitude of what would be neglected would be of an order of magnitude equivalent to what we are trying to measure.

It is therefore recommended that the main capillary characteristics of the substrates chosen according to the invention be determined by a measurement protocol specifically adapted so as not to neglect the difference in capillary pressure inside the sample due to its thickness in the vertical direction, but which on the contrary takes it into account.

With regard to the state of compactness of the substrate sample, and even if it would be preferable in the ideal case to determine the curve on samples of the substrate at its apparent density in situ under conditions of use, this apparent density in situ is not definable as such, being neither constant over time nor in space, and moreover it is easy in practice neither to measure in situ nor to reproduce in a sample. This is why it is important to have a capillary curve of a porous material as representative as possible of the substrate in place, it is sufficient in practice to measure the water concentration curve with a sample of substrate whose apparent density increases this apparent density in situ with a more compacted substrate, with for example the compactness obtained by a press in the compaction measurement protocols used to determine the Proctor optimum density. Such a sample bulk density will increase the in-situ bulk density, but will not be significantly different from it (especially in the case of a long-established ground without effective mechanical maintenance). By increasing the density, one also increases the water concentration at a given capillary pressure (but only slightly), and this applies to all the arguments according to the invention which consist in using the said curve to increase (but only slightly) the water concentration at capillary equilibrium at the said height.

The description provided below of a preferred recurrence protocol according to the invention is only an example of a means of determining a capillary profile by taking into account the capillary pressure difference within the sample but having an accuracy on the water concentration on as thin a slice as desired by a successive equilibration of the sample progressively mounted by a level difference $\Delta_z$ that provides the desired accuracy to the measurement, even if the thickness (a) of the sample is significantly greater than $\Delta_z$. The use of this precise procedure provided as an example of the possibility of determining the curve experimentally and accurately despite a water profile of only a few decimeters is of course not imposed by the method according to the invention.

The explanation below is provided in a case particularly practical for reasoning by recurrence, assuming that:

- the thickness (a) of the sample is smaller than the capillary edge
- the sample connected by a water pipe to the free surface is lifted by a height $\Delta_z$ with each experimental step
- by choosing a as a multiple of $\Delta_z$, i.e. $a=m\ \Delta_z$, with m being an integer The two FIGS. 4*a* and 4*b*, which represent respectively phase n and phase n+1 of a process of recurrent determination of the capillary equilibrium curve, illustrate the experimental measurement of the drainage water profile by recurrence.

FIG. 4*a* shows step n where the base of the sample of thickness a is at a height z.

FIG. 4*b* shows step n+1 where the base of the sample of thickness a is at height $z+\Delta_z$, i.e. after the sample has been raised to a height $\Delta_z$.

These two figures are represented in exactly the same way, but at two successive steps of the recurrence.

We have chosen a representation with $\Delta z=a/2$

Thus, FIG. 4*b* is similar to FIG. 4*a* but having raised the sample by $\Delta z=a/2$, i.e. by half the thickness of the sample The curve of the drainage water profile represented in FIGS. 4*a* and 4*b* is the curve which provides on the x-axis the quantity of water $\theta(z)$ which remains in the porosity after complete emptying as a function of the capillary height $h_c$ represented on the y-axis It is precisely this curve that is determined experimentally by the positive measurement of the drainage water profile by recurrence, the principle of which is explained below.

As shown in FIG. 4*a*, (z) is the altitude of the base of the sample (5) in relation to the water table (6) corresponding to step n of the recurrence and (z+a) is therefore the altitude of the top of the sample at step n of the recurrence. Similarly, as shown in FIG. 4*b*, moving up the sample at step n+1 by $\Delta z$, we have therefore the altitude of the base of the sample increasing to z+A and the top of the sample increasing to $z+\Delta z+a$.

FIGS. 4*a* and 4*b* show in gray which part of the curve corresponds to the thickness of the sample, and this part of the curve therefore naturally shifts in relation to the curve when we go from FIG. 4*a* to FIG. 4*b*.

The thickness of the capillary margin (fc) and the maximum capillary rise (H) are shown on the right.

As can be seen in FIGS. 4*a* and 4*b*, when $h_c=0$, we have $\theta_{drainage}(O)=E$ and this is maintained when reaching the capillary margin to then make an S curve which trends towards zero and arrives almost at zero when we reach the maximum capillary rise (H).

A pressure control device (1) and a device for measuring the inflow/outflow volume (3) are provided on a water circuit (2) which connects the water in the sample (5) placed on a porous medium (4) so that the capillary pressure at any point of the sample is the pressure corresponding to the altitude of this point in relation to the piezometric level (6) of the water table.

In a conventional way, the sample (5) is placed on a porous medium (4) adequate to transmit the capillary pressure uniformly to the sample, this porous medium being connected to the water table by the water circuit (2).

Thus, when the sample is at the bottom, it remains saturated with water and it is sufficient to count the number p of height steps before observing the first effective drainage to know the size of the capillary margin which is between $a+(p-1)\ \Delta z$ and $a+(p)\ \Delta z$.

Indeed, when, at step p−1, the top had an altitude of $a+(p-1)\ \Delta z$, there was no drainage at all, and so we have $a+(p-1)\ \Delta z<(fc)$.

On the other hand, there is drainage at step p, and so this means that $a+(p-1)\ \Delta z\geq(fc)$.

$\Delta z$ provides the maximum uncertainty in the capillary margin height (although the uncertainty can be further reduced by comparing the water loss at pitch p with that at pitch (P+1).

We chose a thickness a of the sample that is a multiple of $\Delta z$ with $a=m\ \Delta z$, so that we have m slices in the sample.

When the $\Delta z$ sample is created, we know by recurrence what the m−1 lower slices lose through drainage and, by measuring what the complete sample loses, we deduce consequently by difference what the upper slice of thickness $\Delta z$ loses.

Thus, by recurrence, we know the quantity of water lost to drainage by each slice of thickness $\Delta z$ from the water table.

In fact, at the beginning of the recurrence, we know the quantity of water that left the upper slice the first time we observed a draining.

At the next step, we know the quantity of water that exits from the section just below the upper section, knowing that nothing exits from the sections below, and by the difference, the quantity of water that exits minus the quantity of water that exits from the section just below the upper section provides the quantity of water that exits from the upper section.

In the following steps, we learn everything that comes out of the various slices below the top slice and by the difference, we deduce the quantity that comes out of the top slice. At each step, what comes out of the upper slice is deduced from what comes out of the whole sample, and it is what comes out of the upper slice that we want to find out in order to obtain the water profile curve, and which will be used in the following steps to learn what will come out of the slices below it.

Thus, by recurrence, we know at each step the quantity of water which leaves the upper slice and therefore also the quantity of water θ (z) which remains in the porosity and which is equal to the porosity E (because of the initial saturation) minus what has left the upper slice, which has been calculated as the quantity which has left the whole sample minus the sum of what has left the slice strictly below the upper slice. This provides the amount of water that remains, i.e. $\theta_{drainage}$ (z) at the capillary height corresponding to the upper slice of the sample. The main drainage water profile is thus determined from the initial saturated state according to a reproducible experimental protocol.

The profile representation chosen to illustrate the experimental method is obviously quite realistic insofar as this type of section is consistent with observations for the type of substrate studied. It can be seen that the capillary margin is clearly visible as expected from the theoretical explanations provided above, but that the capillary percolation threshold is not clearly visible. This representation has been deliberately chosen as it is what is actually observed with the type of substrates representative of the candidate substrates for the present invention that have been tested.

Also, a simple way to set a threshold is to consider the ratio $\theta_{drainage}$ (hc)/θ (0)≤λ and the characteristic requirement according to the invention then concerns the choice of λ.

Experimentation allows us to find $hc_{\lambda}$ such that $\theta_{drainage}$ (hc)/$\theta_{drainage}$ (0)≤λ for any capillary height above $hc_{\lambda}$.

Indeed, the function $\theta_{drainage}$ (hc) corresponding to the main characteristic of drainage from the initial state of saturation is diminishing, which allows for any λ between 0 and 1 to determine the capillary height hcλt such that for any capillary height hc greater than hcλ one verifies the equation $\theta_{drainage}$ (hc)/ε≤λ.

However, we have seen previously that the in situ water concentration in the substrate at any capillary height θ (hc) is precisely indeterminable due to hysteresis but verifies at capillary equilibrium the equation: θ (hc≤$\theta_{drainage}$ (hc).

Thus, for any λ between 0 and 1 one can determine a capillary height hcλ depending on λ such that, in situ, at any time at capillary equilibrium and at any capillary height hc, the water concentration θ(hc) effective in situ at height hc and at capillary equilibrium at the time under consideration verifies the equation:

$$hc \geq hc\lambda \Rightarrow \theta(hc)/\varepsilon \leq \lambda$$

At this stage, by using this equation, we can therefore experimentally have all the intrinsic characteristic elements sought and which make it possible to characterize the invention.

The following descriptions of the method are illustrated by using a reference sand which, on the one hand, makes it possible to provide orders of a magnitude valid in the range of substrates according to the invention and, on the other hand, makes it possible to illustrate in a concrete manner how a main drainage curve is used according to the invention at the various steps.

The curve for this USGA sand (FIG. 5) is used as a reference curve throughout the description to quantify the constraints, without of course restricting the invention to the use of this particular sand.

To clarify the process of optimizing substrate thickness, it is interesting to refer to FIG. 5, which provides a representative curve of a substrate used on a sports field and suitable for use in the present invention. In the curve for FIG. 5, the water concentration and air concentration curves are shown together, since at each height the sum of the water concentration and the air concentration is equal to the total porosity, which is the value of the water concentration at the water table level (here 41% in the example, where the porosity is the same from top to bottom, as it is the same substrate).

The S-shape of the water curve is typical of the main drainage curves of all porous materials with, from a zero height above the water table and by increasing this height, taken here as the x-axis, an approximately horizontal part up to a point of relatively abrupt change in slope, which is called the point of air entry, the corresponding quasi-saturated thickness being called the capillary margin. Then, continuing to rise above the level of the water table, there is a significant slope which corresponds more or less to a straight line with 1% less water for every 1 cm of additional rise until a point of change in slope is reached, more or less symmetrical to the first one above the water table, and the end of the curve is once again substantially horizontal. Of course, the resulting air curve has the same type of shape, symmetrical with respect to the horizontal axis at half the porosity and only rises to the level of the residual water concentration at high capillary pressure.

This reference curve taken as an example in FIG. 5 concerns a substrate composed of 45% medium sand (250 μm to 500 μm) and 55% coarse sand (500 μm to 2 mm). Due to the possibility of lowering the depth of the water table, it is also possible according to the invention to choose finer substrates such as substrates comprising 100% medium sand or even certain fine sand, which would slightly increase the height of the capillary margin and thus the point of entry of drainage air and would very slightly decrease the negative slope of the water concentration curve in relation to the height of water above the water table (less water loss per cm of elevation above the water table). These differences do not justify questioning the magnitudes of the reference curve, but they do justify, for better accuracy, adapting the strategy to the precise curve of each substrate, but this already allows the proposed strategy to be illustrated with the reference curve, in a way that is relatively representative of the entire range of substrates according to the invention.

However, with very specific substrates such as the Radicalé (commercial name), which is the best performing hybrid substrate and which is composed of multi-scale elements, we have a very different curve, as if Radicalé were both much coarser and much finer than the reference sand. We thus notice for the Radicalé a clearly finer texture behavior with a gain of air concentration per centimeter of additional capillary pressure much weaker than for the reference sand (1% of air concentration per 5 centimeters of additional capillary pressure as compared to 1% of air concentration per 1 centimeter of additional capillary pressure for the reference sand) but with, on the other hand, a much coarser texture with a much lower air entry point at capillary pressure and with an already high air porosity (10% air content at 10 cm capillary pressure as compared to 10% air concentration at 20 cm capillary pressure for the reference sand). In other words, the Radicalé substrate very quickly reaches a minimum air concentration of considerable interest, but this does not vary rapidly as one rises higher and the water concentration seems to be the same over the entire height of the substrate, with, moreover, a dynamic of rebalancing during drying which allows one to maintain a wet height all the way to the top without a drying face.

With these types of very special substrates with very different curves, it is therefore particularly justified to refer directly to the corresponding section to optimize water table management.

As such, the principle of using this main drainage curve (SMRC curve) to evaluate the water or air concentration in a substrate is not unknown to the state-of-the-art.

With reference to what is already known in this field for sports fields (but in the absence of a water table and therefore outside the capillary flow condition from a water table), it is already known from the state of the art to use this curve in the case of a substrate laid on a gravel drainage layer and to seek conditions for solving 3 objectives different from those aimed at by the invention, but with the same perspective to ensure that the turf has its basic needs, albeit differently.

The only common point between this invention and the approach used, in particular in the United States, for a substrate laid on a gravel drainage layer is precisely this principle of jointly searching for a desirable type of substrate and a desirable thickness of said substrate above the gravel to satisfy the needs of the turf, using the SMRC curve of said substrate for this search.

While the idea of using this curve is common to the invention and the prior art, the use of this curve according to the invention is very different.

In the state-of-the-art, the curve is used to try to determine, in the case of a substrate placed on a draining layer (thus in the absence of a water table):

- how to meet the desire to have "enough air" without drowning the soil
- how to have a sufficient volume of porosity to be able to absorb a certain quantity of precipitation water before overflowing
- how to have "enough water" in stock to last long enough between two waterings.

In the case of the invention, the laws of physics of granular media being universal, the main drainage curve is also chosen as the best means of estimating the quantity of water retained in the soil by capillarity at equilibrium, and increasing it again, but possibly considerably, during an upward capillary flow.

On the other hand, the presence of the water table and a thorough analysis of its needs are completely different problems, and this leads to an equally different use of the curve. Obviously, in the case of the invention, this curve is not used to determine whether there will be "enough water," because another approach shows that it is not the water in storage that matters for capillary irrigation from the water table, but the capillary flow. According to the invention, this is not deduced from the drainage curve, but depends directly on the depth of the water table and the evaporation demand, independently of the curve (up to a certain limit, of course, but there is a criterion for staying within this limit).

Obviously, the way to use this curve to derive conditions for sufficient oxygenation is also totally different from the case of a draining layer, because of the presence of a water table, since in this case the depth of zero capillary pressure is not the fixed depth $P_1$ of the gravel surface, as in the case of a draining layer, but the depth $P(t)=P_1+P_2(t)$. This additional depth $P_2(t)$ (positive or negative) of the water table in relation to the depth of the gravel surface determines the zero point of the zero capillary pressure at each moment, the said zero point of the zero capillary pressure not being linked in principle to the surface of the gravel layer and even being variable over time according to the scenario of evolution of the water table depth chosen according to the invention.

However, since the invention has to address several distinct problems, this provides a chronological order for solving the problems and then a principle for resolving each of the problems, as will be explained below. Each problem to be solved provides a direct and innovative analysis of the objectives, translating into secondary objectives in terms of water concentration or flow, and finally translating into constraints to be respected by the chronological curve P(t) of water table depth which is the main object of the first part of the invention.

Thus, since the problems do not all arise at the same time, it is possible, in the case of the method according to the invention, to choose at each moment a water table depth which makes it possible to address the problem of the moment, without having to address the problem of another moment.

The illustration of this advantage is perfectly illustrated in the search for water table management with a substrate placed on a storage layer and aimed at both minimizing the thickness of the substrate and optimizing the use of the storage in order to use the least amount of water possible from the network by discharging the least amount of water possible. The proposed scenario makes it possible to have a very high water table in winter, which would normally be considered as drowning the turf, by providing for a low drainage of the water table once in a while, which is sufficiently low so as not to reject too much water in total during the drainings, but sufficiently well calculated from the drainage curve to ensure an entry of air and therefore of oxygen at each drainage at the depth of the roots, so as to oxygenate the said roots perfectly at that depth.

The main capillary characteristic curve of quasi-static drainage from the initial saturated state makes it possible to define the decreasing function $hc_{drainage}$ which, for any water content a between the water content at the wilting point and the total porosity of the substrate (saturation content), associates the capillary height $hc_{drainage}(\theta)$, which is the height above the piezometric level of the water table at which the water concentration at capillary equilibrium is equal to θ on a quasi-static drainage path from the initial saturated state, (the water concentration being lower for a higher capillary height).

In fact, there is a capillary margin above the water table in which $\theta=\varepsilon$ between h=0 and h=thickness of the capillary margin. But above the capillary margin $hc_{drainage}(\theta)$ is a strictly decreasing function, which means that we can define $hc_{drainage}(\theta)$ over the open interval of water content at the wilting point, E as the function that associates with θ the capillary height $hc_{drainage}(\theta)$ for which there is congruence between θ and $hc_{drainage}(\theta)$ on the main quasi-static capillary drainage characteristic curve starting from the initial saturated state.

It is this function $hc_{drainage}(\theta)$ which is chosen according to the invention to characterize a substrate according to the invention, or, equivalently, $hc_{drainage}AIR(\theta)$ defined by $hc_{drainage}AIR(\theta)-hc_{drainage}(\varepsilon-\theta)$.

This can be illustrated on the reference curve provided as an example:

The $hc_{drainage}AIR$ (10%)=19 cm because at 19 cm capillary pressure, the $\theta_{AIR}$ air content is 10%, Thus, $hc_{drainage}$AIR (10%), "the capillary height of the 10% air porosity," is 19 cm.

In addition, the total porosity is 41%.

Thus, $hc_{drainage}$ (31%), "the capillary height of the 31% water porosity," is also 19 cm (since 31%=41%−10%).

B—Principle of Evolution Over Time of the Depth of Zero Capillary Pressure, Equal to that of the Water Table The innovative principle of the invention for determining the conditions to be respected is to consider that the water table depth is variable over time and can be written as follows:

$$P(t)=P_1+P_2(t)$$

$P_1$ is the depth of the point where we want to observe the effect of the water table depth:

- for example, 5 cm from the surface to look at the air concentration during the periods;
- for example, 5 cm from the surface or 12 cm from the surface to see the effect of the water table on root oxygenation at 5 cm from the surface or at 12 cm from the surface;
- for example, 4 cm above the bottom of the substrate laid over a hard water storage layer to see the effect of the water table on the flexibility of the athletic soil $P_1$ is the depth of a point we are looking at a key point in time, but the depth of the point considered depends on the construction of the field and does not vary with time.

On the contrary, $P_2(t)$ is the additional depth of the water table at time t and can therefore vary according to a strategy developed according to the invention to address all the intended objectives.

Thus, the invention is not targeting a compromise concerning the water concentration and the air concentration at a given altitude, which should simultaneously address a set of more or less compatible objectives, but rather it aims at a strategy with an additional degree of freedom, which is the additional water table depth $P_2$ between the point under consideration and the water table, and another additional degree of freedom, which is the variation of this additional water table depth $P_2$ (t) with respect to time.

However, the analysis of the objectives shows that they are all objectives at a given moment and depend essentially for some of them on an accumulation of effects in the period of time preceding the observation.

The determination of a strategy for the evolution of the water table depth with respect to time is therefore an essential element of the invention.

The following principles of the invention are those that determine the constraints to which the time curve of the water table depths is subjected.

C—Means of Ensuring Root Oxygenation

The principle of the invention concerns first the analysis of the phenomenon and then the means chosen to promote it.

An analysis of the phenomena involved clearly shows that it is not the value of the air concentration that is important, but the variation of this air concentration over a long period of time. The oxygenation of the roots at a given moment is not related to the instantaneous aeration at that moment, but the result of an accumulation of effects in a long interval of time preceding that moment.

The first element to be taken into account is the fact that the problem related to the consumption of oxygen by the roots, poorly counterbalanced by insufficient renewal by diffusion of oxygen from the air of the porosity, is a slow phenomenon. Therefore, it is not necessary to have a high air concentration in the root oxygenation layer at all times, but rather it is more advantageous to have only a little air at normal times and sudden influxes of air from outside from time to time.

Thus, in a winter strategy where the water level is lowered, for example, once a month, letting it rise naturally in the meantime, taking advantage of the positive balance of precipitation, possibly to the substrate, one will finally aim to obtain an oxygenation of the roots equivalent to that of a 30 cm or 40 cm thick substrate placed on a draining layer, which will certainly have a much higher air concentration because of the thickness of the substrate, but without involving any convective movement of air and with only the very slow diffusion of oxygen, (10,000 times more slowly). This means, in practice, that only the oxygen already in stock at the beginning of the winter is available to the roots for their respiration.

In short, the roots and micro-organisms can use the oxygen present in the aerial phase as well as in the aqueous phase of the porosity for their respiration. In this respect, the water concentration or the additional air content at a given moment is therefore of no importance for the respiration capability of the roots, nor is the presence of carbon dioxide, which is not toxic and whose effect is even positive and which is not a subject of the invention.

The subject is the consumption of oxygen for the respiration of roots and microorganisms, a consumption that leads to a decrease in the available oxygen, which is equal at any moment to the quantity of oxygen in storage at a given previous moment, decreased by the consumption since then and increased by the possible renewal of oxygen since then. Spontaneously, the only possible supply of oxygen is from the surface.

The real issue, then, is the rate of oxygen renewal from the surface, as a counterpart to the rate of oxygen consumption (which doubles every time the temperature rises by 10°, which explains why a submersion during a warm period causes irreversible damage to the turf much more quickly than in the middle of winter).

However, in the absence of air convection, the only possible renewal is obtained by diffusion into the water or into the air. The air dissolved in the water represents 2% of the volume of the water (at 10° C. and a pressure of 1 atmosphere) and the proportion of oxygen is at all times the same as that of the air dissolved in the water, the constant equilibrium being almost instantaneous. Furthermore, the diffusion of oxygen into the water is several orders of magnitude slower than the diffusion of oxygen into the air, which is itself extremely slow. We deduce that there is as much oxygen in storage with 2% air as with 100% water and that by diffusion, only the air phase ensures a small, though practically negligible, renewal of the order of magnitude of an enrichment of a few % of oxygen in the air of the porosity in 1 year at 5 cm from the surface for an air concentration of 10% and with an efficiency inversely proportional to the square of the depth as we descend. Curiously, the air concentration at capillary equilibrium at a given depth does have a positive influence on the oxygenation of the soil, but not so much because of the almost non-existent phenomenon of oxygen diffusion in the gaseous phase, but simply because it conditions the quantity of water that can be collected, during a rainfall for example, in the spaces of the porosity not yet filled with water, and then expelled downwards by drainage. However, it is the quantity of drained water and practically only it which brings oxygen in a significant way because the water present in the porosity and which leaves the porosity downwards by drainage is necessarily replaced by air coming from above, i.e. air coming from the atmosphere and thus charged with 20% oxygen. Thus, it is essentially the oxygen coming from the atmosphere brought by convection from the surface during the replacement of the drained water by air coming from the atmosphere and not the little oxygen coming down by the phenomenon of diffusion that can effectively recharge the air and the water of the porosity with oxygen. Further down, in the entire capillary margin where drainage is zero, only diffusion remains, and the recharging of oxygen decreases very quickly downwards and becomes insignificant in a few centimeters. Thus, if air porosity is indeed so important for root oxygenation, it is essentially, on the one hand, because it represents the volume of porosity likely to be filled with water that will then be evacuated by drainage under the effect of gravity and will then be replaced by new, well-oxygenated air from the atmosphere, and, on the other hand, because the air in the porosity can store 50 times more oxygen per unit volume than the water in the porosity.

Also in the presence of a water table, in the context of the invention, it does not matter that the porosity is full of water at a given depth where roots are located during part of the winter because they are placed in the capillary margin during part of the time, as long as from time to time the water table level is lowered sufficiently to bring about a drainage at this depth leading to a renewal of air implying a sufficient recharge of oxygen in the air as well as in the water of the porosity. In fact, it is even paradoxically the fact of having an important portion of the porosity that will go from a water saturated state to a sufficiently aerated state that will increase the quantity of oxygen entering the porosity to replace the drained water and it is the proportion of new air that will determine the oxygen concentration of the air and water. For example, the oxygen provided will be twice as important if we go from an air concentration of 0% to an air concentration of 10% at a given depth than if we go to the same air content of 10% from an air content of 5%.

For this reason, in the context of a suitable strategy for modifying the level of the water table according to the invention, the minimum water content in the oxygenation zone of the roots must be "at least part of the time" greater than or equal to a minimum air content, which can preferably be chosen between 5% and 15%, with a higher oxygen recharge for a required air content of 15% at each fall in the water table, but which will nevertheless be sufficient with a fall resulting in an increase in air content of only 5%, as long as the strategy causes the water table to fall more often, leaving the water table to saturate or almost saturate the porosity in water at the depth in question.

Thus, at a depth of 5 cm, a porosity saturated with water most of the time but with an air content reaching 5% once a month in winter will be oxygenated in a satisfactory manner for good root respiration, between 0 and 5 cm and even beyond.

In fact, at a depth of 5 cm, a porosity saturated with water a good part of the time but with an air content reaching only 3% but consistently enough during the winter will be oxygenated satisfactorily for good root respiration, at least between 0 and 5 cm.

This root oxygenation constraint is described here as a winter constraint, but it can also be applied in a tropical climate, the constraint of aeration of the root oxygenation slice being similarly respected "from time to time," as much as necessary, to ensure satisfactory oxygenation of the roots, the objective being to ensure a regular influx of oxygen by emptying the substrate through drainage.

The important thing is that the roots and microorganisms have oxygen to breathe at all times. When fresh air arrives from the atmosphere the composition of the air includes 20% oxygen, which means that the concentration of oxygen over the sum of the concentration of oxygen and the concentration of nitrogen is greater than 20%: we therefore have [Oxygen]/([Oxygen]+[nitrogen])>20% in the fresh air.

This [Oxygen]/([Oxygen]+[nitrogen]) ratio is the same in water and in the air within the porosity at a given depth, but this proportion decreases with respiration as the nitrogen present remains constant while the oxygen decreases.

A criterion for oxygen turnover may be defined according to the invention as the total concentration of oxygen in the porosity remaining below a predetermined sufficient oxygen concentration at all times. It is preferable to define the criterion by the concentration in the porosity because this definition works even when the water is saturated.

For example, a minimum threshold of [Oxygen]/air≥4% in the air of the porosity (or in the porosity) can be preferably chosen as a rule to be met all the time: 4% oxygen in air is equivalent to 20% of the maximum oxygen level in dissolved air, and the "all the time" rule is then to manage oxygen turnover so that there is a total oxygen level in the air in the porosity that is greater than or equal to 4% at all times.

For example, in the case where the air concentration is 4% for a total porosity of 44%, there is 4% air and 40% water, which itself contains 2% dissolved air, i.e. 0.8% dissolved air, and the concentration of oxygen and nitrogen is the same in the air and in the water at all times.

If we wait until the last moment to recharge with air and we go from an air content of 4% to an air content of 6% (by lowering the water level), this implies an oxygen supply of 2%×20%=0.4% of the porosity (20% because the air in the atmosphere contains 20% oxygen).

However, before the oxygen was added, the total amount of oxygen in the porosity was:

in the porosity air 4%×4%=0.16% in the porosity water 40%×2%×4%=0.032%.

In total, the oxygen represented 0.192% of the porosity before the addition of air.

After the addition of fresh air, we will have 0.4%+0.192%=0.59% of the porosity

The concentration of nitrogen being the same in the fresh air and in the old air, the total amount of nitrogen+oxygen has changed slightly from (4%+40%×2%) to (6%+38%×2%) or (4.8%) to (6.76)

the ratio [Oxygen]/([Oxygen]+[Nitrogen]) thus increases from 0.192/4.8 to 0.592/6.7 i.e. 4% to 8.8%.

Thus, by going from 4% air to 6% air by light drainage and replacing 2% water with fresh air, the oxygen concentration of the porosity air is doubled in one go.

Thus, after translating the oxygenation requirement into an aeration requirement, the use of the drainage curve makes it possible to translate this constraint on the aeration result at a given depth $P_1$ into a constraint on the water table depth P(t), with $P(t)=P1+P_2(t)$, the condition of good oxygenation of the roots at depth $P_1$ being based on a minimum value of the additional depth P2(t), this minimum value not having to be attained permanently, but rather only from time to time.

"From time to time" is to be understood as being as much as necessary to maintain the rate of oxygenation of the gaseous or dissolved air at a level higher than a sufficient predetermined value.

A value of 4% as seen in the above example can be chosen for satisfactory oxygenation to determine the "from time to time" and the aeration rate after the drainage determines the water table depth during drainage.

To express this condition, in the case cited as an example, it is sufficient to take the drainage capillary height function of the water concentration hc (ε-6%), remembering that in a given substrate, the air concentration increases as you go above a given depth, so that it is sufficient to express the condition at the deepest point of the slice for it to apply everywhere above it, especially since the air that renews the drained part of the porosity comes from the atmosphere above.

In the simplest and most frequent case where the root oxygenation slice is a slice from the surface to the depth $P_{TOR}$, and this slice has only one substrate layer, the equation can be deduced directly from the main drainage curve thanks to the previously defined function $hc_{drainage}$ (θ) of capillary height corresponding to a water concentration A a capillary height $hc_{drainage}$ (θ) defined by the main drainage curve.

The equation to be checked for a water table of piezometric depth $P_{piezo\ MIN\ TOR}$ is:

$$P_{piezo\ MIN\ TOR} \geq P_{TOR} + h_{c\ i\ drainage}(\varepsilon_i - \theta_{AIR\ MIN\ TOR})$$

In other words, there must be at least, between the water table depth $P_{piezo\ MIN\ TOR}$ and the depth point $P_{TOR}$ where a minimum air content $\theta_{AIR\ MIN\ TOR}$ is desired, the difference in height $h_{c\ i\ drainage}$ (εi−$\theta_{AIR\ MIN\ TOR}$) determined from the main drainage curve.

As seen above, this condition of good oxygenation is expressed simply in the case where the zone where good oxygenation of the roots is desired is composed of a single layer of substrate, but it is also appropriate to express it in a slightly more complicated manner in the case that sometimes occurs in the context of the invention of a multi-layer substrate, each of these layers naturally having its own main drainage curve.

For this purpose, the method according to the invention must then include a step of first defining the depth $P_{TOR}$ of an oxygenation slice of the grass roots from the surface to said depth $P_{TOR}$, which is greater than or equal to 5 cm and preferably between 5 and 15 cm.

The condition required to meet the minimum air concentration condition $\theta_{AIR\ MIN\ TOR}$ at a time t that is required "once in a while" within said root oxygenation slice is deduced from the main drainage curve. It is simply a matter of defining the number of substrate layers involved according to the constructional structure and the choice of depth $P_{TOR}$ of the root oxygenation slice and remembering that what happens at capillary equilibrium at a given depth depends only on the main drainage curve of the substrate at the point considered and the capillary pressure, i.e. the height of the point with respect to the water table, and does not depend on the layers above or below it (both of which affect capillary flow but not capillary equilibrium).

The rest of the formula is deduced from this, the principle still being that to allow good hydration of the turf and to respect the said minimum required air concentration $\theta_{AIR\ MIN\ TOR}$ within the oxygenation slice of the roots between the surface and the said depth $P_{TOR}$, the depth $P_{piezo}$ of the water table inside the structure (S) is lowered "at least once in a while" to a minimum depth $P_{piezo\ MIN\ TOR}$ which verifies the following equation:

$$P_{piezo\ MIN\ TOR} \geq P_{MIN\ TOR} = \mathrm{MAX}\ [Z_i + h_{c\ i\ drainage}(\varepsilon_i - \theta_{AIR\ MIN\ TOR})]_{1 \leq i \leq n}(P_{TOR})$$

where n($P_{TOR}$) is the number of layers fully or partially above said minimum root oxygenation slice (TOR) of a thickness $P_{TOR}$ and being defined by a layer fully or partially included in said root oxygenation surface slice (TOR) the fact that $Y_{i-1}$<PTOR, which allows for the definition of the integer n ($P_{TOR}$)≤N using the equation:

$$1 \leq n(\mathrm{PTOR}) \leq N \text{ with } Y_{n(PTOR)-1} < P_{TOR} \text{ and } Y_{n(PTOR)} \geq P_{TOR}$$

by defining $Z_i$, for i≤N ($P_{TOR}$), using the equation $Z_i = Y_i$, for i<n (PTOR) and $Z_{n\ (PTOR)} = P_{TOR}$.

The depths $Y_i$, are the depths of the base of the successive layers starting from the top, these depths being defined during the construction of the ground.

It should also be noted that this strategy of lowering the water table "from time to time" is effective in terms of oxygenation of the roots, but may have the disadvantage, in certain types of construction, of forcing the discharge of a lot of water instead of storing it. This is why, in cases where this waste is problematic, the invention proposes solutions that will be described later to lower the level without wasting water. This problem is one of those studied in the optimization of water table management a layer of substrate placed on a fixed volume storage layer.

Finally, in a preferred embodiment, all the means are provided to move from "adequate" oxygenation to optimal oxygenation. However, in the context of the invention, blowing air in upward convection is not very costly in terms of energy and makes it possible to renew the oxygen and to have an oxygenation rate close to 20% like in the air, without drying out the substrate, thanks to the combination of a highly effective coarse porosity and the presence of a shallow water table.

In fact, from the point of view of turf cultivation, it would be possible for the sole purpose of oxygenating the turf to have roots that develop over 15 cm, with, for example, the top 5 cm being well aerated, the bottom 5 cm poorly aerated, and the bottom 5 cm in water, as long as oxygen is added to the water, which is possible in a simple and inexpensive way, for example, by adding oxygen to the water by blowing in air bubbles.

The fact of blowing air permanently into the underlying water table would allow sufficient oxygenation of the water in the porosity despite an excess of water or even in a situation of permanent total saturation, but this solution is not the one preferred as a basic solution, even if it is relatively cheap and efficient, because it does not comply with the objective of sustainable development targeted by the invention, on the one hand, and because the conditions of aeration chosen for the good oxygenation of the substrate are in any case also preferable on the mechanical level, on the other hand. In any case, a minimum air concentration in a minimum surface area is desired. Thus, the blowing of air to oxygenate the porosity is indeed intended according to the invention as an additional means of improving the medium, but is not desired as a necessity to avoid its asphyxiation.

D—Means of Ensuring Surface Aeration of the Substrate in Hot Weather

The main drainage curve is also used to determine the minimum depth $P_2$(t) to obtain sufficient air concentration at 5 cm from the surface during a heat wave.

It is known that the main drainage curve minimizes the air concentration during capillary rise caused by climate demand. However, the extent of this minimization is not known, even though the few known references to water concentration during a capillary flow created under the influence of an evaporative demand from a very shallow water table suggest that the drop in water concentration with respect to the curve generally remains moderate to low, except right near the surface when the water table depth and the evaporative demand are significant, i.e., in the area and circumstances of interest for the invention. This is annoying from the point of view of knowledge and precise determination of the risk, but on the other hand it is very favorable for the turf because this "risk" of a sudden increase in air concentration near the surface is precisely the desired effect. In any case, it is not easy to find references to determine the minimum desirable air concentration near the surface in hot weather. We know that it is absolutely essential to have a gradient of humidity that imposes an increasing humidity when one goes down and that a dry surface is preferable and we also know that in case of very high evaporation (most often coinciding if the air is not saturated or immobile with the prolonged hot periods which are not the same as the stormy periods) A dry crust or mulch is formed with the passage of the capillary regime of evaporation in the last centimeter or millimeters rising to the surface, which is very favorable for the control of diseases.

In this context, the principle according to the invention is to impose a minimum air concentration at 5 cm from the surface, which will be chosen in any case to be greater than or equal to 10% and preferably greater than or equal to 15%.

When possible, the best solution is to approach the conditions of maximum depth, i.e. a water table close to 40 cm and an air concentration at 5 cm greater than or equal to 30%.

E—Principles for Spontaneous Capillary Irrigation of Turf

The principle according to the invention for satisfying irrigation needs concerns the maximum water table depth and the characteristics of the substrate above the water table.

For satisfactory capillary irrigation of the turf from the water table, the choice according to the invention is "quite simply" to impose the double condition of a very shallow depth of the water table (ideally less than 50 cm) and a substrate with coarse porosity (medium or coarse sand), and to assert that these two simple conditions are sufficient, in the context of the invention, to solve the mysterious problem of irrigation.

However, such a simple condition seems difficult to accept, as it contradicts the opinions that are well established and accepted in the state of the art, which classically postulate that the water available for irrigation is that corresponding to the water concentration at the level of the roots, and which deduce that it is preferable for capillary irrigation to have a soil that is as fine as possible, with the best possible "useful reserve."

This useful reserve, which can be determined by the main drainage curve used according to the invention to manage the oxygenation needs of the roots, is the classic pivot of the entire irrigation process to determine the water that remains in the soil after re-drying, and what part of this water, not being retained too much by the capillary forces of the soil, can therefore be used by the roots.

However, what allows the plant to hydrate by capillary action is essentially the fact that, in hydrating, it breaks this capillary balance in the soil, by reducing the quantity of water in relation to the capillary balance and generating a capillary flow from the water table, in order to re-establish this balance (as if it were drawing water from a bucket at the end of a string). In this sequence, what counts is not the quantity of water available on the spot at equilibrium (the notion of useful reserve) but the speed with which this broken equilibrium is re-established, in order to know whether or not the flow resulting from the imbalance will be sufficient to quench the plant's thirst as it draws water from the reserve.

There is a level of water in the tub, but the plant draws on the water supply to drink. This spontaneously creates an imbalance and thus an upward movement of water aimed at refilling the tub to its equilibrium level. The question is under what conditions will the rebalancing tap fill the tub as fast as it empties, and, assuming that the tap fills more quickly the lower the water level in the tub, the ultimate question is whether the equilibrium between filling and emptying will occur before the tub has already emptied.

Of course, at the beginning of the story, the amount of water in the tub makes it possible to say that you can go for 3 days without having to empty 5 basins of water to refill the tub. This is the whole notion of useful reserve, which is used in classical irrigation to measure how much water to bring and which time interval should there be between 2 waterings.

But if you want to be able to go 3 months without having to empty basins into the bathtub due to the water inlet taps provided for this purpose, it doesn't matter whether the water supply is at the initial balance of 1 or 3 days' consumption: the only thing that matters is whether the tap will be quicker to fill the bathtub with water than the plant will be to fill it with its straw (the roots that dip into the water).

It is not, therefore, the tool that measures the level of water in the bathtub before starting to empty it (which the main drainage curve measures very well) that will make it possible to determine whether the taps (capillary flow) will be sufficient to compensate for the consumption by the plant (evapotranspiration).

Thus, while the classic notion of useful reserve is perfectly relevant for determining a supply that is not fed between two successive watering sessions (volume of water in the bathtub), and even though it has the advantage of being determinable thanks to the PF curve of the substrate, it is completely irrelevant to the likelihood of continuous supply by capillary flow from the water table (flow of water from the taps).

The use of logarithmic curves does not change anything: a dynamic flow rate cannot be deduced from the measurement of a supply at equilibrium.

However, another argument from common experience seems to be in glaring contradiction with the principle chosen for the invention. Indeed, it is known that water rises further up by capillary action when the substrate is finer, and it is usual in the state of the art to deduce that if the water rises further with a finer substrate, it is undoubtedly because the rate of capillary rise (i.e., the filling speed of the water filling tap) must be lower with sand than with clay.

More disturbing is the common observation that plants in nature (i.e., generally those above a more or less deep water table) dry out more quickly in coarse sand than in clay soil. This observation has always been correct, and the choice of a coarse substrate to guarantee the effectiveness of capillary irrigation may therefore legitimately seem paradoxical in light of this observation.

It is therefore useful to respond to this paradox by summarizing a three-step analysis:

first step: go back to the basic knowledge concerning the speed of capillary rise in the transient phase towards capillary equilibrium and observe this mechanism at work in simplistic but very informative cases of porous media:

This makes it possible to deduce the influence of the porosity characteristics of the porous medium concerning its capacity to develop a capillary flow, which gives us practical orientations for the development of future constituent layers;

This also explains the difficulty of interpreting a visual observation of the rise of a capillary hydration flow in a sample of a substrate.

second step: analyze the tenuous theoretical link between the water content curve and capillary flow using the simple form of the equations for the movement of water from the water table at the base due to the capillary imbalance generated at the top by the consumption of water in the case of evaporative climatic demand;

third step: to consider, finally and above all, the scientific experiments now available and relating to a wide range of experimental conditions thanks to numerical simulation correlated to the experimental measurements, the said experiments now making it possible to estimate the capillary flow generated in the presence of a water table at the base and of an evaporative demand at the top, as a function of the depth of the water table, of the climatic demand and of the type of substrate, within the range of the parameters of the present invention. In spite of the extreme complexity of the phenomena involved, these results can be summarized in extremely simple terms using the theory of boundary flow which applies under certain restrictive conditions which are those chosen according to the invention:

Both at equilibrium in the absence of evaporative demand and during the capillary flow phase in the presence of a climatic evaporative demand at the surface and a water table sufficiently close to the surface in the structure, it is important for the present invention to be able to estimate:

the water concentration at different depths the intensity of the capillary flow

At equilibrium, the quasi-static drainage curve can be obtained from the saturated state, which is an intrinsic characteristic of the substrate.

In the presence of an evaporative demand at the top and a very shallow water table at the base, the water content curve and the capillary intensity are not intrinsic characteristics of the substrate, but they depend on it.

To understand what happens in the porosity of the substrate during a capillary flow phase, in order to be able to estimate the flow as well as the water content curve, it is interesting to take a step back and, instead of dealing directly with "real" porous materials, nothing is as instructive as first looking at known experiences with simple sample porous materials, because they make it possible to approach, at least in a qualitative way, the capillary processes at work in a complex porous material. In an analogous way, this then makes it possible to intuitively manage the combination of effects arising from the particularities of the substrates and in particular to anticipate, explain and validate certain capillary behaviors, paradoxical at first sight, of substrates such as the radical substrate used in a preferential way in the framework of the present invention.

The reference experience concerning capillarity is that of a cylindrical glass capillary tube with a circular cross-section, the lower part of which is soaked in water and whose height h of capillary rise at equilibrium is given by Jurin's empirical formula confirmed and explained theoretically by Laplace's formula, while the velocity of the flow during the phase of ascent of the water to its equilibrium point was provided later by Washburn's formula, which gives as a function of time t the height h of the meniscus in the process of rising to the threshold height hj determined by Jurin's formula, for water ($h=2\gamma \cos \theta/g\cdot 1/R=\text{Constant}\cdot 1/R$) which results in the well-known consequence that the height of capillary rise in a thin tube is greater the smaller the radius of the tube.

The solution of Washburn's equation as a function of the capillary radius R and $T_{with}$ $T=\eta R/\gamma \cos \theta$ where $\theta$ is the contact angle of the liquid on the tube wall and n is the viscosity of the liquid and $\gamma$ is the surface tension as follows:

$$\ln(1-h/h_j)+h/h_j=-R^2/h_j^2\cdot t/4_T$$

which simplifies to the classical diffusion equation as long as the capillary rise height is small compared to the Jurin height, as follows:

$$h^2=\tfrac{1}{2}R^2t/T$$

According to this formula, determined theoretically by Washburn since 1921, and as is easily confirmed by the experience of dipping a large diameter capillary and a small diameter capillary side by side in the same basin full of water, in order to observe the meniscus as it rises, it can be seen that the meniscus in the small capillary tube rises much more slowly than the meniscus in the large capillary tube. This means that during the entire rising phase of the large capillary, the water level in the large capillary is much higher, even though it has a much larger volume of water to draw per unit of height (cross-section proportional to the square of the diameter), which means that the flow of water in the large capillary tube, which rises faster and has a larger cross-section, is considerably greater than in the small capillary tube, and even more so than in the small capillary tube, which has a larger cross-section.

Thus, after having believed for a long time that the water in the small diameter capillary tube must rise faster because ultimately it rises higher according to Washburn JURIN's formula and because it has less water to draw on for a given height of ascent, we note on the contrary, by this Washburn formula confirmed by experience, that it is indeed the capillary tubes with a large diameter which per unit of time cause the most water to rise by capillarity.

In the smallest capillary tubes, the tensile force is stronger per unit area (which is why the meniscus is higher ultimately) but the viscous resistance is also greater and this increase in viscous force prevails in terms of the dynamics of the movement over the tensile force, which prevails in terms of the height at equilibrium in the end.

However, and in spite of a classically popularized modeling of the substrates represented as panpipes, the substrates comprising an assembly of grains generating coarse and fine pores that are connected to each other at all levels on the entire substrate slice are not comparable to parallel capillary tubes but should rather be represented as an assembly of capillaries of sizes representative of the substrate and connected to each other at all levels from the bottom to the top.

The experience of soaking a capillary consisting of a tube with a large cross-section connected to a tube with a much smaller cross-section is much more representative and particularly instructive in this respect. In this experiment, it is found that the water meniscus rises fastest in the small tube connected to the large tube. Thus, the low viscosity open channel in the large tube is used for a rapid rise of water in the large tube, but the stronger vacuum in the small tube allows from the bottom to the top of the large tube for a discharge of water from the large tube into the small tube. As a result, some of the water that rises in the small tube has traveled part of the way faster in the large tube before arriving in the small tube because the stronger capillary pull in the small tube pulls the entire column of water from the small tube, which fills up by lateral discharge from the large tube over its entire height. Moreover, the amount of water that escapes from the large tube into a small tube at a given level remains small compared to the volume of the large tube and its ability to replenish itself from below by capillary action.

Through a similar effect, this time taking a circular but crenellated capillary tube, we see that the water rises in the center of the tube as it would with a normal tube with the same cross-section, while at the same time the small crenellations in the wall allow for a much faster rise and one that goes much higher against the crenellated wall.

In the same way, if we take a tube with a square cross-section, we see that the speed of ascent and the height of ascent are at the center as they would be with a circular tube inscribed in a square, while at the same time the water rises much higher and much faster in the 4 corners of the square, forming 4 ridges that form the edges of the square.

Analytical calculations and experimental verification of these model porous cases were carried out and published more recently in 2000 by Bigo, using the old Washburn formula. These porous models are very meaningful and useful because they allow for the interpretation of the two major effects in a substrate, which are, on the one hand, the driving force of the circulation linked to a mean Laplace force to which one can assign an equivalent Laplace radius and, on the other hand, the viscous resistance to the flow to which one can assign an equivalent viscosity radius. This is larger than the Laplace radius and, in the case of heterogeneous porosities in the substrate, allows for a large quantity of water to circulate more quickly through the large porosities, some of which are gradually discharged into increasingly narrower pores with an average capillary force corresponding to finer porosity, so that they can rise to higher levels without having to take up the water that rises from the bottom.

However, when one considers a classical substrate made up of aggregates distributed homogeneously according to a Gaussian curve with a more or less broad spectrum, the classical interpretation of the capillary behavior of the substrate is that of a single equivalent porosity of the substrate. The consequence of an interpretation with the model of a single equivalent porosity is to consider that a low capillarity corresponds to a high permeability and that a decrease in capillarity and an increase in permeability are necessarily achieved by increasing the equivalent porosity. This observation is also generally corroborated by experience, at least as long as the substrates are relatively homogeneous in nature, with substrates consisting of aggregates classified by bell-shaped granulometric curves.

However, it becomes possible to understand how in a substrate certain effects of heterogeneity of scale and constituents can simultaneously improve capillarity and permeability when one chooses a model with 2 equivalent porosity radii as suggested by the work of Bigo, with an equivalent Laplace porosity to model the equilibrium height and an equivalent porosity of larger size to model the viscosity or permeability. In particular, it is then understood that under this assumption, large porosities correspond to the effective porosity that favors both permeability and capillary flow intensity near the water table.

With this two-radius model of equivalent porosity, it is understood that permeability and capillary rise rate depend on coarse porosity with a water content curve during capillary flow that depends on the combination of fine and coarse porosity.

For example, in the preferred embodiment of the radical substrate invention, a fiber chosen for its fineness, which is much lower than the porosity of the sand, allows the grains to be spaced slightly apart, increasing the viscosity porosity (simultaneous increase in drainage permeability and capillary flow velocity) while creating finer spaces between the fiber and the grains between which it passes. This creates a finer porosity and increases the capillary force, the fiber being itself a fine capillary tube used to bring up water but also to maintain the capillary cohesion of the sand despite a dry situation. Similarly, the introduction of a judicious share of very large grains several units larger than the average size of the sand will create wider capillary paths that promote drainage and capillary flow, while the addition of these large resilient and hydrophobic grains partially crushed during mixing and placement, traps more and more water between the finer parts of the substrate and the flexible wall of these resilient grains because this trapped water exerts pressure on the walls that make it rise by capillary action a force of pressure that has the effect of making the resilient grains swell up again by decreasing the pore volume against the resilient wall, which then acts according to the same process as the living flexible tissues that make water rise in the plants by reducing the pore space due to the effect of the pressure. This allows the water to rise higher than the porosity of the plant tissue before it collapses into the rising capillary water.

Another effect that takes place on a third scale in the radical substrate concerns the spherical siliceous grains that make up the sand, whose surface is not perfectly polished like glass beads but rather scratched. These scratches on the surface of the grains represent nothing in terms of pore volume, but they are of absolutely considerable importance for the cohesion between the grains and also for the capacity to make water rise higher or to diffuse water all around as soon as a path allows a cavity in the porosity between grains to fill.

Thus, all of these effects at play in the radical substrate allow the substrate to be both highly permeable and highly capillary, highly resilient due to the cohesive forces that bind the grains together in the fiber network, and highly flexible due to the presence of resilient grains and effective cohesive forces, These forces are sufficiently strong to give the soil a resistance functionality allowing it to remain non-deformable and flat in the face of the mechanical stresses of sports practice, but sufficiently weak (absence of strong forces such as those developed by the clay during drying) to preserve the desired flexibility of the substrate to avoid damaging the joints of the athletes.

Thus, this qualitative approach to the combination of effects makes it possible to interpret and validate the observed characteristics of the radical substrate, which make it a preferred hybrid substrate within the framework of the invention, even if these effects are apparently paradoxical in the classical interpretations of porosity by a single equivalent porosity.

This approach offers the hope of creating both highly porous and capillary media from aggregates of fibrous media if one can create a very high 49icroporosity between solid elements through which or in which a network of fibers engenders a microporous network. The lesson to be learned from these examples is that considerable 49icroporosity is not an obstacle to excellent capillarity if the latter is based on irregularities on a very small scale.

However, this necessary qualitative approach is still insufficient in itself to estimate the equilibrium depth-dependent water content curve or the depth-dependent water content curve during summer runoff in the presence of evaporative demand, or the capacity to raise water by capillary flow as a function of the depth of the water table, the evaporative demand and the depth-dependent water content curve during summer runoff.

In order to determine the water concentration curve by depth at equilibrium, it has been seen how a special recurrence protocol can be used, taking into account the effect of the sample size, which is the same size as what is to be measured.

In a dynamic context, the most classic experience for estimating the possibility of irrigation by capillary flow is the visual observation of the saturation face of a column of substrate that is "dry" at the start (but with enough moisture to maintain its cohesion). This column is placed with its base in contact with the water, so that its darker color can be used to observe the rise of an absorption face, the speed of which is observed and the height finally reached.

This tempting experience is classic and necessary because it is very quick to carry out, not very costly and indeed gives useful information, but it does not directly or completely answer the questions that arise in the context of the invention, because it must first be interpreted and, once interpreted, it can only give a partial answer.

The principle of visual observation of the wetting face is that the "presence of water" changes the refractive index in the porosity and that "in the presence of water" a greater part of the incoming light is therefore caused to bypass the sand grains and penetrate the mass instead of returning to the source of illumination as in the "absence of water," so that ultimately the wet sand is darker than dry sand. This experience therefore shows a rise in water and the rate of rise of a wetting face as well as the height of the wetting face. But water content is not binary ("absence" or "presence" of water) and the question is at what water content the sand appears light or dark. The two practical questions that arise in the context of the invention are whether a dark color would mean too much water that could drown the roots of the grass or whether, in the opposite manner, a dark color would guarantee sufficient hydration of the grass at this height. An interesting indication of what can be interpreted directly from what the eye sees is to compare it to model porous cases with what is measured by continuous weighing experiments. Thus, in certain typical cases, such as the capillary rise in a square tube described above, it can be seen that the face itself is diluted and that the eye rather sees a face at the height of the rise of a water content that is sometimes very small (the 4 edges at the four corners of the square), whereas the weights are not sensitive to the rises in the 4 corners, which represent a negligible volume of water in relation to what rises in the inscribed circle, and the weights give the level of saturation on more than 99% of the surface area of the section of the square tube. The interpretation of this experience is that the eye sees the front of the face even if the front of the face represents a small increase In terms of water content (which can however support a significant flow) while the weighing will show the back of the face neglecting the water heights corresponding to a small proportion of the water rising by capillarity. This result makes it possible to understand qualitatively that the height of the face does not necessarily indicate much about what is happening in the darker part, but rather that in the lighter part, probably not much has happened yet and that there is still very little water. This point could be exploited in the context of the invention to say that above the height of the face once it has stabilized, there is no risk of lack of air in the substrate, but this result is already available more simply and in a very precise way through the main drainage curves.

However, this does not imply that there is too much water below this face.

Nor does it imply that in the clear part, capillary rise will be insufficient to feed a high intensity flow.

In other words, observation of the rising face of the dark color in a cylinder of sand is certainly useful, but it does not clearly address either the question of the possibility of irrigation or the question of the risk of asphyxiation.

second step: analyze the tenuous principled link between the water concentration curve and capillary flow What is important in the context of the invention is to determine under what conditions the capillary flow can partially or completely satisfy the potential evapotranspiration of the atmosphere on the surface of the turf.

Now, in principle, since upward flow is the amount of water that rises through a horizontal surface over a period of time, this is the maximum amount that could be captured at any level to supply the roots. However, if the roots were to absorb all the upward flow at a given level, there would be no upward flow left above it, and there would be no supply to compensate for the consumption above said level.

Thus, it is more appropriate to consider the amount of water that could be withdrawn over a period of time at a given elevation without preventing the flow from continuing to rise, so that the phenomenon could be sustained in a steady state without changing the conditions under which the flow is rising. This amount of water that can be withdrawn without changing the conditions of disequilibrium at the origin of the flow is what would accumulate during the same period of time, in the absence of withdrawal by the roots.

However, the continuity equation that expresses the conservation of the mass of water in an elementary volume representative of the soil shows that the quantity of water that can be withdrawn at a given altitude in a steady state is equal to the gradient of the upward capillary flow that develops at a depth z. What arrives from the water table to a cell of thickness $\delta z$ at elevation z minus what exits at elevation $z+\delta z$ is the accumulation of water that would take place over a period of time $\delta t$ if the roots present did not withdraw that same amount of water over the same time. In other words, the amount of water that can be withdrawn by the roots in a steady state for a period of time $\delta t$ is equal to the z-gradient of the upward capillary flow.

Thus, the quantity of water that can be withdrawn per unit of time $3\theta/\delta t$ is equal to the vertical gradient of the capillary flow $\delta q/\delta z$.

In other words: $\delta\theta/\delta t=\delta q/\delta z$

Now, the equation of the forces involved (gravity and capillarity) or the conservation of momentum equation can be written by generalizing the Darcy equation (valid in saturated media) to unsaturated media using the equation:

$$q=K(\theta)(\delta h/\delta z-1)$$

where h (θ) is the relative suction pressure with respect to atmospheric pressure, i.e. expressing the pressure P in water height:

P=p g H=p g (h+z), where H is the pressure expressed in water height and h is therefore the suction pressure expressed in water height, depending on the porosity of the substrate and the degree of saturation.

K(θ) is the generalized hydraulic conductivity in unsaturated media, which is an increasing function of θ, equal in saturated media when $\theta=\theta_{sat}$ at the permeability of the ungeneralized Darcy equation and then decreasing to 0 when the water content decreases, initially with a value more or less proportional to the saturation of the effective porosity and then decreasing more rapidly when the water occupies only the useful reserve and finally trending towards zero more and more rapidly when the useful reserve is empty.

We thus have a product between $K(\theta)$, which is an increasing function of $\theta$, and which decreases with the decrease in water concentration, and the pressure gradient, which can, under certain conditions, create a significant flow and compensate for this decrease in hydraulic conductivity.

It is clear that the term $K(\theta(z))$ is likely to be low when there is little water, but the term $\delta h/\delta z$ does not depend on the amount of water but on the drying gradient and can therefore become very large so that the product can be both small and large depending on this gradient. Thus, by simply observing the form of the equations and without even trying to solve them, we can see that whether this term is small or large does not matter much in itself because it is the gradient of this product that drives the upward capillary flow and provides the ability to compensate in real time for the consumption of water by the roots with sufficient upward flow in an evapotranspiration dynamic. As long as the capillary equilibrium is not achieved, a flow of water will rise to try to re-establish this equilibrium and will rise all the faster if the pressure gradient that translates this imbalance is significant; the available water is at the bottom and drying takes place from the top, destroying an equilibrium that the upward flow tries to re-establish. The initial motor is therefore the drying out by evaporation, which in turn sets in motion the motor of the capillary flow that is established to try to replace the water evacuated by evapotranspiration and that can, without succeeding in re-establishing the capillary equilibrium, nevertheless succeed in maintaining the imbalance as it is, at a constant level despite the continuation of evapotranspiration, if the rising capillary flow is equal in intensity to the flow of evapotranspiration at the origin of the movement.

This is the basis of the invention, considering the next step of the analysis of the studies that does not specifically consider the withdrawal of water by roots at different levels, but that studies and establishes the conditions for the spontaneous development (in the absence of roots) of a capillary flow in a steady state capable of sustaining an evaporative demand on the surface from a water table as a function of the depth of said water table.

third step: consider, finally and above all, the scientific experiments currently available and covering a wide range of experimental conditions.

However, it appears from the experiments carried out by combining numerical modelling and experimental calibration that for very shallow water table depths, the intensity of the capillary rise flow is capable of increasing to adapt to the evaporative demand and to equal the intensity of this evaporative demand as long as the latter is less than a threshold flow, which itself depends essentially on the depth of the water table and secondarily on the granulometry of the substrate. It can be seen that all the water flow takes place in the form of liquid water flow by capillary action as long as the evaporative demand is lower than this threshold flow, whereas once the evaporative demand is higher than the threshold flow, the upward capillary flow which is set up reaches the threshold flow and remains there, while a steam flow is added to the threshold flow, which has the effect of drying the soil more thoroughly and reducing its evaporation to the level of the threshold flow. Thus, it is remarkable to observe experimentally that the capillary flow is always able to supply the water necessary to fully satisfy the potential evaporation as soon as the average flow required is less than the threshold flow.

However, it appears that this threshold flow is dramatically reduced by a factor of 2 to 3 when the water table depth increases from 40 to 100 cm, and by a factor of 6 to 8 when the depth increases from 40 to 150 cm, and it also appears that the coarser the soil structure, the more rapidly the threshold flow decreases with increasing depth. This rapid decrease in threshold flow with depth when the porosity is coarse while the decrease is slow with fine porosity explains perfectly the traditional observations that soils are as efficient as their texture is fine to feed the vegetation by an ascending capillary flow from deep water tables. But this observation, which has always been made with deep water tables, does not apply to a very shallow water table. On the contrary, for a very shallow water table, less than 50 cm, it is observed that sandy textured soils, considered as "not very capillary" have the highest threshold flow, which can even reach 15 mm/day at 40 cm for the very porous sandy substrates chosen according to the invention, whereas for a texture of 100 cm, the threshold flows with a coarse texture are still of the magnitude of 3 mm/day, which is significant, but insufficient for climates with an intense and prolonged evaporative demand.

These results may seem shocking to agronomists in charge of sports fields, since they contradict the a priori assumptions that are classically accepted and justified in the absence of a water table, but they are nevertheless quite easy to understand.

First of all, with a shallow water table, and this is still the case for a water table of 40 cm, a sandy soil is still relatively moist at the surface, not only at capillary equilibrium but even in situations of intense summer evapotranspiration. Under these conditions, with a coarse texture the decrease in transmissivity linked to a decrease in water concentration when rising above the water table is real and clearly superior to the decrease in water concentration in a fine textured substrate when rising from the same height above the water table, but this decrease in water concentration in a coarse textured substrate remains limited (of the same order of magnitude as a decrease in water concentration from 100% to 10% of the porosity) and is not sufficient to compensate for the better transmissivity at saturation of coarse textures, which is several orders of magnitude higher than the transmissivity of fine textures. In fact, when this water concentration passes by hypothesis from 100% of the porosity to 10% of the porosity, the quantity of water which will be subjected to the same pressure gradient is divided by 10 but the obstacles decrease and the resistance remains lower for all the water corresponding to "fre" water at a constant corresponding to the resistance force applied to the texture. In fact, when this water concentration passes by hypothesis from 100% of the porosity to 10% of the porosity, the quantity of water which will be subjected to the same pressure gradient is divided by 10 but the obstacles decrease and the resistance remains lower for all the water corresponding to "fre" water at a constant corresponding to the resistance force carried out on the free water in the smallest porosity still corresponding to free water (PF<4.2). Obviously, the less water that remains, the more the water that remains is essentially more and more strongly bound water and more and more difficult to mobilize because the forces exerted on the water by the surfaces are more and more likely to block it by immobilizing it against the immobile granular skeleton, But this is not the case as long as the water is only held by capillary forces which go in the direction of capillary rise and are exerted on water held by capillarity and not by Van der Wals forces. Also, in the case of sand where almost all the water is still either free or retained by simple capillary forces "weak and going in the direction of the capillary gradient," there will certainly be a slight decrease in permeability related to the decrease in water concentration, but this will not be the permeability of an order of magnitude greater than 10 for a water concentration divided by 10, which is not much compared to a ratio of $10^2$ or $10^3$ between the permeabilities of the substrates as soon as we go from clay to silt or from silt to sand. This brief analysis provides an initial explanation for the fact that the capillary flow created in sand can remain much higher than that created in clay, at least as long as the substrate is only drained by a moderate suction pressure.

In any case, the results of observation confirm that the objective of the first step of hydrating the turf is achieved in a completely satisfactory manner as soon as the water table depth is less than 40 cm and the substrate has a coarse porosity, as is the case with the blue and draining substrates of sports fields. When these two conditions are met, a capillary flow starts from the water table with an intensity that creates a capillary upward flow sufficient to continuously compensate for an evapotranspiration of up to 15 mm/day, i.e. a flow much higher than the evapotranspiration of the most demanding climates. Therefore, such an upward capillary flow is able to renew all the water subtracted from the substrate by the roots, by a continuous renewal at the rate of root consumption, while allowing an actual evapotranspiration intensity at the level of the potential evapotranspiration.

At depths greater than 40 cm but less than 1 meter, the hydration capacity of the upward capillary flow will be relatively satisfactory in providing the turf with sufficient hydration to combat water stress and die-off in climates where evapotranspiration exceeds 5 mm/day, even if actual evapotranspiration is less than potential evapotranspiration (as is the case today with turf hydrated by conventional twice-weekly sprinkler irrigation systems) and upward capillary flow will address satisfactorily in temperate, mainly oceanic climates, where average summer evapotranspiration is about 3 mm/day.

The constraints to ensure satisfactory capillary irrigation create a mechanical soil problem and impose the choice of hybrid substrates to guarantee that the soil will be mechanically stable despite a high water concentration.

In fact, from a mechanical point of view, with a traditional (non-hybrid) substrate, it is known that with shallow water table depths of 60 cm, and even worse for a much shallower depth of a few decimeters, as is the case according to the invention, such a shallow water table depth creates a water concentration on the surface and sub-surface that is too high to ensure sufficient mechanical strength.

Under these conditions, normal soil cannot withstand the mechanical stresses associated with sports activities or maintenance without rutting, compaction or deformation, which in winter, or even all year round for water tables at a depth of less than 30 cm, lead to rutting and deformation as well as compaction of the soil, The accidental maintenance of a water table at such a shallow depth for a prolonged period of time always leads to problems of hypoxia and then anoxia, which are seriously detrimental to the respiration of the roots and the development of the plants that one would like to cultivate during the period in question.

However, in the case of a normal soil, this incompatibility of the bearing capacity of a very shallow water table with an agricultural or sports use has been recognized for a long time and this explains the surprising fact that the hydration potential of plants by a very shallow water table has not been the subject of more observations transmitted by the state-of-the-art tradition.

However, despite the presence of a very shallow water table, and due to the use of these new hybrid substrates recently developed according to the invention, which allow a satisfactory mechanical resistance, even in conditions of quasi-saturation, such as may result from a particularly violent storm just before or during a match, it is now possible to respect this purely mechanical constraint, which constituted from the outset the first obstacle that was incompatible with such a shallow water table as the one chosen in the first step.

Thus, by using hybrid substrates according to the invention, the mechanical obstacle resulting from the presence of a water table at too shallow a depth is removed.

By restricting the invention to the context of structures comprising a hybrid layer, this allows satisfactory use in terms of mechanical strength, even with a very high level of moisture very close to the surface.

One can therefore never be too flexible (not strong enough) with hybrid substrates, but it remains to be verified in the following steps under what conditions this will be sufficient.

The invention is therefore based on the principle of limiting the depth of the substrate to less than a maximum depth, and on a choice of coarse and hybrid substrates, determined in such a way as to satisfy the two requirements of satisfactory spontaneous irrigation and mechanical resistance of the soil.

F—Flexibility of Sports Turf where the Structure Includes a Hard Water Storage Layer The flexibility of the field corresponds to the mechanical response of the field to a stress exerted on its surface during a sports activity. To a force exerted on the surface, the field reacts, with a slight delay, on the surface of the ground.

This reaction depends, on the one hand, on the reaction force of the storage layer on which the substrate rests, which must itself block at a certain depth in order to block the successive slices up to the surface, and also depends, on the other hand, on the damping deformation by the substrate of the blocking signal from the bottom of the substrate during the transmission of the blocking from bottom to top.

Therefore, in order to optimize the smoothness of the response, it is necessary to act on whatever favors a smooth response at the bottom and/or on whatever favors damping during the transmission of the blocking signal by the substrate.

We are interested here in the case where the substrate has significantly greater damping capacities than the more rigid bottom on which it rests, and we seek to optimize the effects of the substrate's hydrous characteristics on the damping.

Now, there are 5 elements known to influence the mechanical damping response of a mechanical sports load, which are the type of bottom, the type of substrate, the depth of the bottom, the water concentration of the substrate above the bottom and the water content of the substrate. Once the hard bottom type and substrate are provided, flexibility is promoted:

- by increasing the depth of the substrate, which favors an increase in flexibility until a threshold depth beyond which the flexibility is no longer changed at a constant water concentration,
- by increasing the water concentration of the substrate to a sufficiently high water concentration, beyond which the flexibility no longer changes significantly, by the existence and sufficient thickness of a slice of substrate saturated with water or almost saturated with water to about 3 or 4% just above the bottom (generally sought after and referred to as a "perched water table").

Obviously, the influence of these last three parameters depends on the substrate considered.

Staying with the example of the chosen reference substrate, which complies with the USGA standard, and which has been the subject of tests to estimate this influence, it was thus possible to observe the following in tests carried out with a reference substrate column resting on a hard support:

Concerning the influence of the total thickness of the substrate column above the bottom, the flexibility first increases rapidly with the thickness and then tends towards an asymptote, the increase in flexibility beyond a thickness of 12 cm being insignificant.

that a very considerable gain in flexibility of 40% is obtained for a saturation of the bottom of the column (perched water table in the case of draining layers) when the saturation thickness at the bottom of the substrate of a 12 cm column of substrate is increased from 2 cm to 4 cm, without improvement for a saturation thickness less than or equal to 2 cm and without any additional significant influence for a thickness of a perched water table greater than 4 cm and up to total saturation of the substrate;

that a significant though modest gain in flexibility of about 5% is obtained in the absence of saturation at the bottom of the substrate column when the average water concentration of the column increases from the field capacity of the substrate to an average water concentration occupying about half of the effective porosity of the column.

From these observations, 2 strategies are therefore possible for a sports field, outside or within the framework of the invention, to benefit from flexible ground.

Outside the scope of this invention, it is already known in the case of a gravel drainage layer that obtaining a water table perched at the top of the drainage layer is the most effective way to soften the field, which would otherwise be subjected to the hardness of the impact of the return flow due to the hardness of the drainage layer. The surface of the drainage layer being at atmospheric pressure, it is already customary to choose a substrate and its thickness that is as thin as possible, but thin enough for the thickness of its capillary margin to reach 4 cm, then choosing to adapt the thickness of the substrate so that it is not too wet all the time in winter, so that it can absorb a certain amount of rainwater without overflowing, while keeping a sufficient supply of water for the hydration of the plants between two sufficiently spaced out waterings. This compromise is not obvious, but it has traditionally led to the consensus of imposing a minimum substrate thickness of 30 cm.

On the contrary, in the context of the invention, it is precisely the presence of a water table that allows the substrate to dry out (paradoxical as it may seem), if we have a draining and capillary storage layer (due to the addition of artificial elements allowing the capillary continuity from the water table to the substrate) and whose surface is at a depth $P_1$ and a water table whose piezometric depth is at a depth $P_1+P_2$ (i.e. with an additional depth $P_2$ compared to the surface of the storage layer), This implies that the pressure at which the pressure is equal to atmospheric pressure (i.e. zero capillary pressure) is not $P_1$ as in the case of a drainage layer without a water table, but $P_1+P_2$.

Obviously, this changes everything and provides both a thinner substrate and a lower substrate thickness for a given air concentration.

Moreover, it is important to consider that the air concentration does not need to be high all year round, but only during heat waves and part of the time in the winter.

It is therefore possible to have an additional depth $P_2$ of zero for part of the time, with a very low air concentration in the substrate at that time. This makes it possible to take advantage of the complete potential tidal range of the storage layer between a high position at the base of the substrate and a low position to be determined depending on the period with an adapted strategy.

This element is essential from an economic point of view because the entire storage volume can be used by reducing the thickness of the substrate placed on top: there is therefore no need to increase the size of the storage layer for the same volume of water stored.

It is therefore sufficient to have a strategy which allows a water table to be placed in the lower part of the structure at times when it is necessary, and in this case it is no longer the thickness $P_1$ of the substrate but the sum of $P_1$ and the depth $P_2$ of the water table below the top of the storage layer which must be taken into account for the equations to be respected in the context of the invention.

Apart from the heat wave period, when it may be possible to have a less flexible sports surface to protect the grass from disease, the objective is to have optimum flexibility of the field, which means that the water table should not be lowered too far in order to maintain 4 cm of saturation above the top of the storage layer, which therefore allows the water table to be lowered to a depth equal to the thickness of the capillary margin minus 4 cm, without losing the flexibility provided by a water table that is perched at least 4 cm above the surface.

In the example of the curve shown in FIG. 5, which provides a curve for a substrate representative of the type of substrate used on sports fields and usable within the framework of the present invention, there is a small margin of subjectivity in the determination of the capillary margin because there is not strictly a horizontal plateau followed by a curve of a decreasing water concentration with an increase in the height above the water table, but it is possible to determine the capillary margin with the help of a graph. There is not strictly a horizontal plateau followed by a curve of decreasing water concentration with increasing height above the water table, but it can be considered that there is only 2% air up to 13 cm above the water table and then we gain 1% air per additional centimeter of height above the water table and it can be considered that the air supply point is at 13 cm above the water table and 2% air. The capillary margin thickness can be estimated at 13 cm, which means that 4 cm will still be almost saturated above the top of the storage layer if the level is reduced by 9 cm, i.e. $P_2$=13 cm−4 cm=9.

When the water table is reduced by less than 9 cm from the top of the storage layer, the ground retains its softness. If the level is reduced further, the air concentration of the substrate is increased, hardening the soil significantly.

This flexibility criterion must be taken into account in the search for an optimal strategy and provides the leeway of the water table level in order to control the flexibility of the perched water table as a function of the substrate curve, but unlike the root growth criterion or the summer aeration criterion, the flexibility criterion is independent of the thickness of the substrate layer.

G Optimization of the System of Substrate Layer Placed on a Storage Layer with a Fixed Storage Volume In general, the fields according to the invention presented below have a structure that can be described as composed of a substrate layer with a thickness of 10 to 40 cm placed on a capillary storage layer with a thickness of 5 cm to 200 cm, said capillary storage layer being located between the depth $P_{ROOF}$ of its roof and $P_{BASE}$ of its base and characterized:

in that $P_{ROOF} \geq P_{Min}$ and $P_{BASE} = P_{Max}$ in that the capillary storage layer has natural capillary characteristics or through the artificial addition of suitable means that allow the water to rise into the layer of substrate placed above it, regardless of the piezometric level of the water table between $P_{ROOF}$ and $P_{BASE}$, with a capillary flow that is at least equivalent to the flow that would result from the same evaporative demand at the top of the same substrate placed on a medium sand (between 250 μm and 500 μm) with a water table at the same depth.

It is unimportant that the water table level can be set higher than the storage layer.

It is unimportant that there is a continuity of constitution between the substrate and the storage layer, some layers are capable of having both functions, whereas other capillary storage layers, which will be studied below, have been specially designed to optimize the water storage capacity, even if it means having to add additional means to add the necessary capillary function.

In terms of water storage for deferred irrigation of grass, the efficiency of a porous layer is determined by its storage coefficient, i.e. the ratio of the volume available to store mobilizable water to the total volume of the storage layer. This ratio corresponds to the effective porosity of the porous storage medium.

In a conventional granular medium where the storage layer in which the water table is stored is made up of an arrangement of aggregates, this storage coefficient corresponds to the effective porosity which increases with the granulometry of the constituent grains while the capillarity decreases with this same granulometry. The higher the effective porosity, the less capillary the porous media are, and for this reason, media with relatively high effective porosity such as gravels are even used on a capillary barrier to block capillary rise. However, the specific storage layers according to the invention must have both a very high effective permeability and sufficient capillary capacity to allow the field to be satisfactorily irrigated in summer by a spontaneous capillary flow from the water table as long as the said water table has its piezometric level located anywhere in the said storage layer. Finally, the volume of water storage mobilized by capillary flow varies from 1% for clay and up to a maximum of 15 to 20% of the volume for medium sand, which is the natural granular medium with the highest effective porosity while still possessing an adequate capillary capacity to allow the mobilization of the stored water through an upward capillary flow in order to address for a very shallow water table, the hydration needs of the turf under the effect of evaporative demand, and this volume of water storage is up to 25% of the apparent volume for gravel, but the gravel does not have the capillarity allowing the water stored there to rise by capillary action into the substrate above if the gravel is not saturated to the top.

A mobilizable water capacity of 25% in volume is certainly modest, but already allows substantial water savings and a significant contribution to the reduction of storm rainfall.

Although this solution is not the most efficient in terms of storage, it is nevertheless worth considering from an economic point of view, especially for the rehabilitation of stadiums previously built with a drainage layer of gravel; a particularly interesting solution for rehabilitation is to reuse the gravel from the old drainage layer by installing it in a waterproof enclosure and adding a hydrophilic and permeable water table to the top of the gravel and installing a bundle of vertical capillary columns in the gravel layer.

This rather modest storage performance of natural granular media can be very significantly increased by using an artificial granular medium specifically composed of a mixture comprising cement and coarse aggregate and known by the trade name of Capillary Concreete. Indeed, this artificial granular medium allows a significant increase in storage capacity, between 40% and 50%. A layer of Capillary Concreete is a mechanically stable, highly porous concrete layer with macro-pores and therefore very effective porosity but very porous and whose dimensions are determined by the on-site shaping of the mixed product during the installation on the building site, thus making it possible to adapt to the circumstances using complex 3-D shapes such as can be found, for example, on grains or golf tees. However, its storage capacity of around 40 to 50% is still much lower than that of the artificial reservoirs presented below.

To optimize the storage capacity of a layer of the field structure dedicated to the storage of the water table, the ideal is obviously to have a ratio (storage volume/storage layer volume) as close as possible to 100% and for this the best possible storage ratio is therefore obtained for a volume practically made up of empty space. A storage layer of this type exists in fact, totally artificially, made up of a juxtaposition of self-supporting "containers." Even if it is not a stack of aggregates but an artificial storage reservoir with additional artificial means added for the capillary function, such a layer can be considered as a layer of a porous medium constituting the structure of a sports field according to the invention.

Juxtaposed containers used as a drainage layer under the substrate of a sports field are already known under the name of "Permavoid" containers, and they can also be used to mobilize vertically through capillarity with the addition of specific additional means, this system being known commercially under the name of "Blue2Green System." In practice, a layer of Permavoid containers is a stable mechanical structure consisting of a juxtaposition of plastic containers, parallelepipedic in shape and of predetermined dimensions, with an empty volume that represents more than 95% of the volume and with an upper horizontal surface in the form of a supporting grid resting on its vertical walls and on which a hydrophilic and permeable water table is installed, the layer of cultivation substrate resting itself on the said hydrophilic and permeable water table; these containers are crossed vertically by a bundle of capillary columns distributed horizontally along 2 horizontal axes and arranged at an adequate distance from each other, allowing the water to rise by capillarity from said water table to the substrate, to be distributed horizontally and then to rise in the substrate, with a homogeneous horizontal distribution of the capillary flow, in the presence of a water table at any level inside the containers despite the presence of a thickness of air separating the water table from the bottom of the substrate. Although this is an unusual artificial medium and very different from the granular porous media traditionally used on sports fields, such a layer of juxtaposed Permavoid containers can be considered as one of the layers of porous media constituting the structure of a field according to the invention, this artificial layer being mechanically stable and load-bearing, hydrologically capillary and hyper-draining and with a storage coefficient (or by extension "effective porosity") greater than 95%. The two main advantages of this solution are, on the one hand, its optimal storage coefficient and, on the other hand, its ease and rapidity of implementation during construction, since it is a matter of prefabricated modules that are easy to install.

Thus, in the range of water storage layers intended to be used later for irrigation of the lawn by capillary action, the capillary function of the storage layers according to the invention, which consists of allowing the water to rise into the substrate by capillary action in the presence of a water table at a certain level inside the said storage layer, must always be assured.

Depending on the solution chosen, this capillary function of the storage layers according to the invention can be ensured naturally by the porosity properties of the porous medium of said storage layer or by the addition of additional artificial means.

Depending on the importance attached to the objective of storing water in the structure, the water table storage layer according to the invention may belong to one of the following three categories of porous media:

- a granular porous medium whose porosity determines a water table storage volume by its effective porosity, permeability and capillarity sufficient to ensure the capillary function of said storage layers;
- a granular porous medium whose porosity determines a water table storage volume by its effective porosity, a permeability and capillarity insufficient to ensure the capillary function of the said storage layer, but whose capillary function is ensured by the addition of adequate artificial means;
- an artificial storage reservoir that is not a granular porous medium, with added capillary means to ensure the capillary function of the storage layer.

The use of gravel layers to be equipped with additional means to provide them with capillary capacity seems particularly relevant for the economic rehabilitation of fields previously installed in a gravel drainage layer without any particular objective in terms of water storage.

On the other hand, the installation of rigid containers equipped with additional means to provide them with capillary capacity, whether they be fixed-base containers such as the Permavoid containers already known or, a fortiori, movable-base containers according to the invention, are an excellent alternative to granular porous layers, as soon as water storage capacity for deferred sub-irrigation is a primary objective for the field in question.

In order to increase the efficiency of the storage of precipitation water under the field, it is also possible to equip the field with additional means to collect and convey to the specific water storage layer, located under the cultivation substrate of the sports field, the rainwater falling on a catchment area larger than the field itself, such as the roofs of the stands, the tracks, the parking lots or any other suitable surface around the field. This amount of water, approximately proportional to the size of the catchment area, is another important factor in the effectiveness of the said specific storage layer, both for the degree of water self-sufficiency and for the downstream flood control function.

However, while this additional means allows for maximum use of water from a rainstorm when the reservoir has room to store it, the water that can be stored is still limited to the size of the reservoir minus the water storage in place at the time of the rain event.

The problem with state-of-the-art storage layers, i.e. with constant storage volume, is threefold:

volume limits of the container:

A 150 mm storage layer cannot satisfy the objective of water autonomy in a demanding climate, for example in the Mediterranean, with a long drought and high climate demand in the summer, simply because the container is too small and therefore offers too little water reserve for summer irrigation in any case.

Certainly, in a Mediterranean type climate, with classic storm rains of 30 mm, and violent storm rains of 60 mm (or even 100 mm or much more in the case of Cévennes rains), properly managed containers of 150 mm make it possible to store the rainwater from several storms falling on the field and allow this water to be consumed by the plants between storm events, so that it can in principle provide water self-sufficiency for the turf outside of the summer, i.e., in the fall, winter and spring, while effectively participating in downstream flood control during fall and spring storms, especially if the catchment area is larger than the field itself. However, as far as summer is concerned, and even without taking into account the necessary constraint of keeping a storage reserve for storms, and without taking into account either the necessary constraint according to the invention of minimum depth of the water table in winter and during heat waves, the maximum volume of water storage is in any case limited to 150 mm for the heavy version of the Permavoid containers, whereas the water needs in summer in a Mediterranean climate for real evapotranspiration desired according to the invention at the level of REE can be evaluated at 5 mm per day (or even 10 mm per day in an extreme climate), i.e. 150 mm per month (or even 300 mm per month) with periods of drought that can last for 4 months (or even 6 months), i.e. a total volume of stored water needs of at least 600 mm if water autonomy with real summer evapotranspiration is desired, according to the invention, equal to the potential evapotranspiration. It would therefore be necessary to have a storage volume at least 4 times larger, of the magnitude of 60 cm to store water in winter for use in summer, which corresponds to both winter rainfall resources and summer needs in a Mediterranean type climate.

Limits to the ability to increase the volume of the container to address the constraints of the turf.

However, the simplistic solution of quadrupling the thickness of Permavoid containers to provide the necessary storage volume is not feasible, not only because of the financial impact but also because the water table level would have to be too high in winter to accommodate the turf constraints.

With a fixed base, the water table level is equal to the base level plus the height of the water storage. Assuming a summer consumption of 60 cm, this means that in the low situation the water table level is equal to the thickness of the substrate, plus the air gap above the high level at the beginning of the summer, plus the 60 cm of water storage for the summer.

This is 80 cm plus the air gap above the high level at the beginning of summer for a 20 cm thick substrate. The condition for sufficient flow is therefore not met, even for a zero void. But for a zero void, the condition of oxygenation of the roots since the end of winter and aeration during the heat wave at the beginning of summer is not met either.

If the base is not lowered much, the conditions for oxygenation and aeration of the substrate are even worse.

Limits on the number of times the container can be filled to meet the constraints of the turf Management of water table depth variation can and should be optimized, and examples are provided below that remind us of both the turf constraints and the strategies for optimizing the use of storage containers despite their volume limitation.

With this type of strategy, in oceanic type climates where the summer water requirement is relatively moderate, with an average summer potential evapotranspiration of 3 or 4 mm per day, and with rainfall that is relatively well distributed throughout the year, including in summer, the Permavoid container solution is a solution that can satisfy, depending on the circumstances, between 75% and 100% of the annual water requirement in this type of climate. In addition to the constraints of the turf, it must always be considered that the specific storage layer can only store water from a rainfall event for future irrigation or flood control if the potential storage volume is not already filled with water at the time of the event; This implies a strong additional constraint of anticipation and possibly even partial emptying as a precaution to have a volume dedicated to flood control, sometimes anticipating the simple possibility of a precipitation event that may not occur, which may in certain cases and circumstances reduce the storage capacity for deferred irrigation.

Thus, to summarize, it is convenient to describe a preferred example of capillary storage layers according to the invention as a combination of 1 to 7 layers including:

- a layer of substrate marketed under the name Radicalé with a thickness of 4 to 20 cm;
- a layer of sand with a D10 of between 200 and 800 um, with a thickness of 5 cm to 200 cm, if present,
- a layer consisting of a juxtaposition of containers of a type known and marketed under the trade name Permavoid with a thickness of 7 cm to 15 cm, if present, said containers being provided with a bundle of vertical capillary columns allowing capillary rise through the air-filled void above the water table level;
- a layer of gravel from 7 cm to 150 cm, if present, said layer of gravel being provided with a bundle of vertical capillary columns or capillary wicks allowing capillary rise through the capillary barrier constituted by the essentially air-filled porosity of the gravel above the water table level;
- a layer of the product marketed under the brand name Capillary Concreete by the company Capillary Concreete, with a thickness of 5 to 15 cm if present;
- a layer of sand with a D10 between 200 and 800 μm located under the layer of the product marketed under the brand name Capillary Concreete, with a thickness of 10 to 250 cm, if present;
- A layer composed of hard or soft fibrous materials, natural or artificial, crushed fibrous material or pieces such as coral, chalk, crushed wood or fibrous pellets, natural pellets of Posidonia, pieces of carpet, all constituting a porous medium with high macroporosity between the aggregated constituents and a capillary network within the aggregated constituents.

The aggregation of fibrous materials, which can be in particular agricultural or industrial wastes, are very useful for this application of storage with upward flow by capillarity in the sense that they present a double porosity with fine pores which permit high and coarse pores to rise fast by filling the fine pores at each height as it has been seen concerning the moderating of the capillary flows according to the characterization of the porous medium by a double porosity.

Capillary Concreete, which has been specially developed for this purpose with an additional stability feature, works on this principle, and the Radicalé Substrate also has this capability.

The particular case discussed below corresponds well in practice to one of the first practical questions that the market will ask in the search for the best possible field creation products.

The invention provides a general approach that can be applied to a variety of materials, climates, budgets and performance requirements.

However, among the drainage layers according to the invention, some have been artificially designed for their purpose. These are artificial capillary storage layers specifically designed for this purpose and include:

- either a layer consisting of a juxtaposition of containers of the type known under the trade name Permavoid, with a thickness of 8 cm to 15 cm, said containers being provided from top to bottom of the layer with a bundle of vertical capillary columns allowing capillary rise through the air-filled void above the level of the water table.
- either a layer of the product marketed under the brand name Capillary Concreete by the company Capillary Concreete, with a thickness of 5 to 15 cm.

The question here concerns those fields that use expensive and high-performance materials in order to optimize the quality of the turf and minimize the need for water from the network.

Of course, by choosing a given substrate and a given type of storage and by choosing the model of a substrate laid on a storage layer, the question of determining the thickness of the substrate and the thickness of the storage layer arises immediately, and the aim here is to use the criteria of the invention to show how, depending on a few choices, it is possible both to reduce the thickness of the substrate and at the same time to reduce the amount of "wasted" water.

The principle of this particular solution proposed in this figure according to the invention is to use the concept of solving the problems not all at the same time but each at the moment that it arises because the water table has a variable depth over time, which not only allows for a tidal range in order to make the best possible use of the storage volume, but also allows for an influence on the oxygenation of the roots and on the aeration during a heat wave, which will depend on the variations in the level of the water table at the time concerned.

Since the objective is to minimize substrate thickness through a water table depth strategy, the choice is made for an oxygenation constraint.

with $P_{TOR}$=5 cm, $\theta_{AIR\ MIN\ TOR}$=5%, $\theta_{AIR\ MIN\ SUMMER}$=5%, $P_{MIN}$=40 cm For these different solutions, the flexibility constraint will then be considered with several proposals.

Similarly, a solution with $P_{MIN}$=45 cm will be proposed.

The principle of the search for water table management with a high-performance and expensive substrate placed on a high-performance and expensive storage layer is to minimize the thickness of the substrate and at the same time to optimize the use of the storage in order to minimize the water requirements of the network, which implies discharging as little water as possible.

In this strategy of low substrate thickness and water table variation, the dual objective of the choice of substrate thickness is to have the lowest possible thickness and to save as much irrigation water as possible, with the technical constraint of respecting the constraints of oxygenation, aeration, flexibility and irrigation by choosing the most appropriate strategy for varying the water table level according to the season.

The scenario proposed here is to have a very high water table level in winter (and even higher than the storage roof), a level which, outside the criteria of the invention, would classically be considered as being of a nature that would drown the turf, but with the provision, according to the invention, of being able to carry out a moderate drainage of the water table once in a while.

This drainage must be sufficiently low so as not to reject too much water in total during successive drainings, but sufficiently well-calculated on the basis of the drainage curve to ensure a sufficient air intake (in this case 5%) at each drainage at the depth of the roots (in this case 5 cm), so as to oxygenate said roots perfectly at said depth.

The important point to consider when establishing the water table level scenarios is that the water table level increases according to the height of water received by voluntary water supply or by precipitation, or decreases according to the height of water rejected by drainage or consumed by evaporation, so that each variation in the water table level is made by an equivalent supply or decrease in the height of water in storage. Each lowering of the water table by drainage is done at the expense of stored water which will not be available later.

The case of a layer of containers with a movable base according to the invention is therefore not considered here because it does not impose this constraint (and this is why this solution is also proposed according to the invention).

One can simply consider that the structure is composed of a Substrate placed on a Storage Layer.

The structure sought here is a thin hybrid substrate placed on a storage layer, it may in particular be a single-layer hybrid substrate on a storage layer or a two-layer substrate with a hybrid substrate on a sand layer (but considering a hybrid substrate up to at least 5 cm in depth), and the said substrate being placed on the storage layer which can be a layer of gravel with a bundle of capillary wicks but preferably a layer of Capillary Concreete or preferably a layer of containers with a network of capillary columns such as, for example, Permavoid type containers.

The question that arises from the outset in this figure is to determine the best possible combination of substrate thickness and storage thickness to optimize the effect of the additional investment cost.

In order to minimize the costs and the economic and ecological impact of the work, it is clear that the best solution is to seek the minimum thicknesses required for the two structures and, as regards the substrate, to choose the thinnest possible substrate thickness for a given storage layer thickness, i.e. the largest of the mandatory minimum thicknesses as determined in accordance with the invention, in order to address the various criteria to be met and to not to go beyond the thickness that makes it possible to address them with a realistic and feasible scenario of water table variation.

Storage structures are chosen for their theoretical capacity to store as much water as possible per cm of storage layer (this is the case with containers).

However, it must be considered that the additional investment cost per cm of storage will be all the more justified if the entire volume is actually used to the maximum to store water and only the minimum is discharged, the water being best used when it is consumed for irrigation and least used when it is discharged to lower the water table.

In addition, these high-performance storage structures have a rigid upper surface at the substrate interface, which implies an additional condition of a perched water table to reduce the lack of flexibility that otherwise results.

To determine the correct substrate thickness, it is therefore necessary to consider all the constraints on substrate thickness one after the other and to search for the smallest substrate thickness at each time of year (with an implicit climate scenario) that addresses all these constraints based on an explicit water table depth scenario.

The constraints should be recalled here:

- Tests with different substrates show in general that for a good flexibility of a sports soil consisting of a substrate laid on a hard surface, the flexibility increases at best up to 12 cm of substrate and that the flexibility does not increase beyond that.
- The roots of a sports field should develop at least to 5 cm and are very satisfactory if they develop densely to 7 cm or 8 cm, although they can develop to 12 cm or even 15 cm.
- other tests carried out with different substrates have shown that flexibility is increased very significantly, up to 40% or 50% when there is a water table perched at least 4 cm above the top of a hard surface, but does not increase significantly if this thickness is increased.
- The strategy for optimizing the ecological and economic efficiency of the storage layer in terms of water savings is to fill the containers "to the brim" in winter when the rain-evaporation balance is positive, then allow the water table to drop to the bottom of the storage layer during the spring by irrigating the turf with a slightly negative rainfall-evaporation balance, and add as much water as necessary to maintain the water table at the base of the storage layer during the summer and fall until the positive balance causes the water level to rise again.

Specifically, the storage level is considered to represent the lowest water table level, but in winter the water table may rise higher in the substrate than the top of the storage layer.

More precisely, the strategy is to let the water table rise in autumn and winter until it almost saturates the substrate through the capillary margin up to 5 cm from the surface and to lower the water table as many times as necessary to the top of the storage (thus discharging and losing the corresponding quantity of water), knowing that there would be no room for additional water in the storage layer or in the substrate above, and that these discharges are made as long as the following month has a positive forecast balance (rainfall minus precipitation).

Thus, with regard to water saving, in winter the water level never falls below the top of the storage layer, or not more than 2 or 3 cm, and the substrate therefore serves as an overflow storage during this period. The paradoxical positive aspect is that it is precisely this overstorage that makes it possible to reduce the need for substrate thickness to address the need for root oxygenation, because this overstorage of water in the substrate then provides the opportunity to drain this overstored water and thus to bring oxygen to the roots each time the overstored water is drained from the substrate.

However, this means that the constraints of oxygenation of the roots in winter and of the hot water concentration in summer must be respected according to the invention, but with the principle that the water table is at its highest in winter and at its lowest in summer, with modulations to be defined more precisely.

Oxygenation Constraint of the Roots

The air concentration at 5 cm from the surface must be greater than or equal to 5% when the water table is lowered to the top of the storage layer:

i.e. $P_{TOR}$=5 cm, and $\theta_{AIR\ MIN\ TOR}$=5%.

i.e. $P_{TOR}$=5 cm, $\theta_{AIR\ MIN\ TOR}$=5%, $\theta_{AIR\ MIN\ SUMMER\ 5\ cm}$=5%, $P_{MIN}$=40 cm $$P_{piezo}-P_{piezo\ MIN\ SUMMER\ AIR\ 5\ cm}=5+h_{cj(5)drainage}(\varepsilon j(5)-\theta_{MIN\ SUMMER\ AIR\ 5\ cm})$$

For a sand like the reference sand, this implies a substrate thickness of at least 5 cm+15 cm=20 cm.

By lowering the water table to within 3 cm of the top of the storage layer during November, December, January, and only to the top of the storage layer in February, an additional 3 cm Δ=3 cm can be gained.

Moreover, some tests have shown that even an air concentration of 3% at 5 cm from the surface can in fact be sufficient, but with a much thinner safety margin in managing the depth of the water table, which must then be managed precisely according to the precise shape of the capillary drainage curve, and in particular the height of the air inlet.

In the case of the Radicalé substrate, this is much easier to manage because there is already 10% air at 5 cm for a total substrate thickness of only 15 cm.

In order to have an average range that works for all substrates, this strategy requires that the substrate have a minimum thickness of between 15 and 20 cm for winter oxygenation of the roots.

In order to allow for fine-tuned management, the rule to be followed is the following equation:

$$\text{Substrate thickness} \geq 5\ \text{cm}+hc\text{drainage}(\varepsilon-5\%)-\Delta=5\ \text{cm}+hC\ \text{AIR}(5\%)-\Delta$$

where Δ represents the small portion of the top layer drained (3 cm in the example provided above).

It appears that Δ=3 cm is acceptable for climates with sufficient rainfall to refill the storage or even the overstorage in the substrate after the last drainage of the overstorage at the end of the wet season before the season when the balance (rain minus evaporation) becomes negative.

Summer constraints

When summer arrives, and in particular during a heat wave, it is decided according to the invention to have as a criterion a "theoretical" air concentration of at least 10% for the smallest storage thicknesses and at least 15% otherwise for conventional hybrid sandy substrates.

For the Radicalé substrate, there is 10% air at 10 cm from the water table and the summer experiments have shown that the summer behavior is perfect for a minimum height of the surface greater than or equal to 20 cm above the water table (in fact it is already satisfactory from 15 cm, which corresponds to 10% air at 5 cm from the surface).

summer constraint for Radicalé substrate: water table 20 cm and by choosing a "safety margin" Δ'=1 cm, the minimum thickness of the Radicalé Substrate to be able to respect the canicular period constraint for the Radicalé Substrate is thus:

16 cm for a storage layer of 5 cm, 13 cm for an 8 cm storage layer 6 cm for a 15 cm storage layer The summer aeration conditions are written in general terms:

Substrate thickness≥5 cm+hcdrainage $(\varepsilon-\theta_{AIR\ MIN\ SUMMER\ 5\ cm})$−storage thickness+Δ' with Δ'≥0 Δ' the thickness margin is above the base from which the condition is verified.

For the reference sand and thus for most sandy substrates, the minimum thicknesses are obtained based on the storage thickness and minimum air concentration requirement and a safety margin selected as follows $\theta_{MINSUMMER\ 5\ cm}$=10%, Δ'=1 cm there is hcdrainage (ε−10%)=19 cm The minimum thickness of reference sand to meet the stress of the heat wave period for the Radicalé substrate is therefore:

20 cm for a 5 cm storage layer, 17 cm for an 8 cm storage layer 10 cm for 15 cm storage layer $\theta_{AIR\ MIN\ SUMMER\ 5\ cm}$=15%, Δ'=1 cm there is hcdrainage (ε−10%)=24 cm The minimum thickness of the reference sand in order to respect the constraint of the heat wave period for the Radicalé substrate is therefore:

25 cm for a 5 cm storage layer, 22 cm for an 8 cm storage layer 15 cm for a 15 cm storage layer The constraint for the substrate thickness is of course greatest for a small storage thickness.

In fact, this means that with a large storage thickness, the summer constraint is generally met even before the water table is at the bottom, and the longer before and after the water table is at the bottom, the more it is met.

In addition, it is necessary to verify that the hydration is sufficient.

We have seen that this condition is verified as soon as the substrate is in the medium sand range and for a water table whose depth is less than 40 cm.

This simply implies that for a perfectly satisfactory operation in terms of hydration of the turf and rational use of the entire storage volume, the water table can still correctly feed the turf when it is at the very bottom of the storage layer (otherwise this part of the bottom of the storage layer is useless).

Therefore, we must have: thickness of (substrate)+thickness of (storage)≤40 cm

In the case of a storage thickness of 15 cm, this implies a substrate thickness of less than 25 cm for sufficient hydration.

Of course, if the substrate thickness were, for example, 35 cm, the water table would have to come down to 50 cm from the surface to make the best use of the storage layer and at 50 cm from the surface turf will probably not show signs of water starvation but over an extended period of time and at the time when the turf needs it most, irrigation may be less than needed for optimal growth.

There is still the constraint of flexibility that must be overcome in conjunction with the previous ones, but it does not concern the thickness of the substrate. It is not necessarily required to use a soft turf for the game all year round, as the turf is often not used during the summer.

In any event, the softness of the field requires a water table at least 4 cm above the hard top of the storage layer.

This means that the flexibility conditions are only met if the depth of the water table relative to the top of the storage layer is less than the thickness of the capillary margin (i.e. the height of the air entry point) minus 4 cm.

In the case of the reference sand, the capillary margin is about 13 cm thick, which implies that the depth of the top of the storage layer should not exceed 9 cm.

For a 15 cm storage layer, the bottom 6 cm does not meet the requirement.

The finer sands have a thicker capillary margin and therefore the condition would be better met, but the Radicalé substrate has a thinner capillary margin. It might be wise in the perspective of summer field use to have a bilayer with Radicalé substrate at the top and 5 cm of reference sand between the Radicalé substrate and the roof of the storage layer.

This constraint is important for the management of the water table and the athletics schedule, but does not affect the thickness of the substrate layer.

It is important to remember that oxygen deficiency problems are much more severe for roots in the warm season than in the cold season, and that the roots are better able to withstand the lack of oxygen in the cold season if they have built up reserves in the previous warm season. The proposed oxygen strategy respects the natural cycle of the turf by having perfect oxygenation of the turf throughout the year and lower but adequate oxygenation only in winter.

The scenarios of a lower water table in summer and a very high water table in winter proposed in the invention below may seem complicated, but they too simply reproduce the principle of water table depth cycles in nature.

If we summarize all the constraints concerning the thickness of the substrate above the storage layer, we see that the thickness of the substrate must be:

- preferably less than 25 cm for a storage thickness of 15 cm
- at least between 15 cm and 20 cm for oxygenation of the roots
- at least between 10 cm and 19 cm for air concentration in hot weather.

The case of the Radicalé substrate is much easier to deal with for root oxygenation and with regard to summer air concentration, numerous tests have shown that a minimum air concentration of 10% at 5 cm, i.e. a water table depth of more than 15 cm from the surface provides perfect results. In this context, the minimum thicknesses necessary for the Radicalé substrate are lower than the thicknesses for the reference sand of 5 cm for the oxygenation constraint of the roots and from 4% to 9% depending on whether one chooses an aeration constraint at 5 cm of 10% or 15% for the reference sand.

For the reference sand, two values of minimum summer air concentration of 10% at 5 cm and the conservative basis of 15% air concentration at 5 cm were chosen to determine the minimum substrate thicknesses.

Given the differences in the substrates, the leeway with the safety margin (Δ and Δ'), it is not possible to determine precisely "THE" right thickness, but it is preferable to provide ranges of minimum substrate thickness, knowing that the only maximum limit is the maximum depth for good irrigation in summer. However, here again, there is some leeway and even more important because between a perfect flow in all circumstances with a water table of 40 cm and an irrigation flow almost always satisfactory at 60 cm, there is also a margin of discretion. In any case, the largest of the values retained for the sum in the parameter choices below is less than 40 cm.

Obviously, the summer constraint is most important with a thin storage of 5 cm, implying a minimum substrate thickness of between 20 cm and 25 cm, depending on the choice of the minimum value of air concentration at 5 cm, between 10% and 15%.

The oxygenation constraint implies a minimum thickness of 19 cm, which can be reduced to 16 cm if the water table is allowed to fluctuate to a low point 1 cm from the base during winter drainage (choice of Δ1 to Δ=4).

It can be seen, therefore, that for a low storage thickness it is the summer load that imposes the constraint.

For the Radicalé substrate, all other things being equal, the summer limit is 16 cm and the winter limit is between 12 and 15 cm, so the summer limit of 16 cm should also be used, but the two limits are almost equivalent.

This solution is useful for turf management, but not very relevant for significant storage of precipitation water, but it can play a role in flood control and can retain up to 20 or 30 mm of water during stormy rains, which can be an advantageous way to take advantage of stormy rains For a medium thickness storage layer, of 8 cm, the summer limit is less important, implying this time a minimum substrate thickness between 17 cm and 22 cm depending on the choice of the minimum value of air concentration at 5 cm between 10% and 15%.

The oxygenation limit implies a minimum thickness between 17 and 19 cm depending on the choice of Δ between 1 and 3.

We can therefore see that for an average storage thickness, the two limits, summer and winter, impose the same range of minimum thickness limits, between 17 cm and 22 cm.

The Radicalé Substrate makes it possible, without changing the criteria or the water table depth scenario, to lower this range to between 12 cm and 15 cm.

This solution is useful for turf management and is not optimal for the storage of precipitation water, but it does allow for a really useful water height of 50 to 60 mm to be adjusted between consumption and irrigation.

For storage of a still greater thickness, of 15 cm, the summer limit no longer has any impact, implying this time a minimum thickness of between 10 cm and 15 cm depending on the choice of the minimum value of air concentration at 5 cm between 10% and 15%. And it is then the oxygenation limit that imposes its values, implying a minimum thickness between 13 cm and 19 cm depending on the choice of Δ between 1 and 7 cm.

This solution is more expensive in terms of storage, but allows the thickness of the substrate to be reduced while giving the substrate itself a much greater margin for maneuver, both in winter and in summer. In spite of the limits already explained for fixed volume storage, which cannot use winter water to irrigate in summer in the Mediterranean climate, this is the most relevant solution with a very substantial storage of precipitation water, allowing autonomy in water outside of the long summer droughts and making it possible to take full advantage of summer storm precipitation, especially if additional means make it possible to increase the catchment area collected.

However, for a water table thickness greater than 9 cm, the problem of field flexibility arises.

Indeed, it was seen that the flexibility of the field implies a perched water table thickness of 4 cm above the storage roof, which implies a water table that does not descend to more than the capillary edge thickness minus 4 cm, i.e. for the reference substrate 13−4=9 cm.

The type of substrate just above the water table is important because the water table above the storage roof does not depend on the entire substrate but on the substrate just above the water table. In the preferred case of the Radical substrate, which has a very low capillary fringe thickness, a Radical bi-layer on sand with at least 5 cm of sand at the base should be considered.

The Radicalé substrate in bi-layer of which 5 cm of sand layer would allow, with the same strategy of the water table depth (Δ=8) to go below this range between 7 cm and 15 cm. But to have 5 cm of sand below the Radicalé and to be in the Radicalé at 5 cm below the surface, it is preferable to have a bi-layer of 7 cm from Radicalé above 5 cm of sand, that is 12 cm.

Therefore, in the Radicalé substrate, the minimum thickness of the substrate is between 12 cm and 15 cm for a 15 cm storage layer.

With Δ=7 cm, it is possible to go lower to better oxygenate the substrate, but the level is above the depth of 9 cm in relation to the roof of the storage layer, which is the depth that should not be exceeded in order not to lose the flexibility of the soil.

In the case of a 15 cm storage layer, there is a choice between not playing for part of the summer (which is the case on many fields during the summer break) or accepting a hard field in the summer or not lowering the water table below 9 cm below the substrate roof for part of the summer. In any case, the thickness of the substrate makes no difference.

This is obviously a major disadvantage of fixed volume storage and an additional reason for proposing an alternative solution in the form of vertically movable containers.

In summary, the following rules should be observed:

sufficient hydration:

substrate thickness+storage thickness<50 cm, preferably <40 cm

Sufficient Oxygenation:

$$\text{Substrate thickness} \geq 5\text{ cm} + hc\text{drainage}(\varepsilon - 5\%) - \Delta = 5\text{ cm} + h_{CAIR}(5\%) - \Delta$$

where Δ is the small portion of the top layer of the storage layer emptied during winter drainage.

Δ<storage thickness

Depending on the chosen scenarios a varies between 0 cm and 3 cm if storage thickness<9 cm and A varies between 0 cm and 8 cm if storage thickness<9 cm.

Summer Aeration:

The summer aeration conditions are written in the following general way:

Substrate thickness≥5 cm+hcdrainage $(\varepsilon - \theta_{AIR\ MIN\ SUMMER\ 5\ cm})$−storage thickness+Δ' with Δ'≥0 and Δ'<storage thickness Δ' is the thickness margin above the base at which the condition must be verified In the selected scenarios, Δ'=1

There is also a rule of flexibility which demands that the overflow of the water table in relation to the storage roof be less than the thickness of the capillary margin of the substrate just above the storage roof minus 4 cm:

for the reference sand, we have a choice of $\theta_{AIR\ MIN\ SUMMER\ 5\ cm}$ between 10% and 15%.

for the Radicalé substrate, we have $\theta_{AIR\ MIN\ SUMMER\ 5\ cm}$ which is 10%.

By varying Δ, which allows us to increase the oxygenation to cm at each winter drainage but at the expense of a greater quantity of water rejected, and by varying $\theta_{SUMMER\ MIN\ AIR\ 5\ cm}$ between 10% and 15%, which are all acceptable values for determining the depth of the water table during a heat wave, and by varying the thickness of the storage layer between 3 values (5 cm, 8 cm and 15 cm) each choice of these 4 parameters allows to deduce the minimum thickness of the substrate by the rules determined according to the invention from the main drainage curve.

From this calculation, considering the 3 storage depths and the 2 substrate categories, there are 2 cases for each storage thickness, each with an interval at which the minimum thickness of the substrate varies, which corresponds to a substrate thickness that allows for the implementation of a satisfactory water table depth strategy.

As the storage thickness increases, it is possible to decrease the thickness of the substrate laid on top of it, so that the values found for a given storage thickness work for a thickness greater than or equal to said thickness.

Since an important objective for the market is to determine a substrate thickness that is known to work well with a straightforward rule to implement, which is the case of the water table depth variation strategy determined from the choice of Δ, we can therefore consider for each storage thickness that the correct minimum thickness of the substrate layer is determined by the interval between the minimum and maximum obtained by varying the substrate, Δ and the requirement of $\theta_{AIR\ MIN\ SUMMER\ 5\ cm}$ and remembering that each scenario must satisfy the winter conditions and the summer conditions.

Thus, with thickness (STORAGE)≥15 cm we must verify:

min thickness (SUBSTRATE) between 12 and 19 or more, and between 6 and 15 or more or: thickness (SUBSTRATE) in the interval [12, 19]

with thickness (STORAGE) 8 cm one must verify:

min thickness (SUBSTRATE) between 12 and 19 or more and between 12 and 22 or more or: min thickness (SUBSTRATE) in the interval [13, 22]

with thickness (STORAGE)≥5 cm one must verify:

min thickness (SUBSTRATE) between 12 and 19 or more, and between 16 and 25 or more or: min thickness (SUBSTRATE) in the interval [16, 25]

Thus, we consider the embodiments according to the invention where the capillary storage layer is a capillary storage layer specifically designed for this purpose and which comprises:

either a layer consisting of a juxtaposition of containers of the type known under the trade name Permavoid, with a thickness of 8 cm to 15 cm, said containers being provided from top to bottom of the layer with a bundle of vertical capillary columns allowing capillary rise through the air-filled void above the level of the water table;

or a layer of the product marketed under the brand name Capillary Concreete by the company Capillary Concreete, with a thickness of 5 to 15 cm.

A preferred embodiment of the invention relates to a field construction structure consisting of a layer of cultivation substrate (SUBSTRATE) laid on such a capillary storage layer specifically designed for this purpose, of a thickness greater than or equal to 15 cm, the thickness of the substrate being between 12 cm and 19 cm.

Another preferred embodiment of the invention relates to a field construction structure comprising a layer of growing medium (SUBSTRATE) laid on such a specifically designed capillary storage layer for this purpose, having a thickness of 8 cm or more, the thickness of the medium being between 13 cm and 22 cm.

Another preferred embodiment of the invention relates to a field construction structure composed of a layer of cultivation substrate (SUBSTRATE) laid on such a capillary storage layer specifically designed for this purpose, having a thickness greater than or equal to 5 cm, the thickness of the substrate being comprised between 16 cm and 25 cm.

H—Proposal for Mobile Bottom Storage Containers with Variable Storage Volume and Management Proposal Using these Containers for Water Autonomy and Oxygenation and Climate Conditioning of the Substrate The storage layers without a movable bottom do not make it possible to achieve all the objectives of the invention:

- in passive mode, a sufficient capillary flow but without hindering the oxygenation of the field in winter or during heat waves and with a capacity to store the water when it falls (winter and storms) in order to have enough water in summer to irrigate the field autonomously with a capillary flow capable of sustaining an actual evapotranspiration at the level of the potential evapotranspiration;
- and in active mode, the means to heat the substrate and the turf in winter or to cool it in summer while replacing stale air with fresh air from the atmosphere.

The type of containers already known without a movable bottom does not yet make it possible to fully meet the objective, preferred according to the invention, of water autonomy thanks to the winter storage of a large quantity of water intended for the summer hydration of the turf. In this perspective, the invention proposes the creation of artificial reservoirs with added capillary means in the form of solidly juxtaposed containers and characterized by a vertically mobile horizontal bottom equipped with means for raising and lowering according to a management mode adapted according to the invention.

Also, within the framework of the preferred solutions meeting a very high requirement concerning the storage of precipitation water, the present invention proposes a preferred solution characterized by new means and management mode, with an artificial storage tank with a vertically movable bottom, with added capillary means adapted to a movable bottom and which confer on the sports fields which are equipped with this functionality of autonomy in water impossible to obtain otherwise.

Moreover, only tanks with a movable bottom make it extremely easy and economical to manage the flexibility of the field, the oxygenation of the field and the temperature of the field without additional water consumption.

According to the invention, a specific storage layer has been devised, consisting of a juxtaposition of sufficiently thick empty containers, with a grid and a geotextile in the upper part and a vertically mobile horizontal base:

- to be able to store all the water necessary for the targeted self-sufficiency,
- to be able to adjust the water table level perfectly at any time depending on the depth of water stored at the time and the requirements according to the invention regarding the desirable water table level.
- in this way, the water level can be raised in the substrate and lowered by sucking in surface air.

Thus, this structural technique of vertically sliding bottom containers allows:

- to have both a maximum storage capacity with an adjustable water table level and at the same time without the constraint of having to discharge rainwater in winter or during periods of hot weather so that the water table level respects the depth conditions required according to the invention;
- to have the water stored in the containers and a simple, inexpensive and incomparably efficient means of rapidly cycling the water table stored in these containers up and down in the substrate at any time, simply by raising and lowering the bottom of the containers. This makes it possible to influence the temperature of the substrate and the turf and then to draw in air from the surface atmosphere to refresh the air in the substrate without the need for additional water from the outside and without any other means than the bottom of the vertically sliding containers.

According to a preferred embodiment of the invention, the storage layer of the soil structure is comprised of a juxtaposition of containers, such as that schematically shown in vertical cross-section in FIG. 6 and referred to as a whole by reference 10, having as a fixed portion vertical edges 11 and 12 at the periphery and a horizontal grid 13 at the top, with a hydrophilic geotextile (not shown) laid on the horizontal grid 13, the substrate (not shown) resting on said hydrophilic geotextile.

As the level of the water table in the containers is always equal to the level of the bottom plus the thickness of the stored water, it is sufficient to adjust the level of the base, which is therefore mobile, so that the level of the water table is at the desired level. The very simple adjustment of the level of the mobile base 14 is then as follows: base level=desired water level minus the depth of water storage.

The means of managing the level of the water table make it possible to determine the level of the surface of the water table and to adjust the level of the movable floor 14 as a function of the signs relating to the depth of this movable floor 14 and to monitor the depth of the water storage (which can possibly be confirmed by cross-referencing the information if electrical conductivity sensors are installed in the volume of the containers).

The movable base 14 of each container 10 may be raised and lowered by any suitable means.

An example of a proposed means according to the invention consists of the use of a jack 15 or a plurality of jacks. The jacks may be chosen hydraulic or electric.

Furthermore, to create water convection in the substrate and for the stored water to rise to fill the porosity to the surface, without the need for additional means to bring water from elsewhere and manage the pressure thereof to percolate through the substrate, it is sufficient to sufficiently raise the movable base 14 of the containers.

This simply requires:

- that the movable base 14 of the containers be equipped with a means capable of exerting a vertical force capable of carrying the weight of the water storage for the objectives of capillarity in passive mode and of overcoming the resistance exerted by the substrate to the percolation of water from the base up for the objectives of active management of the cultivation conditions by convection of water through the substrate;
- to have a volume of water stored in the water table inside the containers greater than the volume of air in the substrate porosity to be replaced by water.

In one embodiment cited by way of example only, the provision of a central jack 15 or an array of jacks positioned in a balanced manner to support and vertically displace each movable base 14 of the box allows the movable base 14 of the box 10 and the weight of the water storage to be carried and in an active mode to overcome the resistance exerted by the substrate to the percolation of water from the bottom up.

Each jack 15 must itself rest on a stable surface 16 capable of resisting without movement the force exerted in the opposite direction to support or raise the base of the water-carrying box. The containers can have a fixed supporting part on which the jack that carries the mobile base rests. An example of implementation concerns a juxtaposition of 400 containers of 20 $m^2$ each with 16 tons per box, a jack, constituting a partition of a plot of land measuring 8,000 $m^2$, with a hydraulic jack 15 in each container lifting 20 tons, with a displacement of 1 meter, which in the lowered position allows for a reserve of 80 cm of water below the minimum winter depth, when the containers are installed in such a way that the depth of the base of the containers in its lowest position is 80 cm below the minimum winter (and summer) depth determined according to the invention as a function of the water characteristics of the substrate.

In a preferred embodiment, the containers are prefabricated elements designed to be easily transported and installed on the ground.

Such a box 10 can be prefabricated in kit form. The width of a box is slightly less than 2 meters and the length is, for example, 12 meters corresponding to a conventional length of a semi-trailer bed, and the base of each box is an independent exhibit provided on the one hand with connections to be integrally connected to the base of a box on one side and to the base of another box on the other side, and provided on the other hand with connections to be integrally connected to a vertical wall of the container on one side, the vertical wall on the other side is connected to the next container. In the same way, the vertical walls are connected to the upper grids, which are also connected to the upper grids of the preceding and following containers. According to this logic, the containers are packaged for transport in bundles of 2 containers to be installed, connected and fastened together, each bundle having a thickness corresponding to twice the thickness of the box bases plus twice the thickness of the upper box grids plus the thickness of the base-vertical partition and upper grid-vertical partition connections. A number of these bundles are then stacked on a semi-trailer bed for transport to the construction site with the main constraint in terms of transport, given a very low weight constraint, not to exceed the heights allowed on the road.

The storage layers for precipitation water intended for use in deferred irrigation are constituted in an innovative manner according to the invention by juxtaposed empty containers, whose vertical walls and upper horizontal face in the form of grids are fixed but whose horizontal base is equipped with means for sliding vertically between the vertical walls of the box between a maximum depth and a minimum depth.

According to the invention, these containers are also equipped with a network of additional capillary paths which, in the presence of a water table at any level inside the containers, allow the water to rise by capillary action from the said water table to the substrate located above.

To ensure the watertightness of the volume located between the walls above the sliding base, an impermeable membrane can preferably be installed there, which can be, for example, an EPDM membrane 17, fixed in the upper part at the periphery of the box and not fixed to the vertical walls or to the base, but whose dimensions allow it to be placed on the base and to fit the walls when the base of the containers is at its maximum depth and which will spontaneously adapt by folding as the base of the box rises.

The network of capillary paths can preferably be realized by a bundle of flexible capillary fiber wicks connected to the upper grid of the containers and which hang down to the base of the container when the base is at its lowest and which fold up freely as needed when the base of the containers rises.

In the event that the base water is likely to be salty, the flexible capillary fiber wicks connected to the top grid of the containers may not hang down to the base of the box but have a rigid non-capillary portion attached to the base to leave a potentially saltier and therefore heavier pool of water unused at the bottom of the water storage.

Instead of flexible wicks, capillary columns can also be used, but with an upper attachment around an axis of rotation allowing the capillary column to hang vertically downwards when the mobile base is at its lowest, the base of the capillary column being pushed upwards when the base rises by sliding the base of the column on the base and rotating the top of the column on its axis of rotation.

Furthermore, in the case of artificial tanks, it may be useful to provide the upper grid with an additional means of damping.

When a point is located, for example, vertically above a box's upper grid at a point situated between two vertical walls of the box without being in the vicinity of either of these walls the structure of the grid will have a certain tendency to bend and then rebound according to its own elasticity under the effect of a relatively punctual vertical mechanical stress transmitted by the substrate, and the amplitude of this movement and its damping effect are almost negligible when the point of impact is vertical to one of the vertical walls of the box, but all the more important the further one deviates from the nearest vertical wall, this has the double disadvantage of not damping close enough to the walls and of creating heterogeneity of mechanical behavior over the entire ground.

One way to overcome these disadvantages is to have an upper grid whose deflection capacity is relatively negligible compared to the amplitude of movement of its supports on the vertical walls of the containers. It is foreseen for this purpose to have horizontal upper grids which are sufficiently rigid with respect to the distance between the parallel vertical walls, these horizontal grids resting at their ends on the vertical walls of the containers, said containers being equipped at their upper end with one or more elements for joining with the grids allowing to fix and support the grids at their ends, said joining elements being endowed with a damping functionality which is specifically adjusted to provide the surface of the ground with an adequate damping of the mechanical solicitations that correspond to the sport considered.

The resistance to sagging of a grid consisting of an assembly of parallel slats resting at both ends of the length on the vertical walls of the containers, with the width of the slats oriented along the vertical and their section in the horizontal plane is determined according to the material by the width of the slats in relation to their length.

In another preferred embodiment of the invention, compatible with the preceding embodiments, the method of construction and management of the ground is also distinguished by the proposal of a set of new means and methods for active management of the water storage for self-sufficient irrigation of the ground with containers having a movable base in order to overcome the disadvantages of water tanks by juxtaposition of containers having a fixed base.

The objective is to use the presence of the water table in the structure, combined with the type of substrate chosen in the context of the invention, to actively optimize the climate control and oxygenation of the substrate, in a particularly efficient and low-energy cost management mode, by using the low-temperature energy resources naturally available, quite often, in the environment of the field.

In winter, regular oxygenation of the substrate by convection of surface air into the substrate to replace flood water is the most effective means of renewing the air and thus the oxygen in the air of the porous soil, not only eliminating any risk of anoxia but also providing optimal oxygenation for root growth and vitality, even if the air concentration was low all winter.

The residual displacement of the jack given in the example provides for further climbing and the residual force of the hydraulic jack provides for overcoming the percolation resistance force of the cultivation substrate located above the specific storage layer during active water convection operations through the substrate in flooding followed by emptying cycles, said submersion-emptying cycles being used in accordance with the invention both to condition the temperature of the substrate as well as to oxygenate its porosity.

The simple combination of a shallow water table and an inverted water content profile with a relatively low water concentration near the surface is already a favorable context for spontaneous cooling of the substrate by conduction, since this arrangement of the water profile tends to favor the natural flow of heat by conduction from the water table and to isolate the substrate from the influence of the surface temperature, this allows the water table to temper the substrate by its thermal inertia, being cooler in summer and less cold in winter than the surface air. In a preferred embodiment of the invention, the active use of means creating an ascending air convection combined with the structure with an incorporated water table allows an eco-responsible optimization of the summer and winter climate control of the substrate and also of the grass blades of the turfed surface, using the air brought to a favorable temperature, low but sufficient in this type of exchange by convection, and thus allowing the judicious use of the natural energy resources available in the environment of the field, this convective process consuming, with the type of substrate chosen within the framework of the invention, only a marginal mechanical energy compared to the caloric energy transported and exchanged with the substrate and the turf, even in the targeted case of a low temperature difference between the circulating air and the substrate to be climate controlled.

In another preferred embodiment of the invention, which may be combined with the foregoing, an active circulation of air within the substrate is also operable to increase oxygenation or to accelerate drying of the cultivation substrate.

In another preferred embodiment of the invention, which can also be combined with the foregoing, a rapid cycle of rise followed by a fall in the water level can also be used for an even more rapid exchange of calories between the water and the substrate, followed, when the water falls back down, by a renewal of the air in the porosity by air from the atmosphere and thus by a renewal of the oxygenation of the substrate As the thermal inertia of the air is low compared to that of the substrate, the renewed air then takes on the temperature of the substrate, modifying the latter only marginally.

It should also be noted that the air gap inside the box between the water table and the substrate placed on top provides a homogeneous and resistance-free penetration path to the substrate, perfectly suited for maintenance climate control of the substrate and the turf on top by upward air convection through the substrate, with an upstream air distribution network corresponding to the juxtaposition layout of the containers, using the inside of the vertical partitions of the containers as an air distribution network from the outside to the air gap between the water table and the top of the box.

Also, in a preferred embodiment of the invention, the containers are prefabricated plastic elements with self-supporting double-walled vertical walls, the gap between the two walls serving as a pressurized air supply pipe for upward air convection operations, and also is used for import or export water transfers.

Thermal convection by water is more effective in the substrate for a rapid rise (in winter) or fall (in summer) of the substrate temperature, but air convection is a complement for the maintenance of this temperature and the oxygenation of the roots, and the advantage of air convection is that it also concerns the surface of the soil and the blades of turf, which is useful in the event of snow or frost in order to preserve the surface.

In order to manage a large volume of water with a goal of water autonomy, another solution than that of the containers with a mobile base according to the present invention has already been proposed in the state of the art to overcome the disadvantages of the containers with constant volume. This consists of two water storage layers, one above the other and separated from each other by a watertight wall, the layer below being of such a size as to store all the water required for one irrigation season, and with means of pumps and supply pipes to supply the upper storage layer with water from the water stored in the lower storage layer.

This solution is usable within the framework of the invention but does not seem particularly judicious or satisfactory in that it doubles the storage infrastructures and implies a great complexity and slowness of the transfer flows from the lower storage layer to the upper storage layer or vice versa, which does not seem easily achievable under satisfactory economic and practical conditions, and in that it does not allow the upper water table to be used for rapid and low-energy cycles of saturation-drainage of the substrate, the total amount of water in the two tanks is often too small to carry out this type of convection operation, which requires filling all the empty space above the water table and then draining the substrate, either for oxygenation or for the substrate temperature. The volume of the porosity (on the outward journey and in emptying on the return journey), i.e. a very large volume of water to be displaced if it is available, whereas the box with a mobile base only needs a tiny quantity of water corresponding to the volume of the porosity of the substrate to carry out these operations.

I—Description of the Method of Management and Construction of Fields According to the Invention A sports field according to the invention comprises a structure (S) placed on a base (F), said structure comprising (i) N porous layers (Layer Ci), i being comprised between 1 and N, stacked on top of each other, with N≥1, the first layer from the top being comprised between the surface of zero depth Y0=0 and the base of the layer (Layer C1) of depth $Y_1$ and all the layers being comprised between the depth $Y_{i-1}$ of the base of the immediately upper layer (Layer CM) if i>1 or $Y_0$ if i=1 and the depth $Y_i$ of the base of the layer (Layer Ci), and with at least one hybrid layer (H) among the N layers, (ii) a turf whose roots are anchored in this hybrid layer (H) and (iii) means (M) allowing water to be introduced into the structure (S) or to be evacuated from it, (iii) means (M) for introducing or evacuating water into or out of the structure (S), for forming a water table and for managing the piezometric level inside the structure (S) at a shallow depth ($P_{piezo}$), which may vary between a minimum depth ($P_{piezo\ min}$) and a maximum depth ($P_{piezo\ max}$)

The method of managing and constructing fields according to the invention comprises a step of installing turf on the surface of the upper layer (C1), said installation of said turf can be carried out by sowing once said top layer ($C_1$) is installed in its final place during said step of building said structure (S) or can be carried out previously by pre-cultivating said turf on a layer of substrate which is then decomposed into a partition of sub-elements each comprising a volume of substrate of the same thickness with the pre-cultivated turf on its surface and the roots installed therein, these sub-elements being transported and then finally gathered and installed to finalize the construction of said structure (S).

Furthermore, there is at least among the N layers a hybrid layer (H), comprised of either (i) a growing substrate which includes synthetic reinforcing elements, or (ii) a growing substrate which shares the space of the hybrid layer (H) with synthetic reinforcing elements.

Next, an essential point of the invention concerns the step of managing the maximum depth ($P_{piezo}$) of the water table inside the structure (S), to allow good hydration of the turf using capillary flow from said water table.

In a preferred embodiment, the construction method comprises a step of determining:

- the depth $P_{TOR}$ of an oxygenation slice of the turf roots from the surface to said depth $P_{TOR}$, which is greater than or equal to 5 cm and preferably between 5 and 15 cm;
- the minimum air concentration $\theta_{AIR\ MIN\ TOR}$ required within said root oxygenation range, said minimum air content $\theta_{AIR\ MIN\ TOR}$ being greater than or equal to 5% and preferably between 5% and 15%;

In order to allow good hydration of the turf and to ensure good oxygenation of the roots within the oxygenation slice of the roots between the surface and the said depth $P_{TOR}$, the depth $P_{piezo}$ of the water table inside the structure (S) must be maintained for at least part of the time of the year between a minimum depth $P_{piezoMINTOR}$ and the maximum value $P_{piezoMAX}$ which verify the following equations:

$$P_{piezo\ MAX} \leq 2\ \text{m}$$

$$P_{piezoMINTOR} \geq P_{MINTOR} = \text{MAX}\ [Z_i + h_{c\ i\ drainage}(\varepsilon_i - \theta_{AIR\ MIN\ TOR})]_{1 \leq i \leq n(PTOR)}$$

where $n(P_{TOR})$ is the number of layers entirely or partially above said minimum root oxygenation slice (TOR) of thickness $P_{TOR}$ and taking as definition of a layer entirely or partially included in said surface root oxygenation slice (TOR) the fact that $Y_{i-1} < P_{TOR}$, which makes it possible to determine the integer $n\ (P_{TOR}) \leq N$ by the equation:

$1 \leq n\ (PTOR) \leq N$ with $Y_{n(PTOR)-1} < P_{TOR}$ and $Y_{n(PTOR)} \geq P_{TOR}$ where $\varepsilon_i$, is the characteristic total porosity of the layer ($C_i$) in its in situ compactness state; where the function $h_{C\ i\ drainage}$ is the function characterizing the theoretical capillarity of the layer ($C_i$) in its state of in situ compactness, defined as the function that has a value $\theta_{water}$ of volume water content strictly between the water content $\varepsilon_i$, at saturation and the water content at the wilting point associates the value $h_{cdrainage}$ ($\theta_{water}$), which is the equivalent capillary height expressed in cm corresponding to $\theta_{water}$ on the strictly decreasing curve of water content versus capillary pressure on a quasi-static drainage path from the initial saturated state;

defining $Z_i$, for $i \leq n\ (P_{TOR})$, by the relation $Z_i, = Y_i$, for $i < n\ (P_{TOR})$ and $Z_{n(PTOR)} = P_{TOR}$ Moreover, in all cases, and even in the absence of an explicit step of defining $P_{TOR}$ and the minimum air concentration required according to the invention within the root oxygenation slice, a minimum requirement is implicitly required according to the invention, corresponding to what is considered according to the invention to be the minimum necessary requirement: $P_{TOR}$=5 cm and $\theta_{AIR\ MIN\ TOR}$=5%.

Thus, in all cases, the management process requires that the condition:

$$P_{piezo} \geq P_{iezoMIN\ TOR} = \text{MAX}\ [Z_i + h_{c\ i\ drainage}(\varepsilon_i - 5\%)]_{1 \leq i \leq n}(5\ \text{cm})$$

Now, the invention also relates to fields made according to this construction method. The field according to the invention must in any case preferably respect the above equation corresponding to the minimum requirement according to the invention: $P_{TOR}$=5 cm and $\theta_{AIR\ MIN\ TOR}$=5%.

And in general, depending on the requirements in terms of root oxygenation depth and air concentration in the root oxygenation zone, the soil must preferably comply with the equation: $YN \geq P_{piezoMIN\ TOR}$ Or:

$$Y_N \geq P_{MIN} = \text{MAX}\ [Z_i + h_{c\ i\ drainage}(\varepsilon_i - \theta_{AIR\ MIN\ TOR})]_{1 \leq i \leq n}(P_{TOR})$$

Thus, in all cases, to guarantee root oxygenation considered according to the invention as minimal, a sports field according to the invention must always verify the equation for:

$$Y_N \geq P_{pPTOR=5\ cm\ and\ iezoMINTOR} = \text{MAX}\ [Z_i + h_{c\ i\ drainage}(\varepsilon_i - 5\%)]_{1 \leq i \leq n(5\ cm)}$$

For root oxygenation that is considered according to the invention to be easier to achieve with an adequate water table depth scenario, a sports field according to the invention must verify the $_{YN \geq PMIN\ for}$ $P_{TOR}$=8 cm and $\theta_{AIR\ MIN\ TOR}$=10%

Or: $YN \geq \text{MAX}\ [Zi + h_{c\ i\ drainage}(\varepsilon_i - 10\%)]_{1 \leq i \leq n(8\ cm)}$ For root oxygenation considered according to the invention to be very easy to achieve with a suitable water table depth scenario a sports field according to the invention must verify the equation $YN \geq P_{piezoMINTO}R$ for PTOR=12 cm and $\theta_{AIR\ MIN\ TOR}$=15%.

That is: $Y_N \geq \text{MAX}\ [zi + h_{c\ i\ drainage}(\varepsilon_i - 15\%)]_{1 \leq i \leq n(12\ cm)}$ Preferably, also to address the requirements of each realization regarding the sufficient summer air concentration required near the surface not to promote diseases, the depth of the piezometric level of the water table in summer, during the hot period, when the night temperature exceeds 18° C., is set so that the equation is also verified:

$$P_{piezo} \geq 5\ \text{cm} + h_{c\ j\ drainage}(\varepsilon_i - \theta_{AIR\ MIN\ SUMMER\ 5\ cm})$$

where j is the number of the layer in which the points are located at 5 cm depth where $\theta_{AIR\ MIN\ SUMMER\ 5\ cm}$ is the minimum summer air concentration at capillary equilibrium of 5 cm from the surface, required according to the invention depending on the level of requirement of each embodiment.

Depending on the overall requirements of each embodiment, the required value for the minimum summer air content at 5 cm from the surface $\theta_{AIR\ MIN\ SUMMER\ 5\ cm}$ is variable but at least 10% and preferably greater than 15%.

Also, in order to be able to comply with this summer disease control requirement with the implied minimum summer air concentration value at 5 cm from the surface being 10%, a field according to the invention must therefore preferably comply with the equation:

$$Y_N \geq 5\ \text{cm} + h_{c\ i\ drainage}(\varepsilon_i - 10\%)$$

where j is the number of the layer where the points at 5 cm from the surface are located.

where $\theta_{AIR\ MIN\ SUMMER}$ 5 cm is the minimum summer air concentration at capillary equilibrium at 5 cm from the surface, required according to the invention depending on the level of requirement of each realization in order not to favor summer diseases during hot periods.

With respect to the hybrid layer (H) that is formed which comprises synthetic reinforcing elements, or that shares the space of the hybrid layer (H) with synthetic reinforcing elements, this hybrid layer (H) preferably comprises:

an essentially sandy cultivation substrate ($SUB_{sa}$)

synthetic reinforcing elements ($SYNT_{renf}$) which can be:

(a) fragmented and incorporated into the substrate(SUB sab) during substrate manufacture;

(b) fragmented or continuous and incorporated in situ into the substrate after the substrate($_{SUB\ sab}$) has already been installed in situ;

(c) formed into an organized structure previously installed in situ at the location of the clearance layer, the substrate (SUBSTRATE) itself being subsequently incorporated within said structure.

Preferably, the hybrid layer (H) has one of the following configurations.

the synthetic reinforcing elements (SYNT renf) are elongated or surface reinforcing elements such as fibers and the substrate (SUB sab) and these elongated or surface elements are mixed beforehand; this is the classic case of fibered substrates.

the synthetic reinforcing elements ($_{SYNT\ renf}$) are long fibers that are incorporated into the substrate, once the turf is installed; this is the classic case of hybrid fields reinforced in situ with long fibers that are implanted into the substrate in situ, once the turf is installed by the technique known as "tufting," these techniques for creating hybrid fields being also known as "stitched solutions";

the synthetic elements constituting a structure are a synthetic carpet imitating grass with a substrate incorporated between the strands of synthetic turf, a seeding being then carried out to finally constitute a sown synthetic carpet in which a true natural turf grows.

Advantageously, the hybrid layer consists of the patented substrate known under the trade name Radicalé.

Advantageously, the hybrid grass sports field comprises a pool structure with a base (F) and edges and an impermeable membrane placed on the base (F) and under the structure (S) and extending up to the edges of said pool structure, so that the structure (S) has its base and its vertical peripheral edges isolated from the outside by said impermeable membrane.

Advantageously, the hybrid grass sports field comprises a layer of a patented, very coarse porous concrete, which is both highly permeable and highly permeable, known under the trade name Capillary Concreete®.

Advantageously, the hybrid turf sports field comprises a combination of 1-5 layers including:

a 1 to 3 cm "dressing" top layer located if present at the very top of the pile of stacked layers.

a layer of the Radicalé substrate with a thickness of 4 to 20 cm.

a layer of sand with a D10 between 200 and 800 μm located under the Radicalé, with a thickness of 10 to 250 cm, if present.

a layer of Capillary Concreete with a thickness of 5 to 10 cm, if present.

a layer of sand having a D10 between 200 and 800 um located under the Capillary Concreete, with a thickness of 50 to 250 cm, if present.

J—Examples of Structures According to the Invention

The organization of the structure and the relationships to be respected according to the invention are illustrated in the "textbook" example shown in FIG. 1, where N=5 and n=3, i.e. there are 5 layers in the structure, 3 of which are completely comprised for the first two layers and partially comprised for the third layer inside the layer section (TOR), where, according to the invention, a sufficient air content is required in order to guarantee satisfactory oxygenation of the roots.

The description, which is in no way exhaustive, should be read in conjunction with the following figures:

FIG. 1 is a schematic cross-sectional view of a soil comprising 5 layers according to this invention.

FIG. 2 comprises the 4 FIGS. 2A, 2B, 2C and 2D which are 4 examples of compositions from 3 types of layers which can be identified by the pattern used to represent them:

a type of layer consisting of the Radicalé substrate, marked on FIG. 2 with ovals and noted (Ra), a type of layer consisting of Capillary Concreete, which can be identified in FIG. 2 by triangles and is noted (CC)

a type of layer composed of siliceous sand, identifiable on FIG. 2 by rectangles with a cross and noted (SS)

In the 4 cases, the figures represent the aerial part of the turf which is noted (g) and shows an impermeable membrane that is noted (IM) and the means shown as in FIG. 1 by an arrow connecting the layers to a container full of water whose level determines the piezometric level of the water table.

The highest and lowest levels predicted by the water table management process and the level at the moment t of the water table are represented as $P_{piezo}$ mini, $P_{piezo}$ mini and P piezo respectively, and the tidal range is noted (Δ) which is the difference between the highest and lowest level of the water table.

Comparing the four figures showing different examples, we can see that the tidal ranges are not necessarily the same.

FIG. 2A is a schematic cross-sectional view of a soil according to the invention comprising a single layer, consisting of the Radicalé substrate, FIG. 2B is a schematic cross-sectional view of a field according to the invention comprising 2 layers: a layer of the Radicalé substrate at the top and a layer of sand at the bottom.

FIG. 2C is a schematic cross-sectional view of a field according to the invention, also comprising 2 layers: the layer of the Radicalé substrate at the top and a layer of Capillary Concreete at the bottom.

FIG. 2D shows from top to bottom: Radicalé substrate at the top, then Capillary Concreete and finally a layer of sand at the bottom.

FIG. 3 is a graph comparing 4 matrix pressure curves corresponding to 4 types of soil.

The 4 types of soil are a clay soil (T1 type curve), a silty soil (T2 type curve), a sandy soil (T3 type curve) and a substrate soil corresponding to the type of water profile intended in the invention (T4 type curve).

The curves show the relationship between the capillary pressure in logarithmic scale on the vertical axis in relation to the water content by volume $\theta_{WATER}$ in normal scale In the example of FIG. 1, we have N=5 and in this example, the hybrid layer is the 2nd layer ($C_2$), represented with a graphic pattern to suggest the draining and elastic aspect of this layer.

FIG. 1 shows a block of 5 layers $C_1$, $C_2$, $C_3$, $C_4$, $C_5$ on a base (f), and the construction parameters $Y_1$, $Y_2$, $Y_3$, $Y_4$ and $Y_5$.

The depth of 5 cm corresponding to the summer aeration criteria is given and $P_{TOR}$ is the depth of the root oxygenation layer (TOR). In the example in FIG. 1, we have n ($P_{TOR}$)=3.

Also on the right side of this block, there is a silt system communicating with a reservoir (R) that rises and falls and whose water level dictates the water table and with an impermeable membrane (IM). The figure also shows the tidal range (A) between the minimum and maximum water table. Farther right, vectors represent the conditions to be met.

$$Z_1 \leq P_{Min} - X_1, Z_2 \leq P_{Min} - X_2 \text{ and } Z_3 \leq P_{Min} - X_3, \text{ with:}$$

$$X1 = h_{c1\ drainage}(1 - \theta_{AIRMINTOR}) \text{ and } X_2 = h_{c2\ drainage}(2 - \theta_{AIR\ MIN\ TOR})$$

In FIG. 1, these quantities $Z_1$, $Z_2$, $Z_3$ and $X_1$, $X_2$ and $X_3$ which correspond to the example are also represented by vectors. These quantities appear on the right-hand side of FIG. 1 as vectors directed upwards with their origin at the depth $P_{Min}$ and this makes it possible to see whether the tip of the vector Xi is lower or higher than the tip of the vector Zi directed downwards from the surface because the condition to be respected according to the invention is diagrammatically to have the tip of the vector Zi situated higher than the tip of the vector Xi.

Thus, it can be seen that in the example shown in FIG. 1, the 3 equations are indeed satisfied, since $Z_1 < P_{Min} - X_1$, $Z_2 \leq P_{Min} - X_2$ and $Z_3 \leq P_{Min} - X_3$.

Moreover, FIG. 1 also illustrates the possibility of complying with the summer condition. In fact, in order to be able to respect the summer condition according to the invention when we will lower the level of the water table to the maximum up to $P_{piezo\ Max}$, we must also verify in this example the following equation: $5\ cm \leq P'_{piezo\ Max} - X'$ with: $X' = h'_{c\ drainage}(\varepsilon_2 - \theta_{AIR\ MIN\ SUMMER\ 5\ cm})$, where h'c is the profile function from the depth $P_{piezo\ Max}$.

According to this example, it can be seen that if $P_{piezo\ Min}$ had been smaller and/or X3 had been a little larger, the relationship would not have been respected. We also see that if the substrate of layer 2 had been the substrate of layer 1 we would have had X1=X2 and in this case we would have had: $Z_2 > P_{piezoMin} - X_2$.

If the $\theta_{AIR\ MIN\ TOR}$ requirement had been a higher air content, we would have had larger X1, X2 and X3 and therefore at least for layer 3, the equation would not have been satisfied.

Similarly, if the BAIR MIN TOR requirement had been that of the example in FIG. 1, but the substrate of layer 3 had been a finer grained substrate, the $h_{c\ 3\ drainage}$ function would have decreased more rapidly and as a consequence X3 would also have been larger, and the equation would not have been satisfied either.

Finally, on the right-hand side of FIG. 1 are the 5 cm vector from the surface and the X' vector from the maximum depth $P_{piezo\ max}$, to check whether the peak of this vector is lower than the peak of the 5 cm vector, which corresponds to the summer conditions, which are indeed observed in the example shown in FIG. 1.

Thus, FIG. 1 represents all the elements that allow one to visually observe in a graphic manner that the example shown is indeed in conformity with the conditions sought by the invention.

An example of 4 typical embodiments is illustrated by FIG. 2, which represents 4 particular structures.

Furthermore, the link between the intrinsic characteristics of the soil and the structure according to the invention will then be illustrated by the analysis of 4 soils representing 4 relatively typical cases and represented on the same FIG. 3 by their capillary pressure curves.

Different combinations of diversified layers can be found, starting from the surface, such as the following example:

- On the surface, a top layer with a thickness of a few millimeters to 1 or 2 cm can be found to provide specific functionalities to this interface, in particular for slip management.
- On the surface or just below the top layer, the hybrid layer is normally present, as it is this surface layer that must play a mechanical, biomechanical role that gives the surface its specific qualities. This layer can be between 5 and 25 cm thick, depending on the sport and the requirements, bearing in mind that the thickness of this layer has a significant impact on the overall cost of the structure.
- Under the hybrid layer, a layer of sand can be used to take over the role of the hybrid layer, which is less effective from a mechanical and hydraulic point of view but more economical.

Underneath these layers, a layer of a material (CC) known under the brand name Capillary Concreete, which is an extremely porous capillary concrete. Ideally, this layer of (CC) has a very high macro-porosity and therefore has a maximum storage capacity per centimeter of the layer and a particularly low mechanical flow resistance, which allows for a perfect horizontal homogenization of the convection flows and an almost negligible mechanical flow resistance power.

Under the hybrid layer, a layer of sand may be found, which may be several dozen centimeters to 1 or 2 meters thick, and which serves both to lower the water table for the summer and to store winter rainwater for summer use.

Finally, underneath these layers, one can find an impermeable membrane that otherwise extends to the edges of the structure.

The following examples of preferred embodiments, which are not exhaustive either, illustrate in a concrete manner various methods of construction and management of sports fields according to the invention.

Since the invention concerns a structure comprising one or more stacked layers, the examples below will be given by taking examples with 1 then 2 then 3 layers, mainly chosen for their different characteristics and functions.

Thus, a first embodiment is possible with a single layer, as illustrated in FIG. 2A.

This is a single layer of the Radicalé substrate with a thickness of 20 to 40 cm, placed on an impermeable membrane that extends peripherally along the edges to the surface.

A second embodiment illustrated by FIG. 2B is possible, according to the same model but replacing the single layer of the Radicalé substrate with a Radicalé layer of 8 to 30 cm (depending on the sport considered and the level of performance sought) on a layer of coarse sand of 20 to 200 cm.

This two-layer structure does not excessively alter performance, as long as the upper layer of Radicalé is thick enough to withstand the mechanical stresses of the sport in question. A very deep structure with a thick sand layer and a deeper layer at the end of a prolonged summer drought in arid climates is certainly less effective, but it does allow the turf to play an important ecological role with economical water storage.

Ideally, from the point of view of turf quality, one can have a top Radicalé layer of 8 to 12 cm thick and a layer of sand 30 to 50 cm thick, with a water table of 40 cm at the time of the July heat wave and which can continue to drop to 60 cm until the first rains in autumn. Thus, the water table can vary between 15 cm and 60 cm in depth, and is mostly below 20 cm and around 40 cm at the time of the heat waves.

A third embodiment shown in FIG. 2C, also in two layers, is also possible by replacing the sand with a product known as CC or Capillary Concreete, which is a very porous concrete with very large pores and at the same time with high capillarity.

A first advantage of CC is that the additional storage volume per 10 cm of additional layer is 7 cm of water and that, above all, there is no need for a water filter. There is no need for drains to distribute the air or water horizontally under pressure or lack of pressure to create an upward or downward movement of air or water, because the permeability is such that the CC provides a perfect distribution layer without any delay and without any significant mechanical resistance, which makes it possible to create vertical convection in the substrate above it from a homogeneous horizontal base.

A second advantage of CC is that it is a perfectly stable surface on which vehicles can be driven or stands installed and that a Radical6 layer can be installed on CC and removed and put back on later, leaving a perfectly clean, load-bearing and draining surface that can be used for multi-functional stadiums.

However, the question of the economic cost remains problematic if one wants very thick layers of CC for large storage capacity.

Other important examples have already been described in the section on structures consisting of a thin substrate layer on a specially designed artificial storage layer, such as:

- sports grounds where the capillary storage layer is an artificial capillary storage layer specifically designed for this purpose with a thickness of ≥5 cm and where the cultivation substrate laid on top is between 12 cm and 19 cm thick.
- sports grounds with a capillary storage layer specifically designed for this purpose with a thickness of 8 cm and with a substrate thickness of between 13 cm and 22 cm.
- sports grounds whose capillary storage layer is an artificial capillary storage layer specifically designed for this purpose with a thickness≥15 cm and with the cultivation substrate laid on top of it having a thickness between 16 cm and 25 cm.

The invention claimed is:

1. A method for the construction and management of a hybrid turf sports field, the method comprising:

a first step for constructing a structure (S) placed on a base (F), the said structure comprising N stacked porous layers ($C_i$), N≥1, a lower layer ($C_N$) being erected first on the base (F) and each porous layer ($C_i$) being then placed on a layer ($C_{1+1}$) up to a top layer ($C_1$) which is comprised between a surface of zero depth ($Y_0$=0) and the bottom of the layer ($C_1$) at a depth $Y_1$, all layers being comprised between the depth $Y_{i-1}$ of the base of a next higher layer ($C_{i-1}$), if >1, or $Y_0$, if i=1, and the depth $Y_i$ of the base of the layer ($C_i$);

a second step of installing turf on the surface of the top layer ($C_1$), said installation of said turf being carried out by sowing seeds, once said top layer ($C_1$) has been placed in a definitive position during said first step, or can be carried out beforehand by pre-cultivating grass on a layer of substrate which is then cut into a partition of sub-elements each comprising a volume of substrate of the same thickness with the turf pre-cultivated on a surface of the substrate and the roots installed therein, these sub-elements being transported and then finally gathered and placed in order to finalize the construction of said structure (S);

a step of providing at least one hybrid layer (H) among the N porous layers, consisting of either (i) a cultivation substrate (SUB sab) which comprises synthetic reinforcing elements or (ii) a cultivation substrate (SUB sab) which shares the space of the hybrid layer (H) with synthetic reinforcing elements;

said at least one hybrid layer (H) comprising one of the following configurations:

synthetic reinforcing elements (SYNT renf) which are elongated or which are surface reinforcing elements, and the cultivation substrate (SUB sab) and the synthetic reinforcing elements (SYNT renf) are premixed;

synthetic reinforcing elements (SYNT renf) which are incorporated into the cultivation substrate (SUB sab), once the turf is placed, and synthetic reinforcing elements (SYNT renf) which are incorporated into the cultivation substrate (SUB sab), once the turf is installed, wherein the synthetic elements are a synthetic carpet with a substrate incorporated between the strands of the synthetic carpet, a seeding is then carried out to finally constitute a sown synthetic carpet in which a real natural turf grows; and a step to manage a depth ($P_{piezo}$) of a piezometric level of a water table inside the structure (S), to allow for good hydration of the turf using capillary flow from said water table.

2. The method for the construction and management according to claim 1, further comprising a step for defining:

a depth $P_{TOR}$ of an oxygenation range of the turf roots from the surface to said depth $P_{TOR}$, which is greater than or equal to 5 cm;

a minimum air concentration θ required within said oxygenation range, said minimum air concentration being greater than or equal to 5%; and in that, in order to allow for good hydration of the turf and to ensure good oxygenation of the roots within the oxygenation range of the roots between the surface and the said depth $P_{TOR}$, the depth Piezo of the piezometric level of the water table within the structure (S) is maintained for at least part of the time of the year between a minimum depth $P_{piezoMINTOR}$ and a maximum value $P_{piezoMAX}$ which satisfy the following equations:

$$P_{piezo\ MAX} \leq 2\ \text{m}$$

$$P_{piezo\ MINTOR} \geq P_{MIN\ TOR} = \text{MAX}\ [Zi + h_{c\ i\ drainage}(E_i - \theta_{AIR\ MIN\ TOR})]_{1 \leq i \leq n(PTOR)}$$

where n($P_{TOR}$) is the number of layers entirely or partially above said minimum root oxygenation slice (TOR) of thickness $P_{TOR}$ and by considering as a definition of a layer entirely or partially included in said surface root oxygenation slice (TOR) the fact that $Y_{i-1} < P_{TOR}$, which defines the integer n ($P_{TOR}$)≤N by the equation:

$$1 \leq n(P_{TOR}) \leq N \text{ with } Yn(P_{TOR}) - 1 < P_{TOR} \text{ and } Yn(P_{TOR}) \geq P_{TOR}$$

where $\varepsilon_i$ is the characteristic total porosity of the porous layer ($C_i$) in an in situ state of compaction of the porous layer ($C_i$);

where the function $h_{c\ i\ drainage}$ is the function characterizing the theoretical capillarity of the porous layer ($C_i$)

in the state of in situ compaction of the porous layer ($C_i$), defined as the function which has a value $\theta_{water}$ of water concentration by volume strictly comprised between the water concentration $\varepsilon_i$ at saturation and a water concentration at a wilting point corresponds to the value $h_{cdrainage}(\theta_{water})$, which is the equivalent capillary height expressed in cm corresponding to $\theta_{water}$ on the strictly decreasing water concentration versus capillary pressure curve on a quasi-static drainage path from the initial saturated state;

by defining $Z_i$ for $i \leq n$ ($P_{TOR}$), by the relation $$Z_i = Y_i \text{ for } i < n(P_{TOR}) \text{ and } Z_n(P_{TOR}) = P_{TOR}.$$

3. The method for the construction and management according to claim 1, further comprising:

a step to define the minimum summer air concentration $\theta_{AIR\ MIN\ SUMMER\ 5\ cm}$ required at 5 cm from the surface at theoretical capillary balance, $\theta_{AIR\ MIN\ SUMMER\ 5\ cm}$ is greater than 10%, to allow for good hydration of the turf and to meet this requirement of summer air concentration near the surface, the said depth $P_{piezo}$ of the piezometric level of the water table inside the structure (S) is maintained, during the times of the year when the night temperature exceeds 18° C., in such a way that the following equation is satisfied:

$$P_{piezo} \geq P_{piezo\ AIR\ MIN\ SUMMER\ 5\ cm} = 5\text{ cm} + h_{c\ j\ drainage}(\varepsilon_j - \theta_{AIR\ MIN\ SUMMER\ 5\ cm})$$

where j is the number of the layer ($C_j$) at 5 cm depth.

4. A hybrid turf sports ground, comprising:

a structure (S) placed on a base (F), with said structure (S) comprising:

(i) N porous layers ($C_i$) with $1 \leq i \leq N$ stacked, with a first layer from a top being between a surface of zero depth Yo=0 and a base of a layer ($C_1$) with a depth $Y_1$ and with all layers being between a depth $Y_{i-1}$ of the base of a next higher layer ($C_{i-1}$) if i>1 or $Y_0$ if i=1 and the depth $Y_i$ of a base of a porous layer ($C_i$), and with at least one hybrid layer (H) among the N porous layers, (ii) a turf whose roots are anchored in the at least one hybrid layer (H);

(iii) means (m) for introducing water into or removing water from the structure (S), for forming a water table therein and for managing the depth ($P_{piezo}$) of the piezometric level of said water table inside said structure (S);

wherein the at least one hybrid layer (H) consists of either (i) a cultivation substrate (SUB sab) which comprises synthetic reinforcing elements (SYNT renf), or (ii) a cultivation substrate (SUB sab) which shares the space of the at least one hybrid layer (H) with synthetic reinforcing elements (SYNT renf), wherein the at least one hybrid layer (H) comprises the synthetic reinforcing elements (SYNT renf) having one of the following configurations:

the synthetic reinforcing elements (SYNT renf) are elongated or are surface reinforcing elements, and the cultivation substrate (SUB sab) and the synthetic reinforcing elements (SYNT renf) are premixed;

the synthetic reinforcing elements (SYNT renf) are incorporated into the cultivation substrate (SUB sab), once the turf is placed; and the synthetic reinforcing elements (SYNT renf) are incorporated into the cultivation substrate (SUB sab), once the turf is installed, wherein the synthetic reinforcing elements (SYNT renf) are a synthetic carpet with the cultivation substrate (SUB sab) incorporated between strands of the synthetic carpet.

5. The hybrid turf sports ground according to claim 4, wherein, in order to be able to address the requirement of air concentration near the surface for minimum oxygenation of the roots, the structure (S) has characteristics meeting the equation:

$$Y_N \geq \underset{(P_{TOR})}{\text{MAX}}\ [Z_i + h_{c\ i\ drainage}(E_i - \theta_{AIRMINTOR})]_{1 \leq i \leq n}$$

with $P_{TOR}$=5 cm and $\theta_{AIRMINTOR}$=5% where $\varepsilon_i$ is the characteristic total porosity of the porous layer ($C_i$) in a compaction state of the porous layer ($C_i$) in situ;

where the function $h_{C\ i\ drainage}$ is the function characterizing the theoretical capillarity of the porous layer ($C_i$) in the state of compaction of the porous layer ($C_i$) in situ, said function $h_{C\ i\ drainage}$ being defined as the function which to a value $\theta_{water}$ of water concentration by volume strictly comprised between the water concentration at saturation and a water concentration at a wilting point associates the value $h_{C\ i\ drainage}$ ($\theta_{water}$) which is the equivalent capillary height expressed in cm corresponding to $\theta_{water}$ on the main drainage curve, a strictly decreasing curve of water content at capillary equilibrium with respect to the capillary pressure on a quasi-static drainage path from the initial saturated state;

where the number n($P_{TOR}$) of layers fully or partially above $P_{TOR}$ is an integer defined by the equation:

$$1 \leq n(P_{TOR}) \leq N \text{ and } Y_n(P_{TOR})_{-1} < P_{TOR} \text{ and } Y_n(P_{TOR}) \geq P_{TOR}$$

by defining $Z_i$ where $i \leq n(P_{TOR})$ by the equation $Z_i = Y_i$ where $i < n$ ($P_{TOR}$) and Zn($P_{TOR}$) being equal to $P_{TOR}$.

6. The hybrid turf sports ground according to claim 4, wherein the structure (S), in order to be able to meet the requirement of the air concentration near the surface so as not to promote summer illnesses during a heatwave, has characteristics meeting the equation:

$$Y_N \geq 5\text{ cm} + h_{Cj\ drainage}(\varepsilon_j - 15\%)$$

where j is the number of the layer located at a depth of 5 cm and $\varepsilon_j$ is the total porosity characteristic of the porous layer ($C_j$) in a state of compaction of the porous layer ($C_j$) in situ.

7. The hybrid turf sports ground according to claim 4, wherein the at least one hybrid layer (H) comprises:

cultivation substrate (SUB sab) is sandy; and the synthetic reinforcing elements (SYNT renf) which is:

(a) fragmented and incorporated into the cultivation substrate (SUB sab) during the manufacture of the cultivation substrate (SUB sab); or (b) fragmented or continued and incorporated in situ into the cultivation substrate (SUB sab) after the cultivation substrate (SUB sab) has already been placed in situ; or (c) an organized structure previously placed in situ at the location of the at least one hybrid layer (H) as a playing layer, the cultivation substrate (SUB sab) being subsequently incorporated into said organized structure.

8. The hybrid turf sports ground according to claim 4, wherein the at least one hybrid layer (H) is comprised of one of the following configurations:

the synthetic reinforcing elements (SYNT renf) are fibers, and the cultivation substrate (SUB sab) and the fibers are premixed;

the synthetic reinforcing elements (SYNT renf) are elongated fibers that are incorporated into the cultivation substrate (SUB sab), once the turf is placed;

the synthetic reinforcing elements (SYNT renf) are elongated fibers that are incorporated into the cultivation substrate (SUB sab), once the turf is installed, wherein a seeding is then carried out to finally constitute a sown synthetic carpet in which a real natural turf grows.

9. The hybrid turf sports ground according to claim 8, wherein the at least one hybrid layer (H) consists of the substrate composed of a predetermined substrate material.

10. The hybrid turf sports ground according to claim 4, further comprising:

an impermeable membrane, wherein the structure (S) is a pool structure and the base (F) is a formed base, and the impermeable membrane is placed on said formed base (F) and under the structure (S) and extending up to edges of said pool structure, so that the structure (S) has base (F) and vertical peripheral edges isolated from the outside by said impermeable membrane.

11. The hybrid turf sports ground according to claim 4, wherein one of the N porous layers of the structure (S) consists of a predetermined porous concrete, with coarse porosity, which is both permeable and porous.

12. The hybrid turf sports ground according to claim 4, wherein the structure (S) comprises a substrate layer with a thickness of 10 to 40 cm placed on a capillary storage layer with a thickness of 5 cm to 200 cm and located between a depth $P_{ROOF}$ of a roof of the substrate layer and a depth $P_{BASE}$ of a base of the substrate layer, and wherein:

$P_{ROOF} \geq P_{Min}$ and $P_{BASE} = P_{Max}$; and said capillary storage layer has natural capillary characteristics or by the artificial addition of suitable means enabling water to rise into the layer of substrate placed above the capillary storage layer, whatever the piezometric level of the water table between $P_{ROOF}$ and $P_{BASE}$, with a capillary flow at least equivalent to that which would result from the same evaporative demand at the top of the same substrate placed on a medium sand between 250 μm and 500 μm with a water table at the same depth.

13. The hybrid turf sports ground according to claim 12, wherein the capillary storage layer comprises a combination of 1 to 7 layers including at least one of:

a layer of sand with a D10 of between 200 and 800 μm, with a thickness of 5 cm to 200 cm;

a layer of substrate composed of a predetermined substrate material with a thickness of 4 to 20 cm;

a layer consisting of a juxtaposition of containers with a thickness of 7 cm to 15 cm, said containers being provided with a bundle of vertical capillary columns allowing capillary rise through the air-filled void above the level of the water table;

a layer of gravel from 7 cm to 150 cm, said layer of gravel being provided with a bundle of vertical capillary columns or capillary wicks allowing capillary rise through the capillary barrier constituted of the essentially air-filled porosity of the gravel above the water table;

a layer of the predetermined porous concrete, with a thickness of 5 to 15 cm;

a layer of sand having a D10 between 200 and 800 μm located under the layer of the predetermined porous concrete, with a thickness of 10 to 250 cm; and a layer composed of hard or soft fibrous materials, natural or artificial, fibrous materials crushed or in pieces such as coral, chalk, crushed wood or clusters or balls of fibers, natural balls of Posidonia, pieces of carpet, all constituting a porous medium with high macroporosity between the aggregated constituent elements and a capillary network within the aggregated constituent elements.

14. The hybrid turf sports ground according to claim 12, wherein the capillary storage layer is an artificial capillary storage layer comprising at least one of:

a layer consisting of a juxtaposition of containers, with a thickness of 8 cm to 15 cm, said containers being provided from the top to the bottom of the layer with a bundle of vertical capillary columns allowing capillary ascent through the air-filled void above the level of the water table; and a layer of the predetermined porous concrete, with a thickness of 5 to 15 cm.

15. The hybrid turf sports ground according to claim 12, wherein the capillary storage layer is an artificial capillary storage layer with a thickness of ≥5 cm and the cultivation substrate (SUB sab) placed on said artificial capillary storage layer has a thickness between 12 cm and 19 cm.

16. The hybrid turf sports ground according to claim 12, wherein the capillary storage layer is an artificial capillary storage layer with a thickness of at least 8 cm and the cultivation substrate (SUB sab) placed on said artificial capillary storage layer has a thickness between 13 cm and 22 cm.

17. The hybrid turf sports ground according to claim 12, wherein the capillary storage layer is an artificial capillary storage layer with a thickness of at least 15 cm and the cultivation substrate (SUB sab) placed on said artificial capillary storage layer has a thickness of between 16 cm and 25 cm.

18. The hybrid tuft sports ground according to claim 4, wherein the structure (S) comprises a combination of 1 to 5 layers including at least:

a top dressing layer from 1 to 3 cm located at the at a top of a stack of overlapping layers, a substrate layer composed of a predetermined substrate material with a thickness of 4 to 20 cm, a layer of sand having a D10 between 200 and 800 μm located under the substrate composed of a predetermined substrate material, with a thickness of 5 cm to 250 cm, a layer of the predetermined porous concrete with a thickness of 5 to 10 cm, and a layer of sand having a D10 between 200 and 800 μm located under the predetermined porous concrete, with a thickness of 10 to 250 cm.

* * * * *